US005754210A

United States Patent [19]

Haneda et al.

[11] Patent Number: 5,754,210

[45] Date of Patent: May 19, 1998

[54] OPTICAL SYSTEM ASSEMBLING DEVICE FOR AN IMAGE FORMING APPARATUS

[75] Inventors: Satoshi Haneda; Tadayoshi Ikeda; Masakazu Fukuchi; Shuta Hamada; Hisayoshi Nagase; Hiroyuki Tokimatsu, all of Hachioji; Toshihide Miura, Koganei, all of Japan

[73] Assignee: Konica Corporation, Tokyo, Japan

[21] Appl. No.: 625,285

[22] Filed: Apr. 1, 1996

[30] Foreign Application Priority Data

| | | | |
|---|---|---|---|
| Apr. 5, 1995 | [JP] | Japan | 7-080252 |
| Apr. 7, 1995 | [JP] | Japan | 7-082621 |
| Jul. 11, 1995 | [JP] | Japan | 7-174881 |
| Sep. 11, 1995 | [JP] | Japan | 7-232654 |

[51] Int. Cl.[6] ..... G03G 15/00

[52] U.S. Cl. ..... 347/116; 399/39

[58] Field of Search ..... 347/115, 116, 347/118, 119, 232, 251; 399/39, 51, 52, 146, 178

[56] References Cited

U.S. PATENT DOCUMENTS

| | | | |
|---|---|---|---|
| 4,611,901 | 9/1986 | Kohyama et al. . | |
| 5,001,499 | 3/1991 | Waragai et al. . | |
| 5,061,960 | 10/1991 | Kitajima et al. | 399/47 |
| 5,175,570 | 12/1992 | Haneda et al. | 347/116 |
| 5,495,277 | 2/1996 | Imamura et al. | 347/171 |
| 5,608,498 | 3/1997 | Nagase et al. | 399/130 |
| 5,619,308 | 4/1997 | Kinoshita et al. | 399/48 |

FOREIGN PATENT DOCUMENTS

| | | |
|---|---|---|
| 0 644 444 A1 | 3/1995 | European Pat. Off. . |
| 0 701 180 A2 | 3/1996 | European Pat. Off. . |

*Primary Examiner*—Matthew V. Nguyen

*Attorney, Agent, or Firm*—Frishauf, Holtz, Goodman, Langer & Chick

[57] ABSTRACT

An optical system assembling method in an image forming apparatus in which there are provided an image forming body around which a plurality of exposure device each having a linear exposure optical system to imagewise expose on the image forming body, and a plurality of developing device containing respective color toners different from each other which are superimposed on the image forming body to form a color toner image, the method further having the steps of: lighting the exposure optical system; forming an image emitted from the exposure optical system on a sensor which is disposed at a position corresponding to a photosensitive surface of the image forming body with respect to the exposure optical system; adjusting a position of the exposure optical system on the basis of a result of the image forming so that a focal point of the exposure optical system is coincident with a surface of the sensor; and fixing at the adjusted position the exposure optical system to an optical system supporting body provided on a main body of the apparatus.

17 Claims, 43 Drawing Sheets

FIG. 20 ( a )
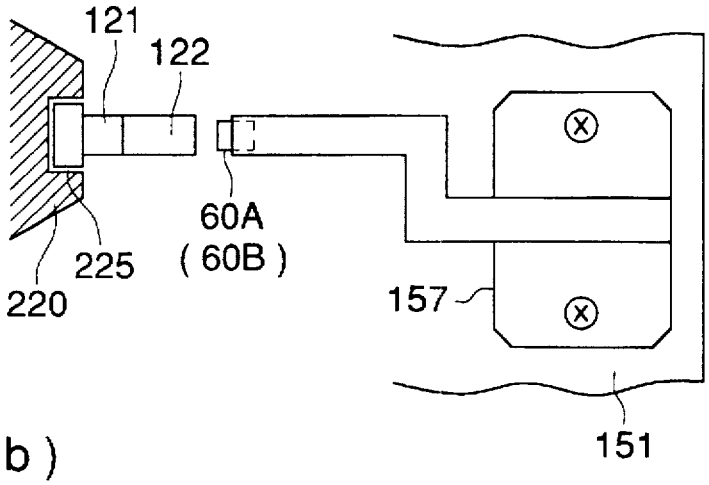
FIG. 20 ( b )
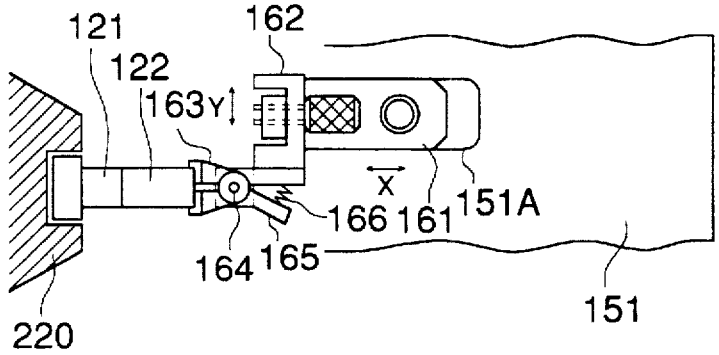
FIG. 20 ( c )
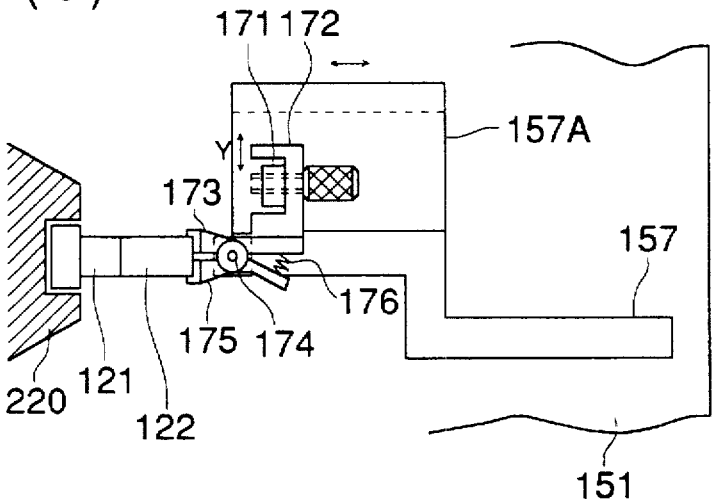

FIG. 32 ( a )
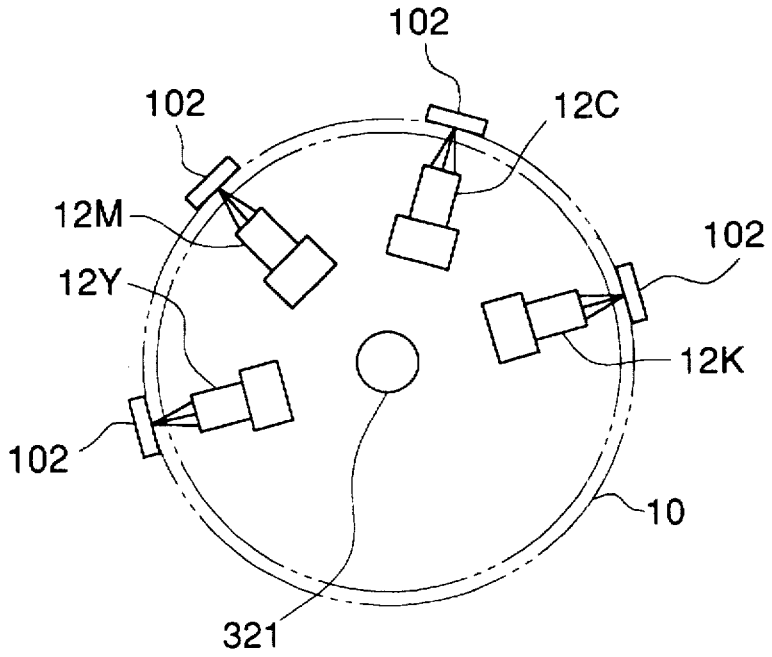
FIG. 32 ( b )
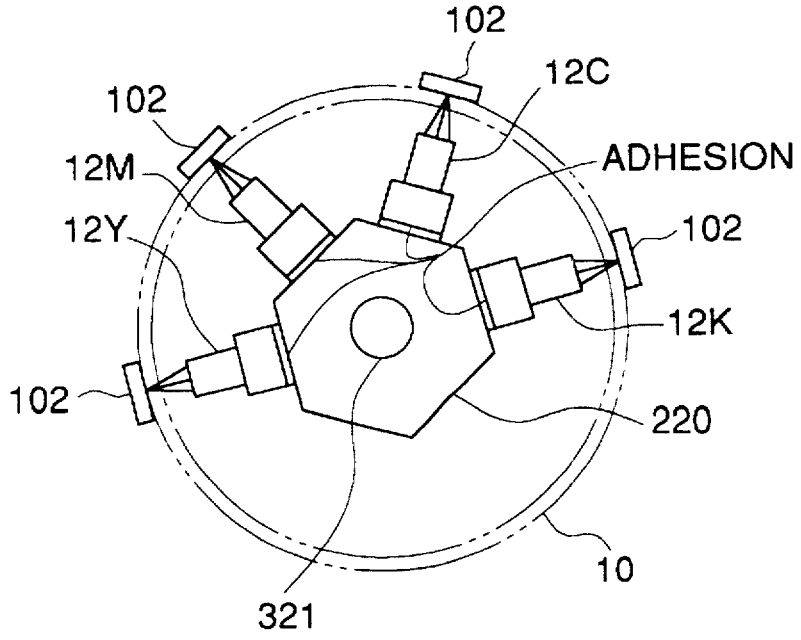

FIG. 33 ( a )
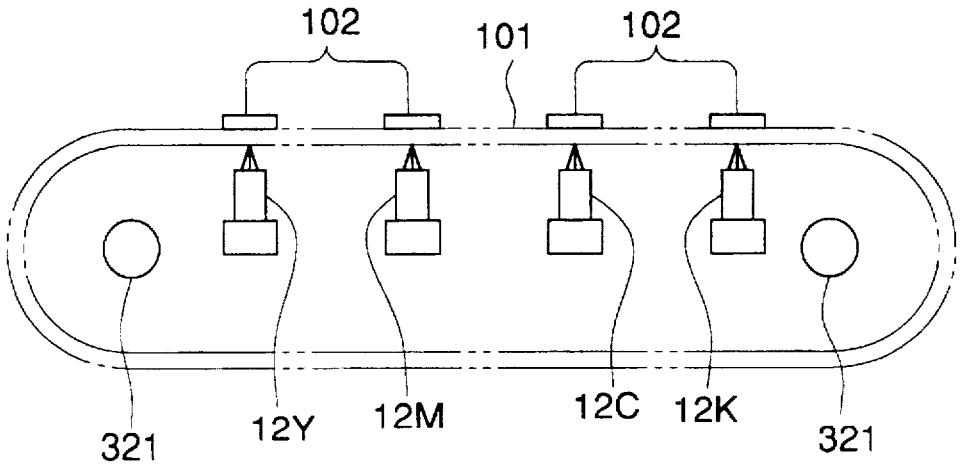
FIG. 33 ( b )
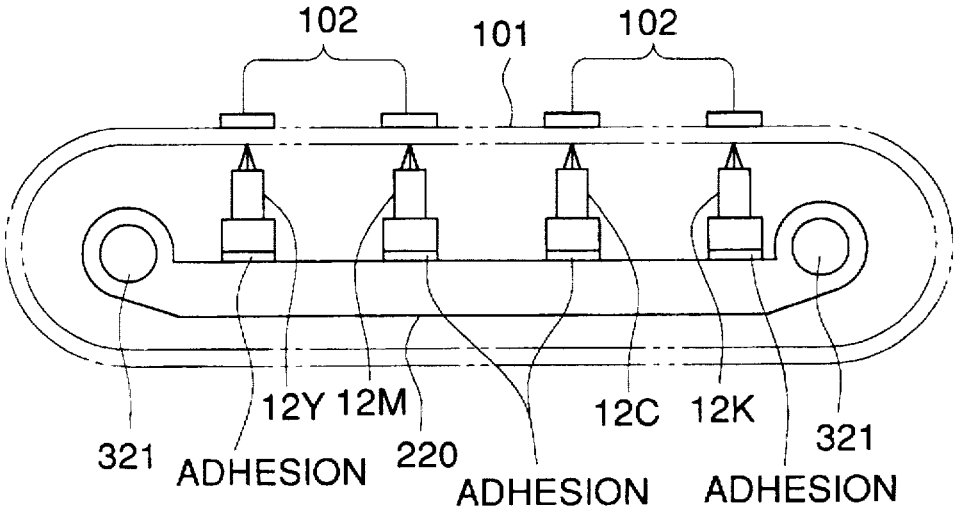

FIG. 34 ( a )
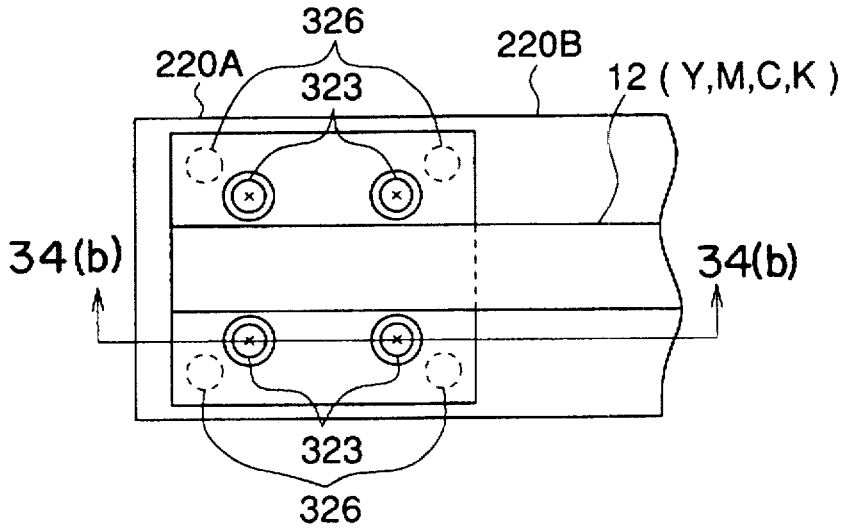
FIG. 34 ( b )
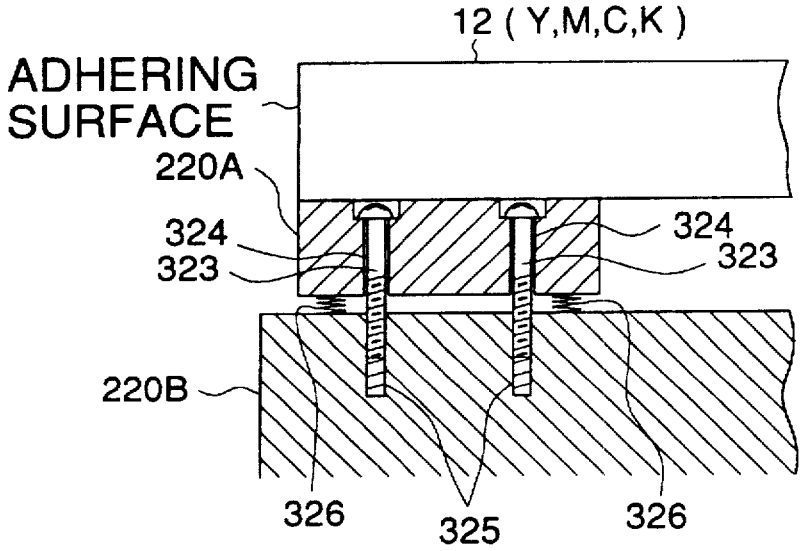

FIG. 37 ( a )
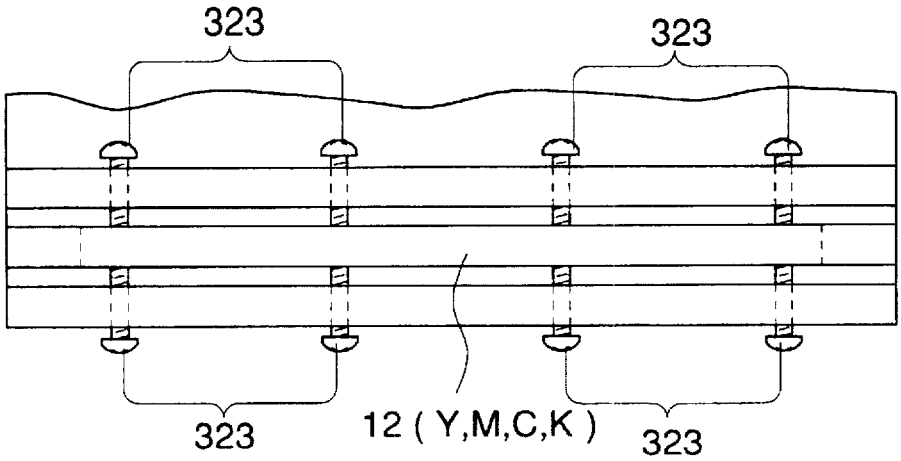
FIG. 37 ( b )
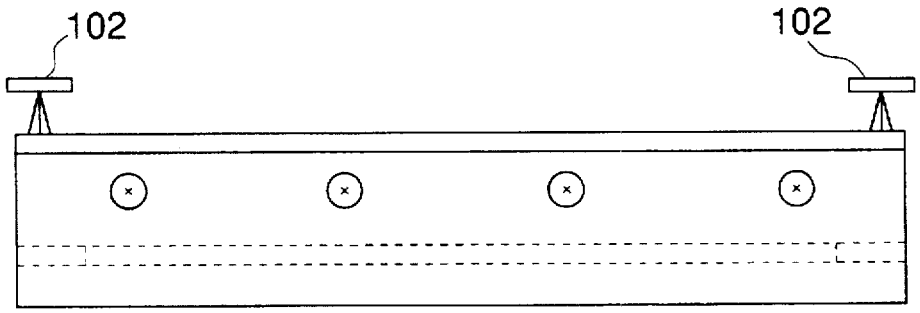
FIG. 37 ( c )
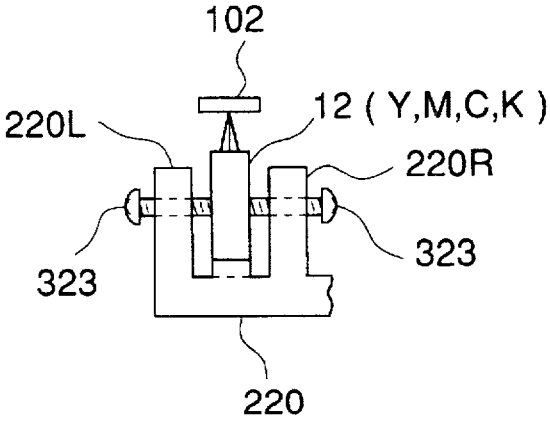

FIG. 38 ( a )
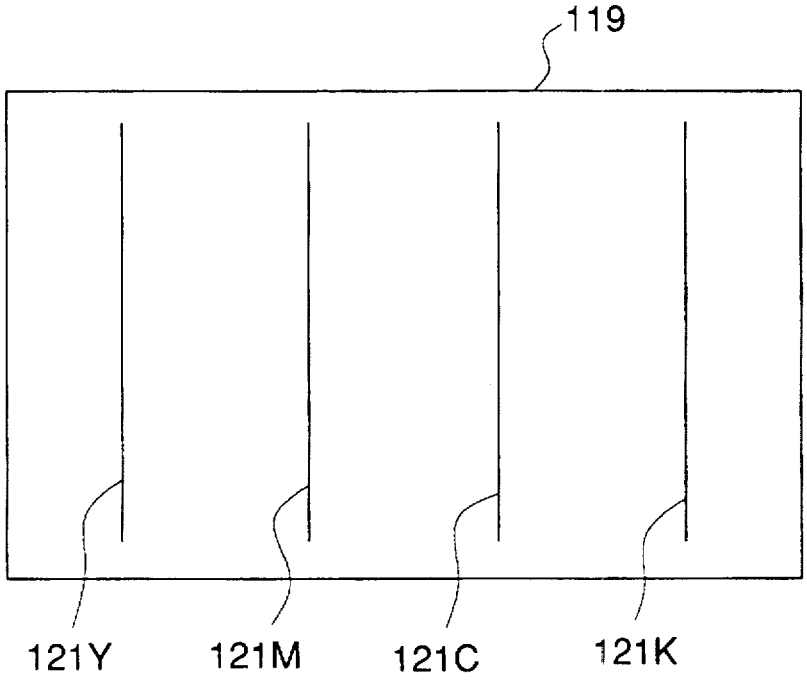
FIG. 38 ( b )
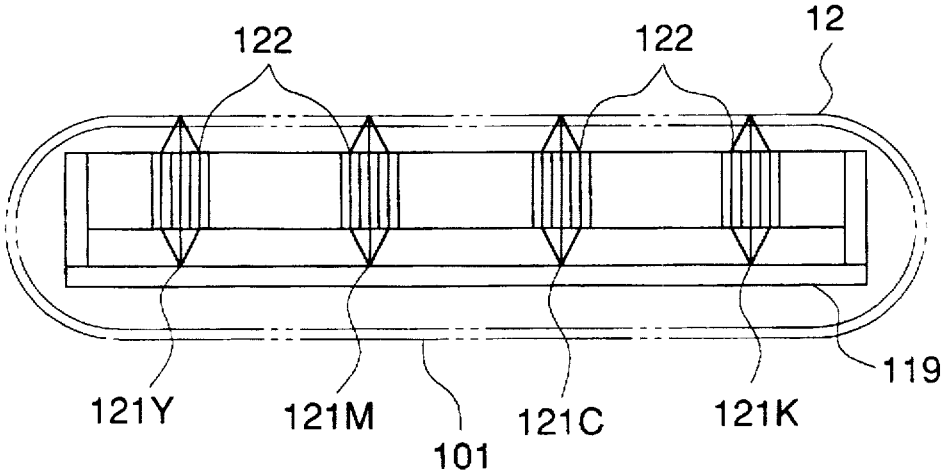

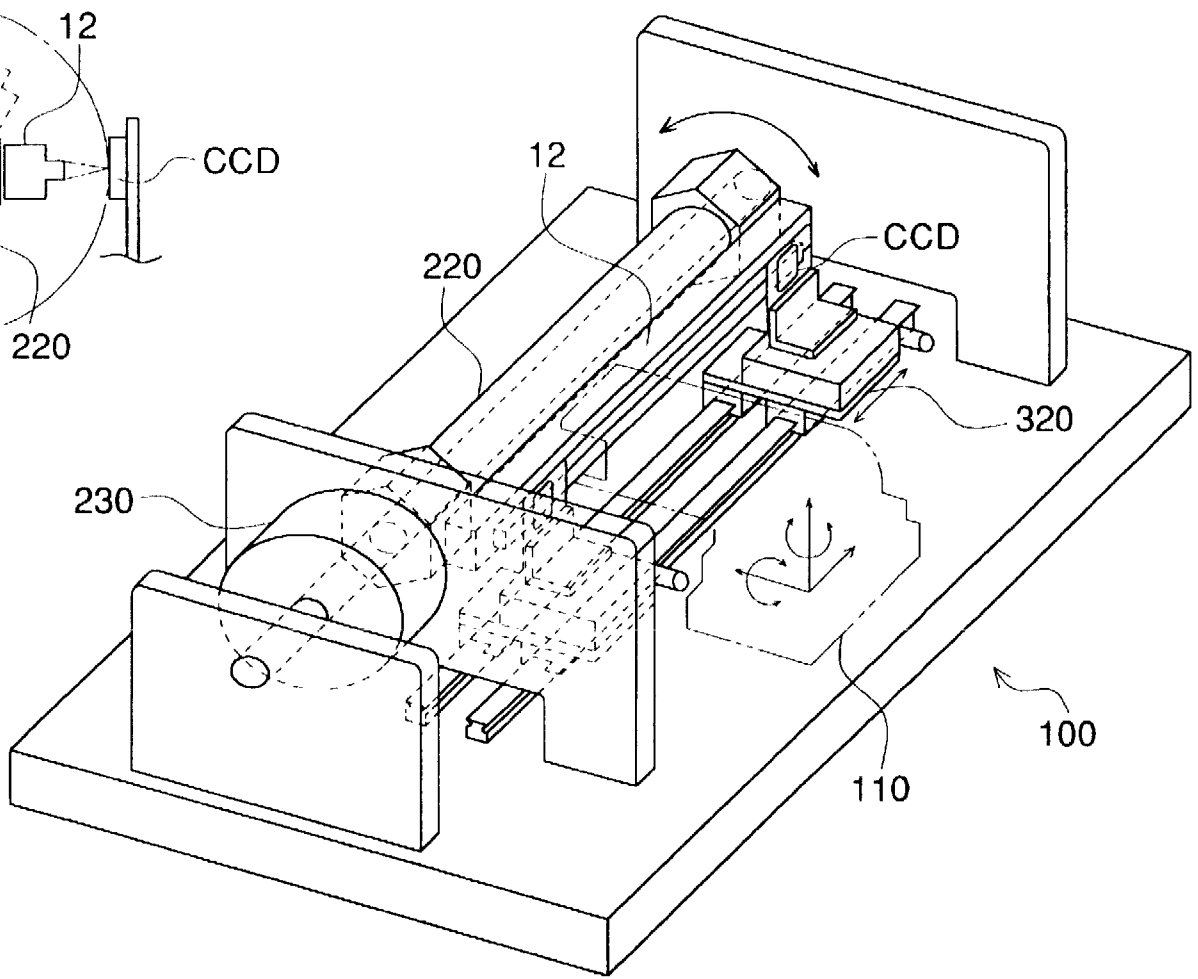
FIG. 42 ( a )
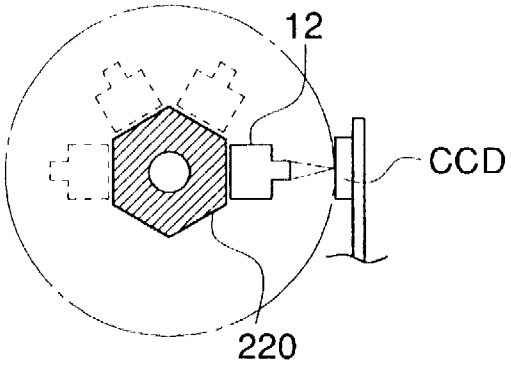
FIG. 42 ( b )

FIG. 45 ( a )
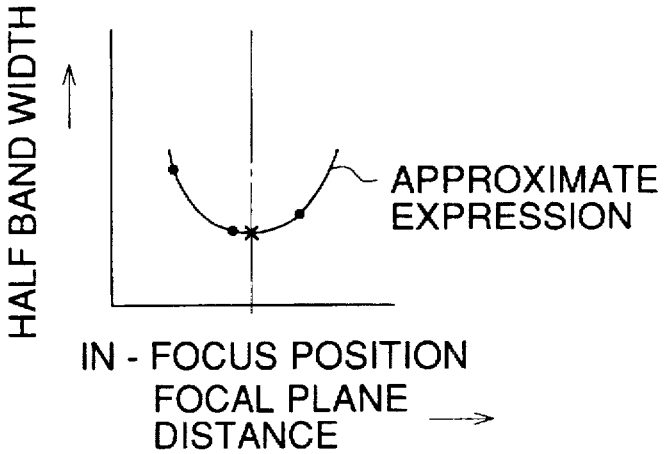
FIG. 45 ( b )
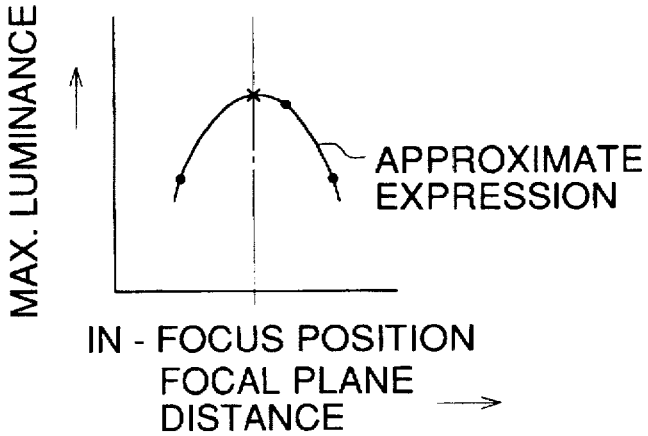

FIG. 46 ( a )
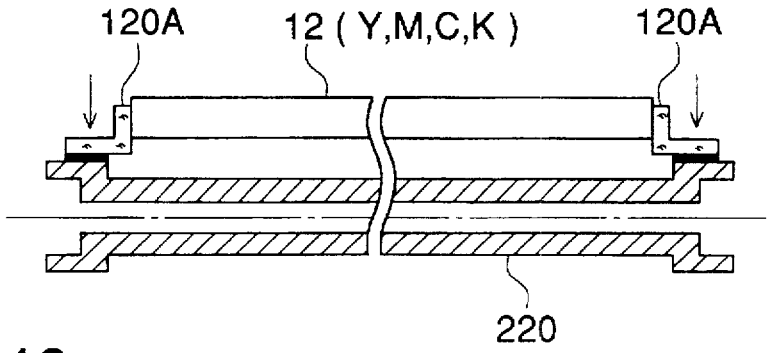
FIG. 46 ( b )
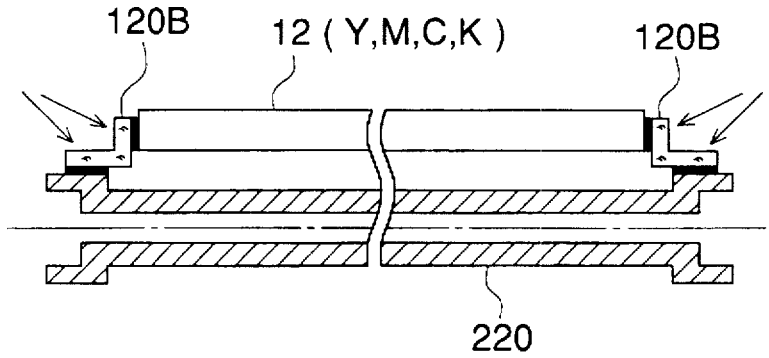
FIG. 46 ( c )
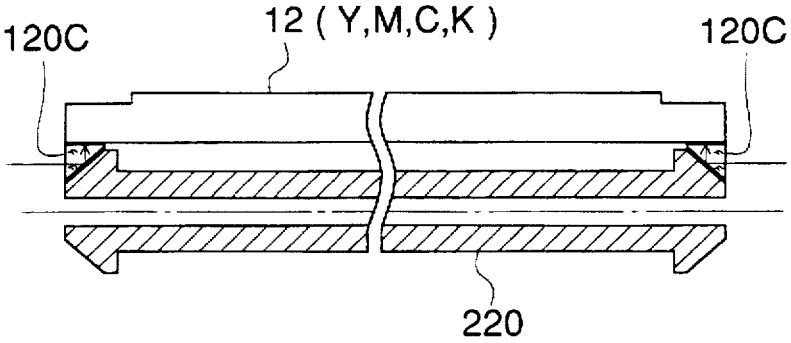

OPTICAL SYSTEM ASSEMBLING DEVICE FOR AN IMAGE FORMING APPARATUS

BACKGROUND OF THE INVENTION

The present invention relates to an optical system assembly method by which plural image exposure means each is adjustably fixed at a predetermined position of an optical system support member, in an image forming apparatus such as an electrophotographic copier, a printer, or the like, in which plural sets of charging means, image exposure means and developing means are provided around an image forming body, and charging, image exposing and developing are repeated during one rotation of an image forming body so that toner images are formed by superimposing these images on the image forming body, and after that, the toner images are collectively transferred onto a transfer material.

The following methods (A), (B) and (C) are widely known as multi-color image forming methods.

(A) A color image forming apparatus in which the same number of photoreceptors, chargers, developers, etc. as colors necessary for a color image, are provided, and a mono-color toner image formed on a respective photoreceptor is superimposed on a transfer body.

(B) A color image forming apparatus in which one photoreceptor is rotated a plurality of times and charging, image exposing and developing are repeated for each color.

(C) A color image forming apparatus in which charging, image exposing and developing are successively carried out for each color during one rotation of one photoreceptor.

However, the apparatus (A) requires that a plurality of photoreceptors and transfer bodies are moved. Accordingly, there is a drawback in which dimensions of the apparatus become excessively large. In the apparatus (B), one charger, one image exposure means, and one photoreceptor are used, resulting in smaller apparatus dimensions. However, the formed image size is limited to less than the surface area of the photoreceptor. In the apparatus (C), high speed image formation can be carried out. However, it requires that a plurality of chargers, image exposure means, and developing units are arranged within one around of the photoreceptor. Further, there is a possibility that an image exposure optical system is stained by toner leakage from nearby developing units, resulting in deteriorated image quality. In order to avoid the image quality deterioration, it is necessary that an interval between the image exposure means and developing units is increased, resulting in a greater photoreceptor diameter, and in an increase of overall apparatus dimensions, which are problems.

In order to avoid the above-described problems in the apparatus (C), an apparatus (D) in which a plurality of image exposure means (which is called externally arranged exposure means, hereinafter) are arranged outside the image forming body, or a base body of the image forming body is formed of a transparent material and a plurality of image exposure means (which is called enclosed exposure means, hereinafter) are accommodated in the base body, and an image is exposed onto a photoreceptor layer formed on the outer periphery of the image forming body through the base body, is proposed (Japanese Patent Publication Open to Public Inspection No. 307307/1993, etc.). In the image forming apparatus (C) and (D), a color image is formed during one rotation of the image forming body. Accordingly, image recording time is reduced and higher speed recording can be carried out, which also is effective for increased image quality.

However, in the image forming apparatus mentioned above, since a large number of image exposure means, chargers, developing units, etc., are arranged with respect to the image forming body, the structure becomes complicated, and it becomes difficult to exactly adjust the relative position among each members, which is a problem. Specifically, in the exposure optical system, it is essential to accurately maintain positions among linear light emitting means (LED, etc.), and positions between linear light emitting means and the image forming body. That is, it is necessary that light collecting positions from the linear light emitting means accurately coincide with the image forming surface on the peripheral surface of the image forming body, and linear LEDs are accurately positioned parallely at predetermined intervals. Conventionally, therefore, linear image exposure means are mounted on the optical system supporting body, and color image forming processes are carried out using an image forming apparatus housed in the image forming body. Then, the quality of the thus formed image is checked and mounting positions of linear light emitting means are corrected. The adjustment operation for this position correction requires high operator skill and some time, and further, is a problem in the assembly of the apparatus.

It was found that: specifically, in the liner light emitting means, dispersion of the focal distance and the image formation position of the light emitted from elements tends to occur; and by this dispersion, the image is caused to be out of focus, or toner images of different colors are caused to be dislocated from each other, when linear light emitting means are only positioned onto the optical system supporting body according to the outer shape of the linear light emitting means. The quality of the color image, formed by using a plurality of linear light emitting means, is greatly affected by these disadvantages.

SUMMARY OF THE INVENTION

The first object of the present invention is to increase the accuracy of the mounting position of the linear light emitting means onto the optical system supporting body, to prevent generation of out-of-focus of the image or slippage of toner images, and to increase the quality of the formed color image. Further, the second object of the present invention is to make mounting operations easier, and to reduce the operation time.

The first embodiment in an image forming apparatus having an externally arranged exposure means of an optical system to attain the first object is accomplished by an optical system assembly device for an image forming apparatus in which plural sets of charging means, image exposure means and developing units are provided around an image forming body, and charging, image exposing and developing are repeated during a single rotation of an image forming body so that toner images are superimposed on the image forming body, after which the toner images are collectively transferred onto a transfer material, the image exposure means comprising a plurality of linear light emitting means being arranged outside the image forming body in parallel with the rotational axis of the image forming body, and an optical system supporting body having a plurality of linear light emitting means and being secured to an image forming body supporting frame in the image forming apparatus, the optical system assembly device comprising: a light beam detecting means arranged in the optical system supporting body and at a position corresponding to an image formation surface of the image forming body; and a movable adjusting means provided outside the optical system supporting body and having a linear light emitting means, wherein the linear light emitting means is adjusted at a predetermined assembling position with respect to the optical system supporting body, and fixed at the position by the optical system assembly device.

Further, the second embodiment is attained by an optical system assembly device for an image forming apparatus in which a plurality sets of charging means, image exposure means and developing units are provided around an image forming body, and charging, image exposing and developing are repeated during a single rotation of an image forming body so that toner images are superimposed on the image forming body, and after that, the toner images are collectively transferred onto a transfer material, the image exposure means comprising a plurality of linear light emitting means being arranged outside the image forming body in parallel to the rotational axis of the image forming body, and an optical system supporting body having a plurality of linear light emitting means and being secured to an image forming body supporting frame in the image forming apparatus, and an optical system assembly device comprising: one light beam detecting means arranged in the optical system supporting body and at a position corresponding to an image formation surface of the image forming body; and a plurality of movable adjusting means fixed at a plurality of predetermined positions outside the optical system supporting body and having a linear light emitting means, wherein the light beam detecting means is moved and successively opposed to the image forming surface of the plurality of linear light emitting means by the optical system assembly device, each linear light emitting means is positioned at a predetermined assembling position with respect to the optical system supporting body, and fixed at a predetermined position by the adjusting means.

Still further, the third embodiment is attained by an optical system assembly device for an image forming apparatus in which plural sets of charging means, image exposure means and developing units are provided around an image forming body, and charging, image exposing and developing are repeated during a single rotation of an image forming body so that toner images are superimposed on the image forming body, and after that, the toner images are collectively transferred onto a transfer material, the image exposure means comprising a plurality of linear light emitting means being arranged outside the image forming body in parallel with the rotational axis of the image forming body, and an optical system supporting body having a plurality of linear light emitting means and being secured to an image forming body supporting frame in the image forming apparatus, and an optical system assembly device comprising: one light beam detecting means arranged in the optical system supporting body and at a position corresponding to the image formation surface of the image forming body; and one movable adjusting means fixed at a predetermined position outside the optical system supporting body and having a linear light emitting means, wherein the image exposure means is moved and successively opposed to an image forming surface of the plurality of linear light emitting means by the optical system assembly device, and each linear light emitting means is adjusted at a predetermined assembling position with respect to the optical system supporting body, and fixed at a predetermined position by the adjusting means.

Yet further, the fourth embodiment is attained by an optical system assembly device for an image forming apparatus in which plural sets of charging means, image exposure means and developing units are provided around an image forming body, and charging, image exposing and developing are repeated during a single rotation of an image forming body so that toner images are superimposed on the image forming body, after which, the toner images are collectively transferred onto a transfer material, the image exposure means comprising a plurality of linear light emitting means being arranged outside the image forming body in parallel with the rotational axis of the image forming body, and an optical system supporting body having a plurality of linear light emitting means and being secured to an image forming body supporting frame in the image forming apparatus, and an optical system assembly device comprising: a plurality of light beam detecting means arranged in the optical system supporting body and at positions corresponding to an image formation surface of the image forming body; and a plurality of movable adjusting means fixed at a plurality of predetermined positions outside the optical system supporting body, and having a linear light emitting means, wherein each linear light emitting means is adjusted to a predetermined assembling position with respect to the optical system supporting body, and fixed at a predetermined position by the adjusting means, by using the optical system assembly device.

Further, embodiments of the assembling method of the exposure means in the image forming apparatus are as follows.

1. An assembling method of the exposure means in the image forming apparatus in which the exposure means composed of a plurality of linear exposure optical systems to expose the image, and a plurality of developing means accommodating different color toners therein are arranged around the image forming body, and a color toner image is formed by superimposing different color toner images on the image forming body, the assembling method including the following steps, a step to make the exposure optical system emit the light, a step to form the image, outputted from the exposure optical system, on sensors arranged at the position corresponding the surface of the image forming body with respect to the exposure optical system, a step to adjust the arrangement position of the exposure optical system with respect to the sensors according to the result of the image formed on the sensors (so that the focal point or the position of the exposure optical system is optimized on the sensors), and a step to fix the exposure optical system to the adjusted position on the optical system supporting body.

2. The assembling method of the exposure means according to item 1, wherein the exposure optical system is arranged so as to expose the surface of the image forming body from the outside of the image forming body in the image forming apparatus.

3. The assembling method of the exposure means according to item 1, wherein the exposure optical system is arranged so as to expose the surface of the image forming body from the inside of the image forming body in the image forming apparatus.

4. The assembling method of the exposure means according to item 1, wherein the exposure optical system is composed of a linear light emitting means and a linear lens.

5. The assembling method of the exposure means according to item 1, wherein the sensors are arranged at positions corresponding to both ends of the linear exposure optical system.

6. The assembling method of the exposure means according to item 1, wherein the linear optical system is composed of a plurality of light emitting elements in the longitudinal direction, and specific light emitting elements arranged at positions opposite to sensors are made to emit light in the step in which the optical system is activated.

7. The assembling method of the exposure means according to item 6, wherein the positions and luminance of the specific light emitting elements are measured in the image formation step, and the optical system is moved according to the positions and luminance of the measured light emitting elements in the adjustment step so that the positions and luminance of the light emitting elements are within a specific range.

8. The assembling method of the exposure means according to item 1, wherein a plurality of exposure optical systems are positioned to each other by repeating the above adjustment step.

9. The assembling method of the exposure means according to item 1, wherein the above sensors are used in common for a plurality of image exposure optical systems.

10. The assembling method of the exposure means according to item 1, wherein a plurality of above sensors are arranged with respect to a plurality of image exposure optical systems.

11. The assembling method of the exposure means according to item 1, wherein the fixing step has the following steps, a step to insert an insert member having the penetrability in the ultraviolet ray wavelength range, between the exposure optical system and the supporting body, a step to adhere ultraviolet ray hardening resin in the vicinity of joint portions of the insert member and the optical system, and the supporting body, a step to irradiate the ultraviolet ray onto the insert member so that the optical system and the supporting body are adhered to each other through the insert member by hardening the ultraviolet ray hardening resin.

12. The assembling method of the exposure means according to item 1, wherein the position of the exposure optical system is adjusted by a fine adjustment means provided outside the supporting body, in the above adjustment step.

13. The assembling method of the exposure means according to item 1, wherein the position of the exposure optical system is adjusted by a fine adjustment means provided inside the supporting body, in the above adjustment step.

14. The assembling method of the exposure means according to item 13, wherein the above fine adjustment means is composed of an elastic member and a fastening member.

15. The assembling method of the exposure means according to item 1, wherein the above exposure optical system is fixed onto the supporting body by a low hardening contractive adhesive agent in the above fixing step.

16. The assembling method of the exposure means according to item 1, wherein the above image formation step includes the following steps, a step to measure a change of luminance or an amount of spreading of the emitted light by changing the distance between the optical system and sensors, a step to calculate the focal position of the exposure optical system based on the change measured by the above step, and further, the exposure optical system is moved according to the result of the calculation of the focal position, obtained by the above calculation, in the above adjustment step.

BRIEF DESCRIPTION OF THE DRAWINGS

FIG. 20(*a*) is a plan view of a light beam detecting means in FIG. 18.

FIG. 20(*b*) is a plan view of a lower end holding means of the image exposure optical system.

FIG. 20(*c*) is a plan view of an upper end holding means.

FIGS. 32(*a*) and 32(*b*) are front views for explaining an exposure device assembling method of the present invention.

FIGS. 33(*a*) and 33(*b*) are front views for explaining an exposure device assembling method of the present invention.

FIGS. 34(*a*) and 34(*b*) are views for explaining the exposure device assembling method of the present invention.

FIG. 34(*a*) is a plan view of a fine adjustment mechanism.

FIG. 34(*b*) is a sectional view of the fine adjustment mechanism, taken on line 34(*b*)—34(*b*) in FIG. 34(*a*).

FIGS. 37(*a*), 37(*b*) and 37(*c*) are views for explaining the exposure device assembling method of the present invention.

FIG. 37(*a*) shows a plan view of the fine adjustment mechanism.

FIG. 37(*b*) is a sectional view of the fine adjustment mechanism.

FIGS. 38(*a*) and 38(*b*) are views for explaining the exposure optical system of the present invention.

FIG. 38(*a*) is a plan view of a light emitting element.

FIG. 38(*b*) is a front view of the exposure device.

FIG. 42(*a*) is a perspective view showing the structure of an adjusting device, and FIG. 42(*b*) is a sectional view of its main portion.

FIGS. 45(*a*) and 45(*b*) are graphs of the approximate expressions used for predicting the focus positions of the image exposure means.

FIGS. 46(*a*), 46(*b*) and 46(*c*) are illustrations showing indirect fixing methods of the image exposure means through a paste member.

DETAILED DESCRIPTION OF THE PREFERRED EMBODIMENT

Prior to an explanation of the present invention, the entire structure of a color image forming apparatus having an externally arranged image exposure means will be described, referring to FIG. 1 to FIG. 3.

Figure 1:
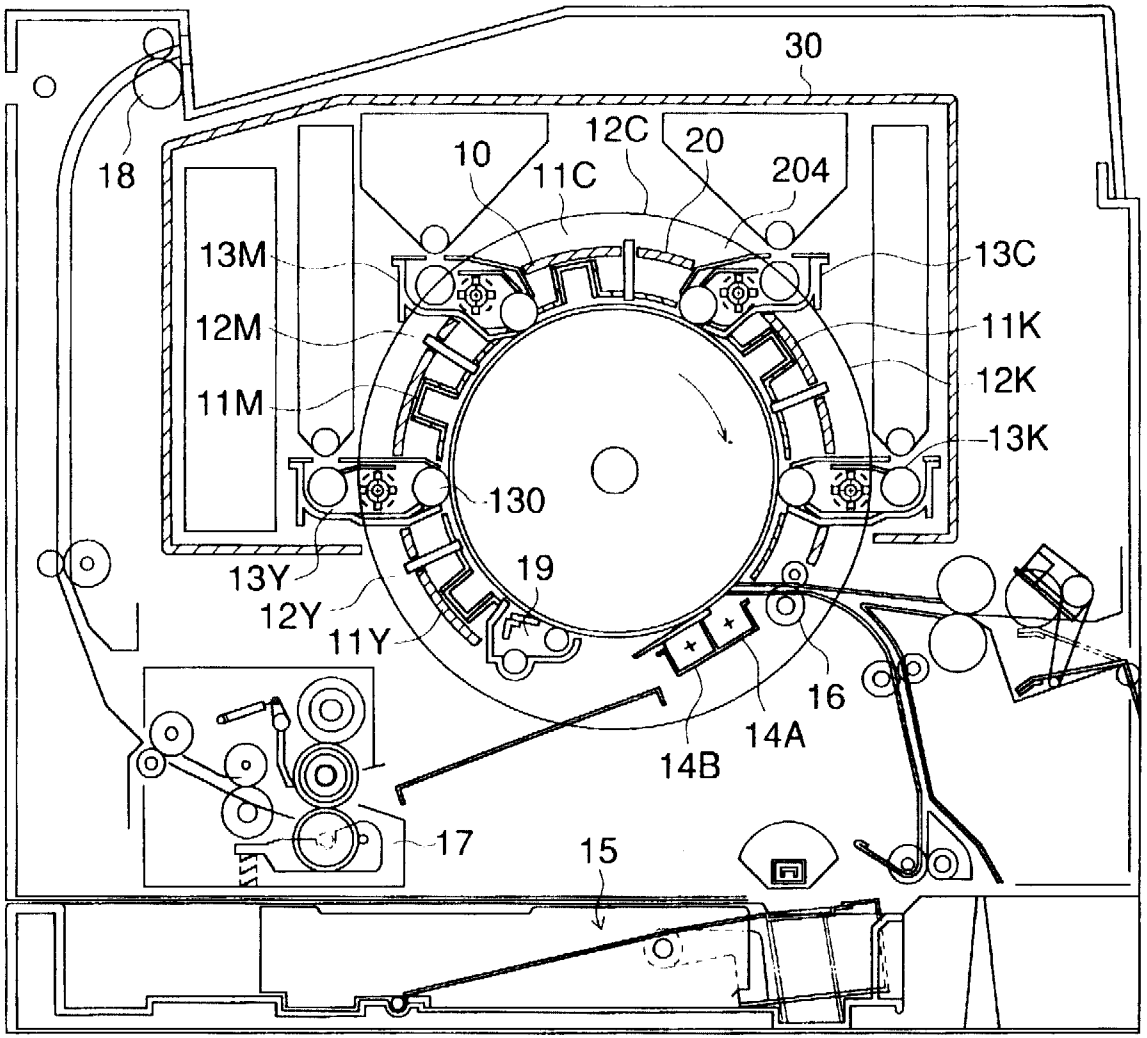
FIG. 1 is a sectional view showing an example of a color image forming apparatus having an externally arranged exposure means, to which the present invention is applied.

FIG. 1 is a sectional view of a color printer showing an example of an image forming apparatus applied to the present invention.

In FIG. 1, numeral 10 is a photoreceptor drum which is a cylindrical image forming body. An organic photoreceptor layer (OPC) is coated onto the outer periphery of a cylindrical conductive base body of the photoreceptor drum 10 which is electrically grounded and rotated clockwise.

Numerals 11(Y, M, C, K) are scorotron chargers which are a charging means and which uniformly charge the photoreceptor drum 10 by corona discharge using a grid and a discharge wire, which has a predetermined potential voltage with respect to the organic photoreceptor layer of the photoreceptor drum 10.

Numerals 12(Y, M, C, K) are exposure optical systems which are image exposure means composed of linear LEDs (light emitting diode), FLs (fluorescent substance emitting element), ELs (electro-luminescence element), PLs (plasma discharging element) and a light converging fiber lens array, which are light emitting elements arranged in the shape of an array in the direction of the photoreceptor drum 10. Each color image signal, which is read by a separately provided image reading apparatus, is successively read from a memory and inputted into each exposure optical system 12(Y, M, C, K) as an electric signal. Wavelengths of the emitted light beams used in this example are within the range of 500 to 900 nm.

The exposure optical systems 12(Y, M, C, K) may be composed of a combination of an optical shutter member such as an LCS (liquid crystal shutter), an LISA (photoelectromagnetic effect optical shutter array), a PLZT (transparent piezoelectric shutter array), etc. in which elements having optical shutter functions are linearly arranged, except the above-described light emitting elements, and an image formation lens such as a converging fiber lens, etc.

Numbers 13Y, 13M, 13C, and 13K are developing units, which constitute the developing means, in which yellow (Y), magenta (M), cyan (C) and black (K) developers are respectively accommodated. Each developing unit is provided with a developing sleeve 130 which has a predetermined gap with respect to the peripheral surface of the photoreceptor drum 10, and which rotates in the same direction as the photoreceptor drum 10. The above-described developing units 13Y, 13M, 13C, and 13K noncontact reversal-develop a latent image on the photoreceptor drum 10 which is formed by charging using the chargers 11Y, 11M, 11C and 11K, and image exposure using the exposure optical systems 12Y, 12M, 12C, and 12K, when a developing bias voltage is applied.

Next, color image formation processes in this apparatus will be described.

Concerning document images, an image which is read by an image pick-up element in a separately provided image reading apparatus, or edited by a computer, is temporarily stored in a memory as individual color image signals Y, M, C and K. When image recording starts, a photoreceptor drive motor rotates and the photoreceptor drum 10 is rotated clockwise. Simultaneously, potential voltage application on the photoreceptor drum 10 is started by charging action of a charger 11Y.

After a potential voltage is applied on the photoreceptor drum 10, image exposure by an electrical signal corresponding to the first color signal, that is, a yellow (Y) image signal is started by the exposure optical system 12Y. An electrostatic latent image corresponding to a yellow (Y) image in the document image is formed on the photoreceptor layer on the surface of the drum by rotational scanning of the drum. This latent image is noncontact reversal developed by developer on the developing sleeve in the developing unit 13Y, and a yellow (Y) toner image is formed corresponding to the rotation of the photoreceptor drum 10.

Next, a potential voltage is applied on the yellow (Y) toner image formed on the photoreceptor drum 10 by the charging action of a charger 11M. Image exposure by an electrical signal corresponding to the second color signal, that is, a magenta (M) image signal of an exposure optical system 12M is carried out. A magenta (M) toner image is successively formed by being superimposed on the yellow (Y) toner image, when noncontact reversal development is carried out by the developing unit 13M.

By the same processes, a cyan (C) toner image corresponding to the third color signal is formed by a charger 11C, an exposure optical system 12C and the developing unit 13C, and finally, a black (K) toner image corresponding to the fourth color signal is successively formed by being superimposed, by a charger 11K, an exposure optical system 12K and the developing unit 13K. Thus, a full color toner image is formed on the peripheral surface of the photoreceptor drum 10 during a single rotation of the drum 10.

The color toner image thus formed on the peripheral surface of the photoreceptor drum 10 is transferred onto a transfer sheet, which is a transfer material, which is conveyed from a sheet feed cassette 15 and is fed synchronously by the drive of a timing roller 16 in a transfer unit 14A. The transfer sheet onto which the toner image is transferred, is discharged by a discharger 14B, which causes it to separate from the peripheral surface of the photoreceptor drum 10. After toner on the transfer sheet has been fused by a fixing unit 17, the transfer sheet is delivered onto a tray in the upper portion of the apparatus through a sheet delivery roller 18, in the case of a single-sided copy.

On the other hand, the toner remaining on the photoreceptor drum 10, from which the transfer sheet has been separated, is removed and the surface is cleaned by a cleaning unit 19. Then, the photoreceptor drum 10 continues toner image formation of the document image, or temporarily stops and is ready for a new toner image formation of the document image.

Figure 2:
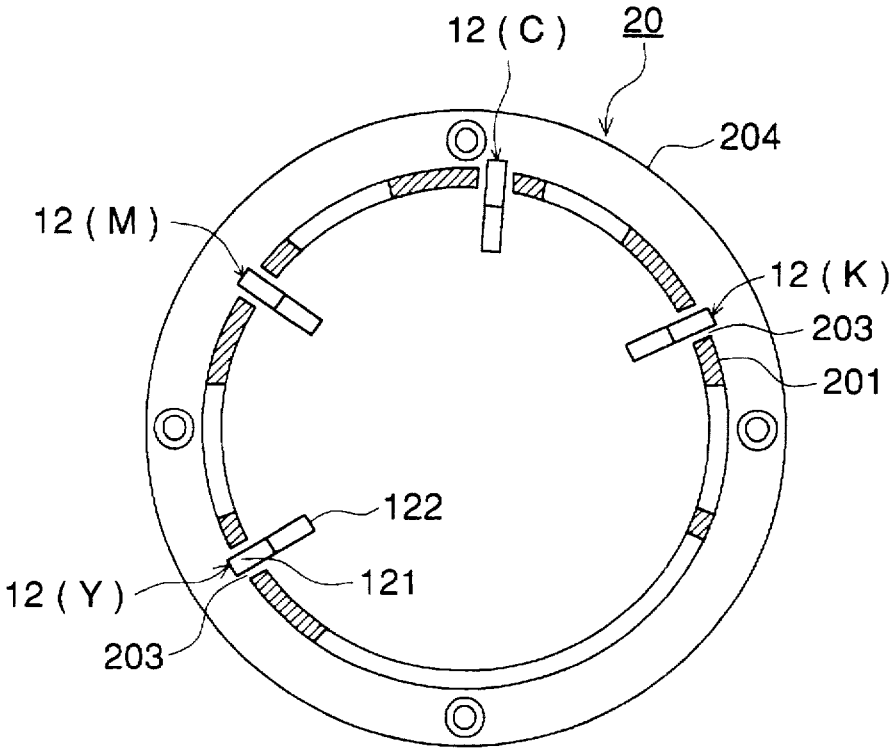
FIG. 2 is a sectional view showing an exposure optical system and an optical system supporting body.

FIG. 2 is a sectional view of an optical system supporting body 20 on which the exposure optical system and the charger, not shown in the drawing, are mounted. FIG. 3 is a perspective view of the optical system supporting body.

Numeral 20 is a cylindrical member (optical system supporting body) in which the photoreceptor drum 10 is concentrically housed. As shown in FIGS. 2 and 3, this member is formed of a cylindrical portion 201 having a predetermined space with respect to the outer periphery of the drum, and a flange portion 202 and 204 at both ends.

A plurality of cutouts 203 are provided on the peripheral surface of the cylindrical portion 201. The exposure optical systems 12(Y, M, C, K) are respectively fixed on inner walls of the cutouts 203 by an adhesive agent after each exposure optical system has been adjusted by an optical system adjusting tool which will be described later.

As shown in FIG. 1, chargers 11(Y, M, C, K) are respectively fixed by screwing their both end electrode blocks onto the inner wall of the cylindrical member 20. In this connection, the cleaning unit 19 may be fixed on the inner wall of the cylindrical portion 201 of the cylindrical member 20. These chargers 11(Y, M, C, K) and the cleaning unit 19 are fixed by screws, and therefore, they can be easily replaced.

Figure 3:
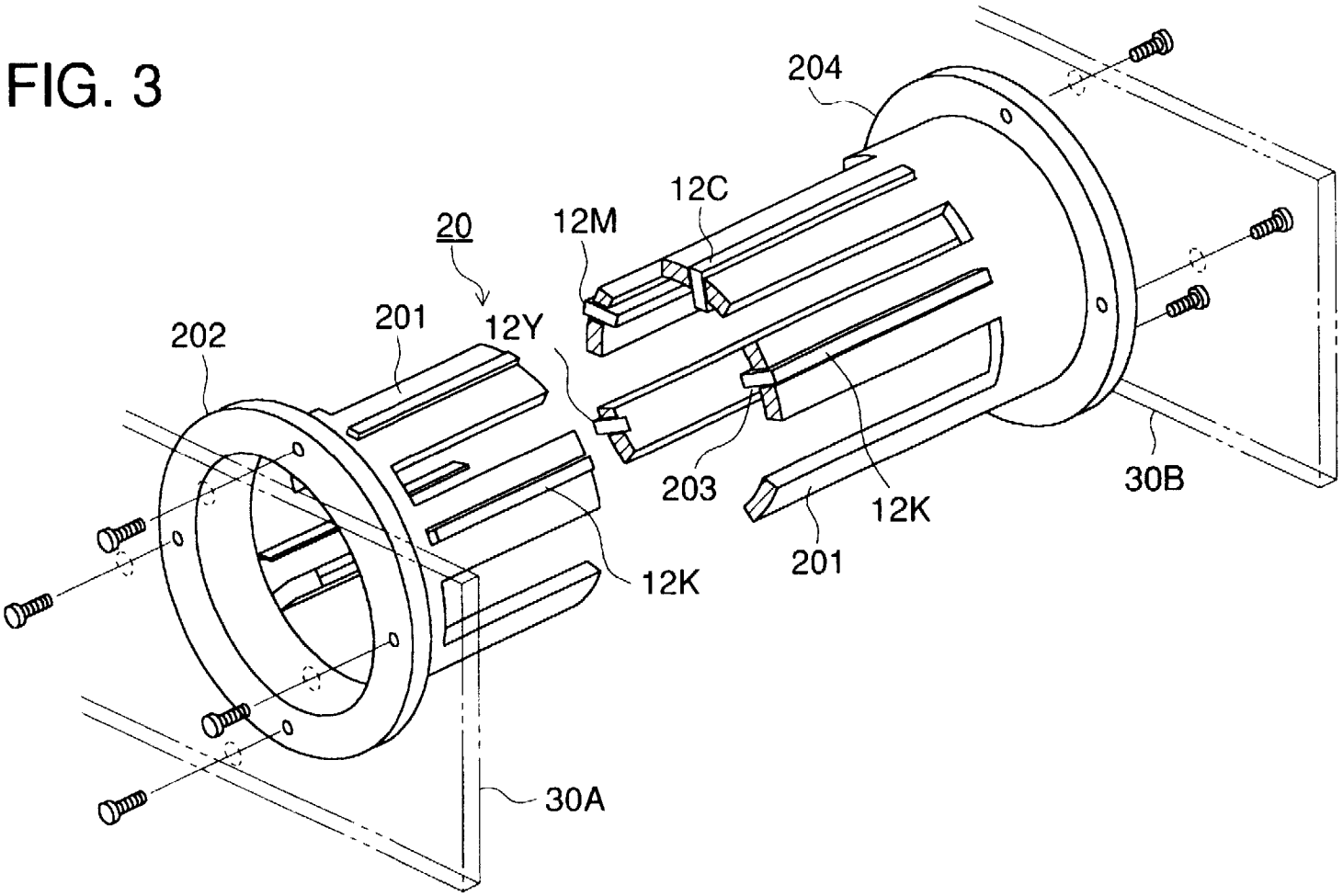
FIG. 3 is a perspective view showing the exposure optical system and the optical system supporting body.

As shown in FIG. 3, in the cylindrical member 20 supporting exposure optical systems 12(Y, M, C, K), chargers 11(Y, M, C, K) and the cleaning unit 19, both end flange portions 202, 204 are respectively fixed to base plates 30A and 30B of the apparatus main body or the process cartridge 30 by screws, and thereby, the cylindrical member 20 is mounted such that it coaxially includes the photoreceptor drum 10.

The cylindrical member 20 may be structured to support only the exposure optical systems 12(Y, M, C, K) (optical system supporting body), and chargers 11(Y, M, C, K) and the cleaning unit 19 may be mounted on the image forming body side, for example, on the cartridge 30 in which the photoreceptor drum 10 is accommodated.

In the color image forming apparatus of the present invention, the exposure optical system 12(Y, M, C, K) composed of a linear light emitting means 121 (for example, an LED array, etc.) and a light converging fiber lens array 122, is located on the outside of the photoreceptor drum 10, and an image exposure position by the exposure optical systems 12(Y, M, C, K) is provided on the upstream side of a developing sleeve 130 in a development casing.

(EXAMPLE 1)

This example relates to the first and the second embodiments of the image forming apparatus having an externally arranged exposure means, and is an optical system assembly device composed of a plurality (4 portions in the drawing) of exposure optical system adjusting tools which are radially arranged on the outer periphery of the fixed optical system supporting body 20, and a light beam detection means which is supported so as to be movable inward to the optical system supporting body 20.

Figure 4:
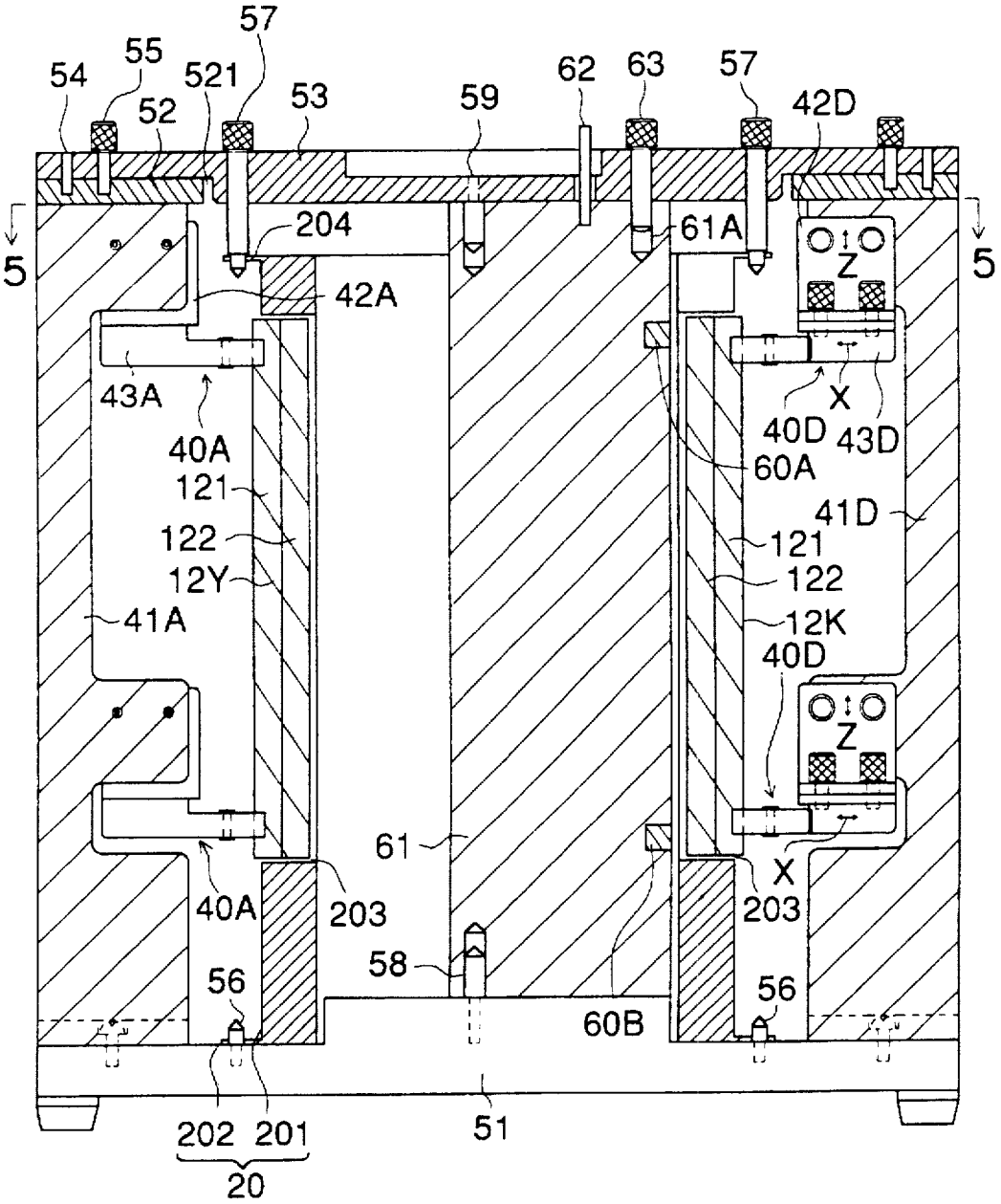
FIG. 4 is a frontal sectional view showing an exposure optical system and an optical system assembling device in the example 1 of the present invention.
Figure 5:
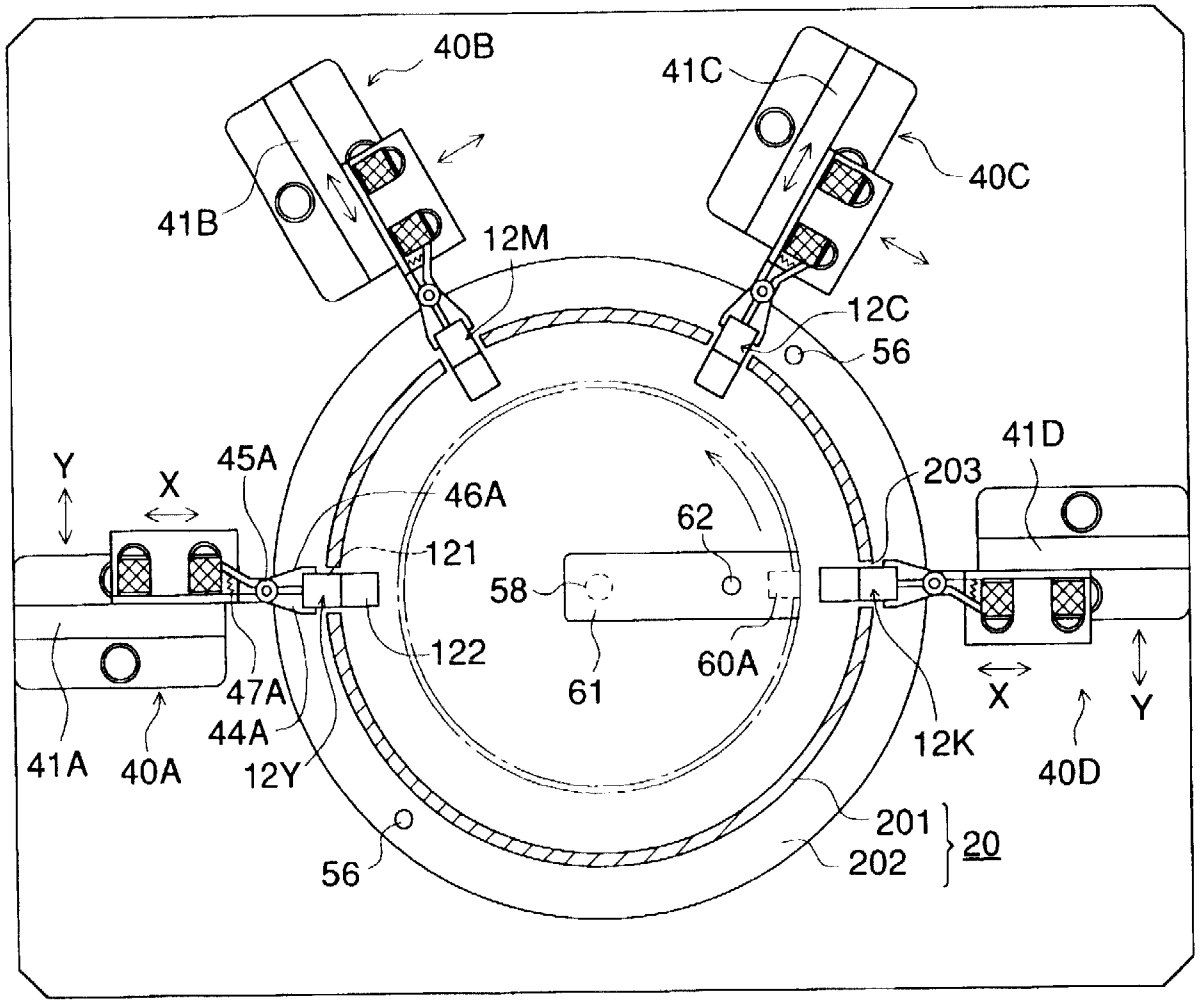
FIG. 5 is a plan view, viewed from the arrow 5—5 in FIG. 4, of the exposure optical system and the optical system assembling apparatus.
Figure 6:
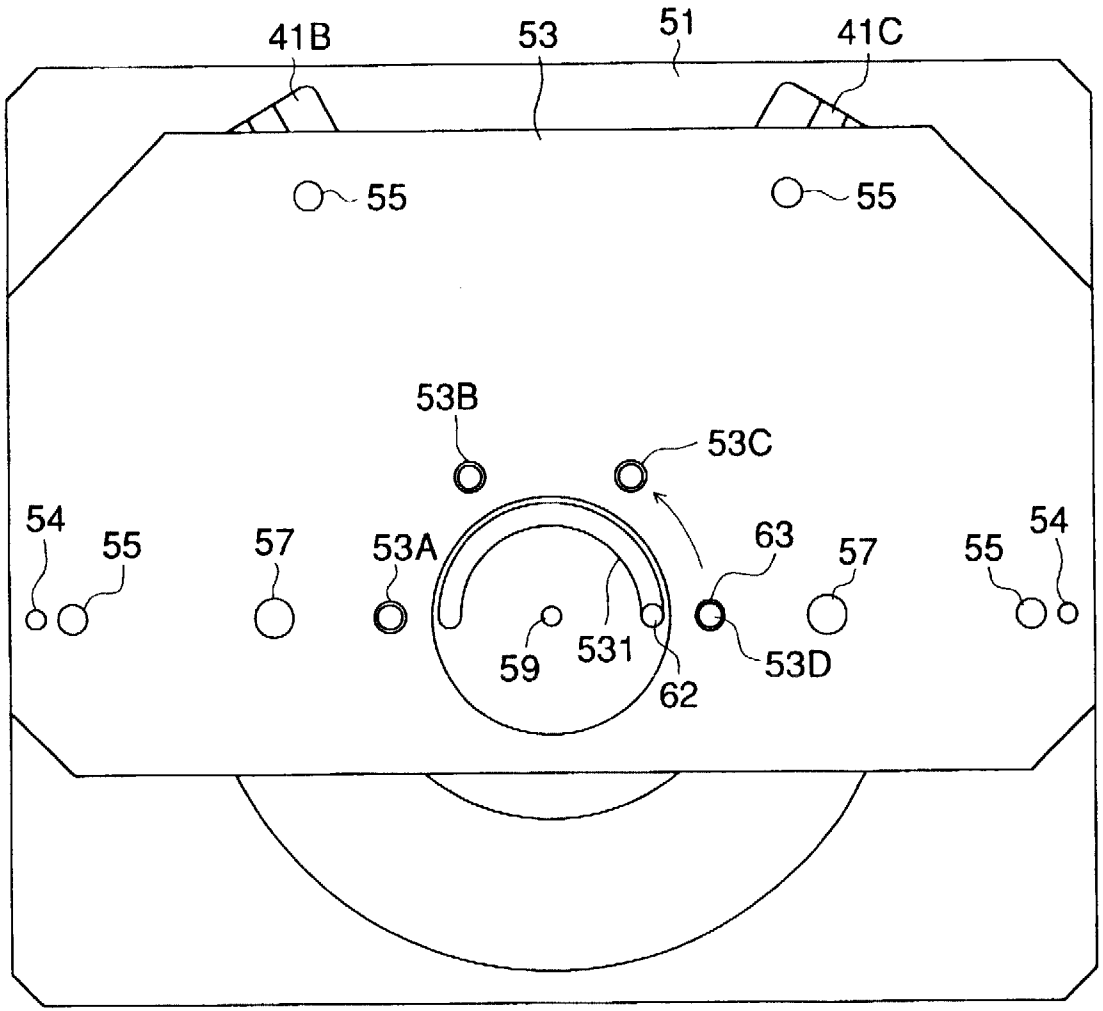
FIG. 6 is a plan view of the exposure optical system and the optical system assembling device.

FIG. 4 is a frontal sectional view showing an optical system assembly device composed of 4 exposure optical systems 12Y, 12M, 12C and 12K, and 4 sets of optical system adjusting means 40A, 40B, 40C and 40D which are respectively opposed to 4 exposure optical systems. FIG. 5 is a plan view taken on line A—A of the optical system assembly device in FIG. 4. FIG. 6 is a plan view of the optical system assembly device.

A plurality of cutout portions 203, in which a plurality of exposure optical systems 12(Y, M, C, K) integrally composed of linear light emitting means 121 and light converging fiber lens arrays 122 are freely inserted, are provided in the optical system supporting body 20.

Four supports 41A, 41B, 41C and 41D are fixed perpendicularly to a base plate 51 of the optical system assembly apparatus. An upper base-plate 52 is horizontally fixed on the upper sides of these supports 41A to 41D. An opening 521 through which the optical system supporting body 20 passes is provided in the center of the upper base-plate 52. An upper plate 53 is detachably provided on the upper side of the upper base-plate 52. The upper plate 53 is positioned and fixed at a predetermined position on the upper base-plate 52 by 2 positioning pins 54 and fixing screws 55.

Two positioning pins 56 are provided on the base plate 51 of the optical system supporting apparatus, and are engaged with the reference holes of a flange portion 202 provided below the optical system supporting body 20 so that the optical system supporting body 20 is positioned at a predetermined position on the base plate 51. Concerning the upper plate 53, two positioning pins 57, which are engaged with the reference holes of the flange portion 204 provided above the optical system supporting body 20, are also provided and the optical system supporting body 20 is positioned at a predetermined position.

After the optical system supporting body 20 has been positioned by the positioning pins 57, the upper plate 53 is located at a predetermined position on the upper surface of an upper base plate 52 by positioning pins 54, and fixed by fixing screws 55.

A reference pin 58 protrudes from the center of the base plate 51, and is engaged with a hole in the lower portion of a sensor supporting body 61 of the light beam detection means. Another reference pin 59 also protrudes from the upper plate 53, and is engaged with a hole of the upper portion of the sensor supporting body 61 of the light beam detection means. The sensor supporting body 61 is supported by the upper and lower reference pins 58 and 59, and can rotate around the pins. Numeral 62 is a lever which is provided at the upper portion of the sensor supporting body 61 and protrudes upward from an upper plate 53.

Light beam detection sensors 60A and 60B are respectively provided at the upper and lower portions opposite to both ends of the linear light emitting means 121 of the sensor supporting body 61. The light beam detection sensors 60A and 60B are composed of, for example, two-dimensional CCD sensors, and previously arranged at an image formation position of the exposure optical systems 12(Y, M, C, K), using the reference image forming body 10, that is, at an image formation reference position on the outer peripheral surface of the reference image forming body 10.

As shown in FIG. 6, a U-shaped slot 531 is provided on the upper plate 53. This U-shaped slot 531 is a recessed hole through which the lever 62 passes when the sensor supporting body 61 is rotated. Four reference holes 53A, 53B, 53C and 53D are provided in the upper plate 53. When the sensor supporting body 61 is rotated and stopped at predetermined positions, the reference holes 53A to 53D respectively coincide with the reference hole 61A of the upper portion of the sensor supporting body 61. When the reference pin 63 penetrates both reference holes, the sensor supporting body 61 is positioned at a predetermined position.

A couple of optical system adjusting means 40A are respectively provided at the upper and lower portions of the support 41A, wherein the optical system adjusting means respectively clamp the upper and lower ends of the linear light emitting means 12Y, and can be moved in the directions of X, Y and Z. That is, the optical system adjusting means 40A are composed of a three-dimensional movement means, which can move in the directions of X, Y and Z with respect to the support 41A, and the detachable clamping means which clamps one end of the linear light emitting means 12Y. The three-dimensional movement means is composed of a movement table 42A which can move vertically (in the direction of Z), a movement table 43A which can move horizontally (in the directions of X and Y), and fixing screws. As shown in FIG. 5, the clamping means is composed of a fixed clamping member 44A fixed to the movement table 43A, and a movable clamping member 46A which is linked so that it can be opened and closed through a fulcrum portion 45A, and is scissors-like. Numeral 47A is a compression spring equipped to each knob portion of the fixed clamping member 44A and the movable clamping member 46A. When the knob portion is pressed against the spring force of the compression spring 47A, clamping portions of the fixed clamping member 44A and the movable clamping member 46A are respectively opened. When the pressure is removed from the knob portion, the clamping portion is closed by the compression spring 47A, and clamps one end of the light converging fiber array 122. In the same way, optical system adjusting means 40B, 40C and 40D, which are composed of three-dimensional movement means which can move in the directions of X, Y and Z, and detachable clamping means which clamp one end of the linear light emitting means 12M, 12C and 12K, are also provided on the supports 41B, 41C and 41D.

Next, adjusting processes of the image exposure means using the optical system assembly device will be described below.

(1) The optical system support member 20 is placed on the upper surface of the base plate 51. Two positioning pins 56 are engaged with the reference holes of the lower flange portion 202 so that the optical system supporting body 20 is positioned and fixed in place. The exposure optical systems 12Y, 12M, 12C and 12K are respectively inserted into cutouts 203 of the optical system supporting body 20 and are temporarily positioned.

(2) The sensor supporting body 61 is engaged with the reference pin 58 on the base plate 51 so that the sensor supporting body stands upright.

(3) The upper plate 53 is placed on the upper base-plate 52, and positioned by positioning pins 54, and after that, fixed by fixing screws 55. Simultaneously, the reference pin 59 is engaged with the upper reference hole of the sensor supporting body 61, and the sensor supporting body 61 can rotate around the upper and lower reference pins 58 and 59.

(4) Two reference pins 57 are inserted into holes of the upper plate 53, and are engaged with the reference holes of the upper flange portion 204 of the optical system supporting body 20.

(5) A leading edge portion of the exposure optical system 12Y which has been temporarily set in the cutout 203 of the optical system supporting body 20, is clamped by the clamping means of the optical system adjusting means 40A. That is, the upper portion of the exposure optical system 12Y is clamped between the fixed clamping member 44A and the movable clamping member 46A, of the clamping means of the upper end portion. Further, the lower portion of the exposure optical system 12Y is clamped between the fixed clamping member 44A and the movable clamping member 46A, of the clamping means of the lower end portion.

(6) The reference pin 63 is inserted into the reference hole 53A of the upper plate 53 and into the reference hole of the sensor supporting body 61, and the sensor supporting body 61 is thus fixed at the first reference position.

(7) Specific light emitting elements on both ends of the linear light emitting means 121Y of the exposure optical system 12Y are caused to emit light, and an image is formed on the surfaces of the light beam detecting means 60A and 60B through the light converging fiber lens array 122Y.

Figure 7:
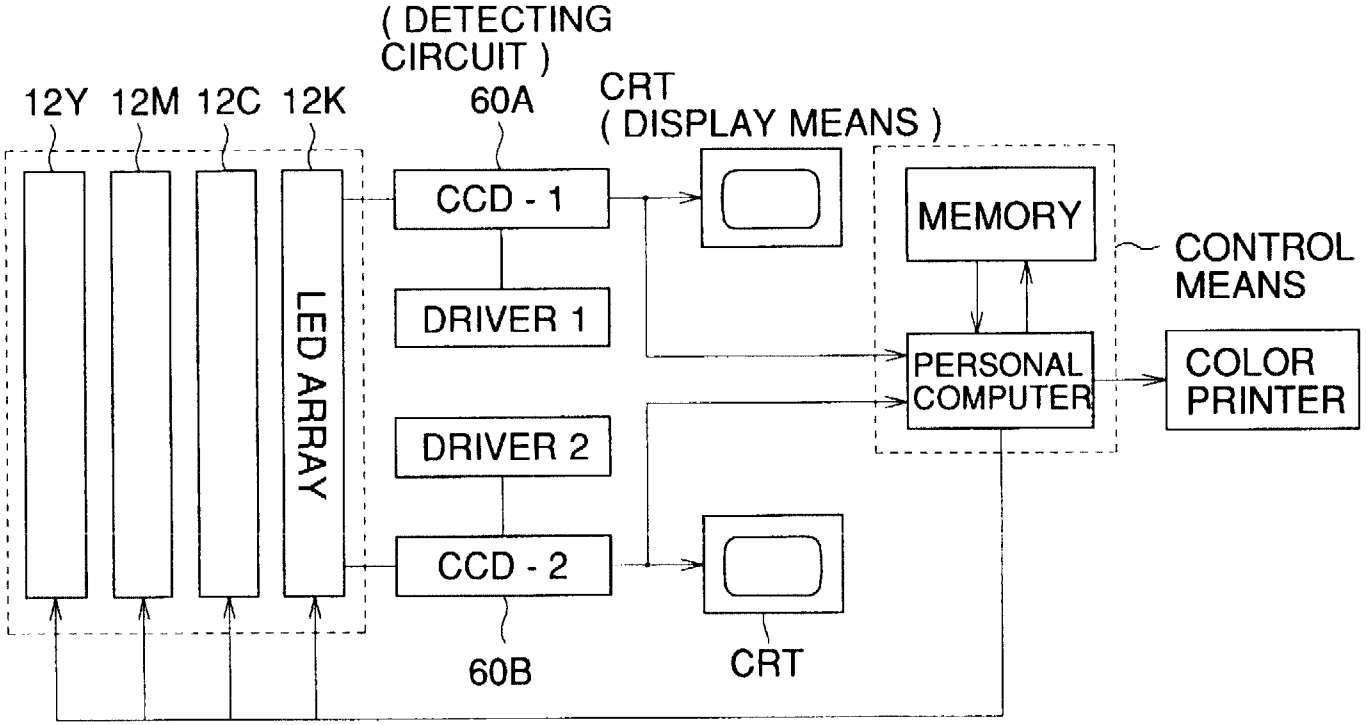
FIG. 7 is a block diagram showing an adjustment control means of the exposure optical system.

(8) The clamping means of the upper end portion and the clamping means of the lower end portion are slightly moved by the movement means in the directions of X, Y and Z respectively. The maximum output position of the light beam detecting means 60A and 60B is detected by the detection circuit and the display means, and a predetermined image forming position of the exposure optical system 12Y is set. FIG. 7, is a block diagram showing an adjustment control means of exposure optical systems 12(Y, M, C, K). The position and luminance (focus) of the lighting LED are measured by light beam detecting means (two-dimensional CCD sensors) 60A and 60B under the condition that the linear light emitting means (LED array) 121 corresponding to specific pixels of both ends of the exposure optical system 12(Y, M, C, K), is activated. The light beam detecting means 60A and 60B are two dimensional CCD sensors composed of, for example, 500×500 pixels, and the size of each pixel is 5 to 10 μm. The exposure optical systems 12(Y, M, C, K)

are slightly moved by the optical system adjusting means 40(A, B, C, D) in the directions of X, Y and Z. It is detected by the control means that image forming positions of specific lighting LEDs coincide with specific pixels in the area of the CCD sensor, and the positions are displayed on a CRT monitor, which is a display means.

(9) An adhesive agent is injected into a gap formed between the cutout 203 of the optical system supporting body 20 and the exposure optical system 12Y, and the exposure optical system 12Y is fixed in place.

(10) The reference pin 63 is pulled out, and the sensor supporting body 61 is moved to the second position. The reference pin 63 is inserted into the reference holes 53B and 61A for positioning. At this second reference position, the position of the opposed exposure optical system 12M is adjusted in the same way as previously-described, and then, it is also fixed by the adhesive agent.

(11) In the same way hereinafter, the sensor supporting body 61 is successively moved, and the exposure optical systems 12C and 12K are positioned and fixed on the optical system supporting body 20. After all exposure optical systems have been mounted on the optical system supporting body 20, the upper plate 53 is removed. The image exposure means, formed in a unit, which are composed of the adjusted exposure optical systems 12(Y, M, C, K) and the optical system supporting body 20, is removed from the base plate 51.

(EXAMPLE 2)

This example relates to the first and the third embodiments of the image forming apparatus having an externally arranged exposure means. In this example, the optical system assembly device is structured such that one light beam detecting means and one optical system adjusting means are fixed, and against that, the optical system supporting body is moved and the exposure optical system is adjusted.

Figure 8:
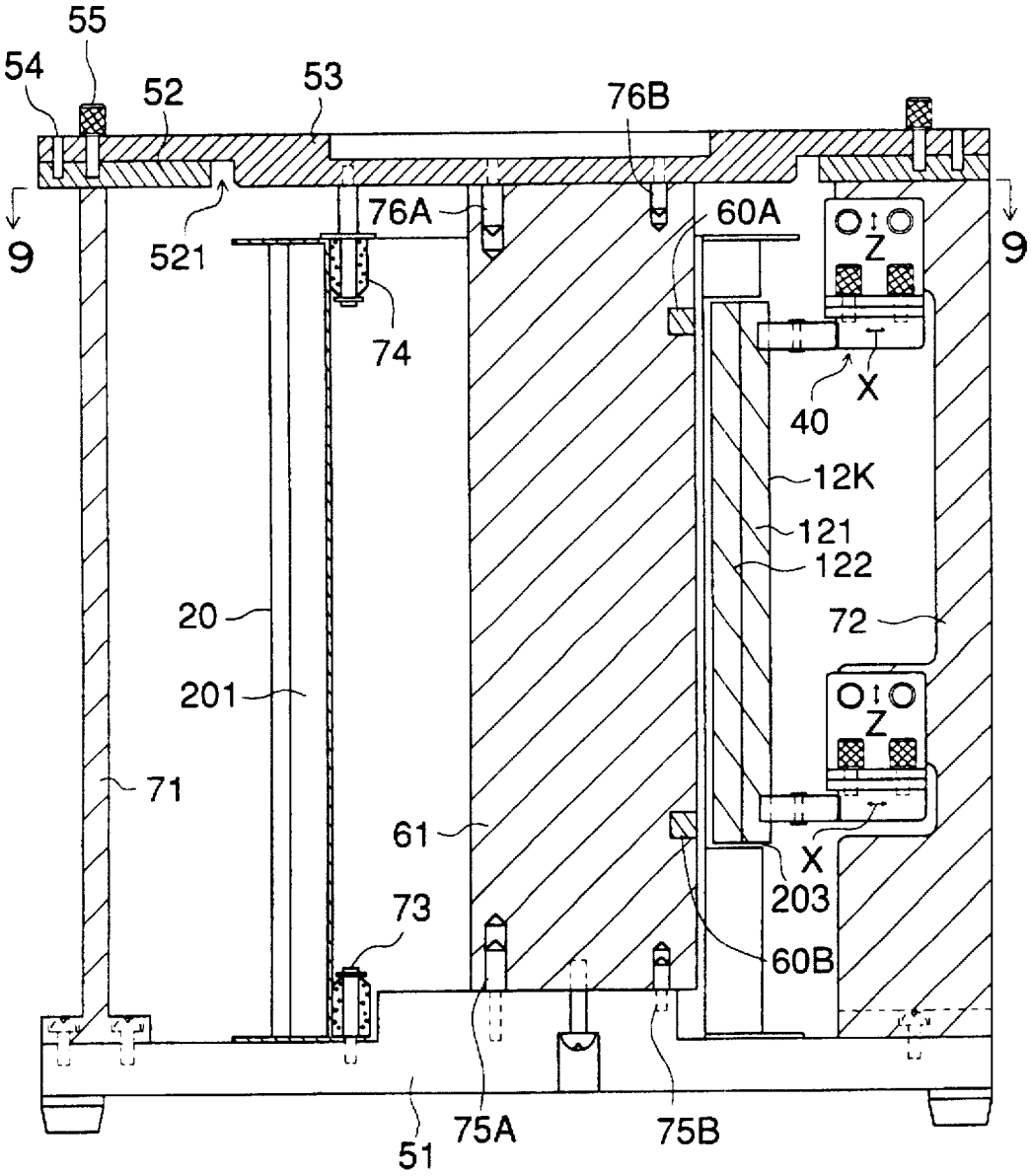
FIG. 8 is a frontal sectional view of the exposure optical system and the optical system assembling device in the example 2 of the present invention.
Figure 9:
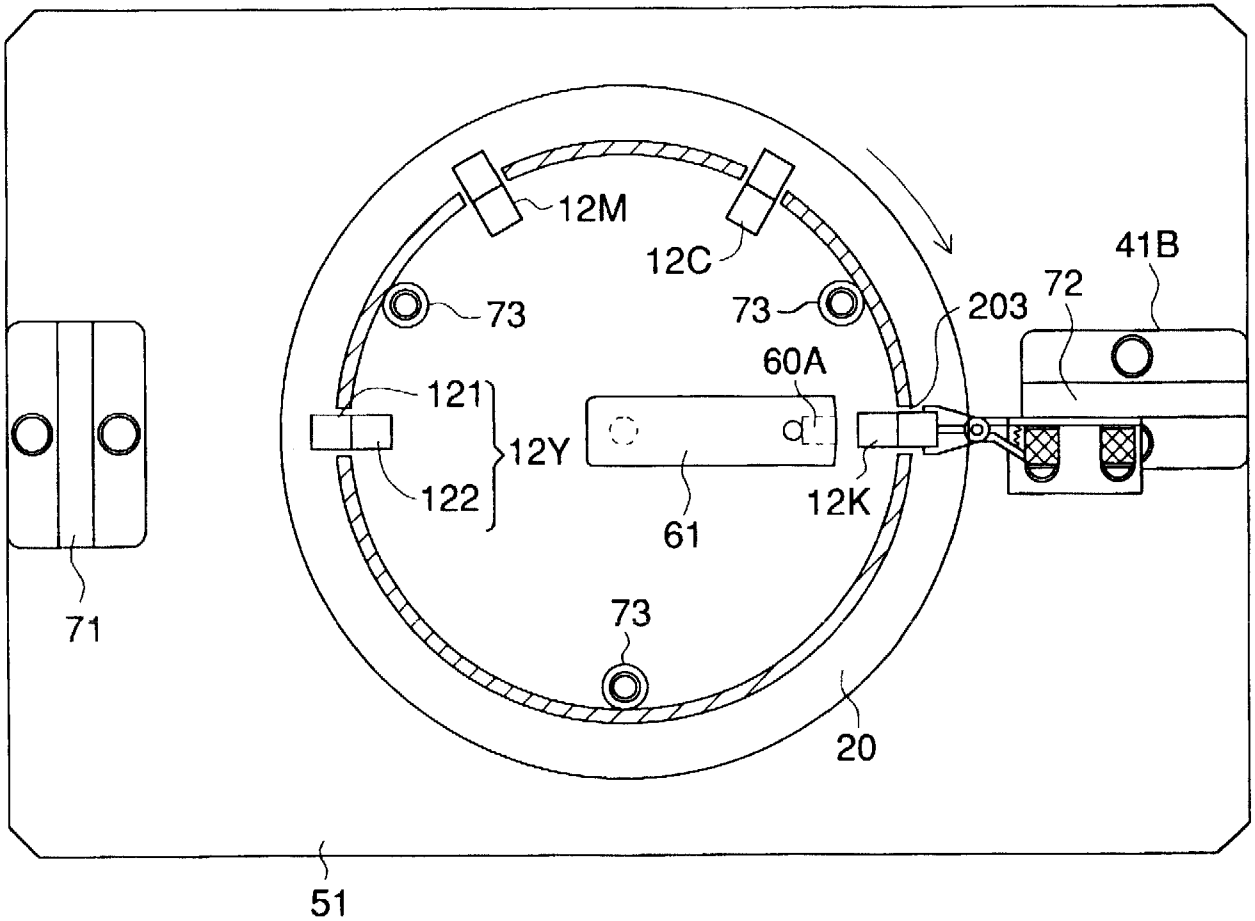
FIG. 9 is a view, viewed from the arrow 9—9 in FIG. 8, of the exposure optical system and the optical system assembling device in FIG. 8.

FIG. 8 is a frontal sectional view showing the exposure optical systems 12(Y, M, C, K) and the optical system assembly device. FIG. 9 is a plan view taken on line A—A in FIG. 8. In the drawings, portions having the same functions as those of the above-described example, are denoted by the same numerals.

Two supports 71 and 72 are vertically fixed in the vicinity of the left and right ends of the base plate 51. The upper base-plate 52 is horizontally fixed on the upper surface of the supports 71 and 72. An opening 521 through which the optical system supporting body 20 can pass, is provided in the center of the base plate 52. The detachable upper plate 53 is mounted on the upper surface side of the upper base-plate 52. The upper plate 53 is positioned and fixed at a predetermined position on the upper base-plate 52 by two positioning pins 54 and the fixing screws 55.

Three pairs of guide roller means 73 having rotatable guide rollers are vertically provided on the base plate 51 of the optical system assembly device, and rotationally contact with the lower portions of the inner wall of a cylindrical portion 201 of the optical system supporting body (cylindrical member) 20. Further, three pairs of guide roller means 74 having rotatable guide rollers are vertically provided also below the upper plate 53, and rotationally contact with the upper portions of the inner wall of a cylindrical portion 201 of the optical system supporting body 20.

The sensor supporting body 61 is fixed at a predetermined position on the base plate 51, and positioned by 2 positioning pins 75A and **75*b*. The reference pins 76A and 76B protrude from the lower portion of the upper plate 53, and are engaged with reference holes of the sensor supporting body 61, so that the sensor supporting body 61** is accurately positioned.

A pair of optical system adjusting means 40 which respectively clamp the upper portion and the lower portion of the linear light emitting means 12K and which can move in the directions of X, Y and Z, are individually positioned on the upper and lower portion of the support 72. That is, the optical system adjusting means 40 is composed of a three-dimensional movement means which can move in the directions of X, Y and Z with respect to the support 72, and the detachable clamping means, which clamps one end of the linear light emitting means 12K. The optical system adjusting means 40 has the same structure as the optical system adjusting means 40 (A, B, C, D) in the first Example 1, and accordingly, the redundant explanation is omitted.

Optical detection sensors 60A and 60B are respectively provided at the upper and the lower portions on the side on which the sensor supporting body 61 is opposed to both ends of the linear light emitting means 121. The light beam detection sensors 60A and 69B are composed of, for example, two-dimensional CCD sensors, and are previously set at an image formation position by the exposure optical system 12 when the reference image forming body 10 is used, that is, at the image formation reference position on the outer peripheral surface of the reference image formation body 10. The light beam detection means 60A and 60B are connected to a detection circuit composed of ampere meters and the like, not shown in the drawing, and a display means, on which the output of the detection means is displayed.

Next, processes for adjusting the image exposure means using the optical system assembly device will be described.

(1) The optical system supporting body 20 is inserted into the opening 521 of the upper base-plate 52, and the lower portion of the inner peripheral surface of the cylinder portion 201 is engaged with the three guide roller means 73 on the base plate 51, so that the supporting body 20 is positioned for mounting.

(2) Three guide roller means 74 provided on the upper plate 53 are engaged with the upper portion of the inner peripheral surface of the cylinder portion 201 of the support member 20. Further, positioning pins 54 in the vicinity of both end portions of the upper plate 53 are engaged with the holes on the upper portion of the upper base-plate 53, and the upper plate 53 is fixed by fixing screws 55.

(3) Simultaneously, positioning pins **76*a* and 76B provided on the upper plate 53 are inserted into the reference holes of the sensor supporting body 61, and thus the sensor supporting body 61** is stably secured.

(4) One exposure optical system, for example, the exposure optical system 12Y unit composed of the linear exposure means 121Y and the light converging fiber lens array 122Y, is inserted into the cutout 203 of the optical system supporting body 20. Following that, the optical supporting body 20 is rotated and stopped at a predetermined rotation position, and is fixed with screws. This stop position may be adjusted using graduated markings, or it may be fixed using the positioning pins. The front surface of the upper portion of the light converging fiber lens array 122Y is opposed to the light detecting means 60A at this stop position.

(5) The upper portion of the exposure optical system 12Y is clamped between the fixed clamping member 44A and the movable clamping member 46A of the upper end portion clamping means. Further, the lower portion of the exposure optical system 12Y is clamped between the fixed clamping member 44A and the movable clamping member 46A of the lower end portion clamping means.

(6) The specific linear exposure means 121Y of the exposure optical system 12Y is caused to emit a beam of light, and an image is formed on the light detecting means 60A and 60B through the light converging fiber lens array 122Y.

(7) The upper end portion clamping means and the lower end portion clamping means are respectively moved slightly in the directions of X, Y and Z. The position at which the output of the light beam detecting means 60A and 60B is maximum, is detected by the detection circuit and display means shown in FIG. 7, and a predetermined image forming position of the exposure optical system 12Y is thus determined.

(8) An adhesive agent is injected into the gap formed between the cutout 203 of the optical system supporting body 20 and the exposure optical system 12Y, and the exposure optical system 12Y is fixed in place.

(9) Next, the movable clamping members 44A and 46A of the upper end portion clamping means and the lower end portion clamping means are opened and withdrawn, and the optical support member 20 is moved for a predetermined angle and fixed in place. The position of following exposure optical system 12M is adjusted with respect to the optical system supporting body 20 which has been fixed at the predetermined position, in the same way as the foregoing, and the exposure optical system 12M is also fixed by adhesive agent. Hereinafter, in the same way, positions of the exposure optical systems 12C and 12K are successively adjusted, and these optical systems are fixed on the optical system supporting body 20.

(10) After all exposure optical systems have been mounted on the optical system supporting body 20, the upper plate 53 is removed, and the image exposure means unit composed of exposure optical systems 12(Y, M, C, K) and then the optical system supporting body 20, is removed from the base plate 51.

(EXAMPLE 3)

This example relates to the first and the fourth embodiments of the image forming apparatus having an externally arranged exposure means. Specifically, it relates to an optical system assembly device in which plural pairs of units composed of a light detecting means and exposure optical system position adjustment tools, are located and fixed with respect to the fixed optical system supporting body, and the exposure optical system is thus adjusted.

Figure 10:
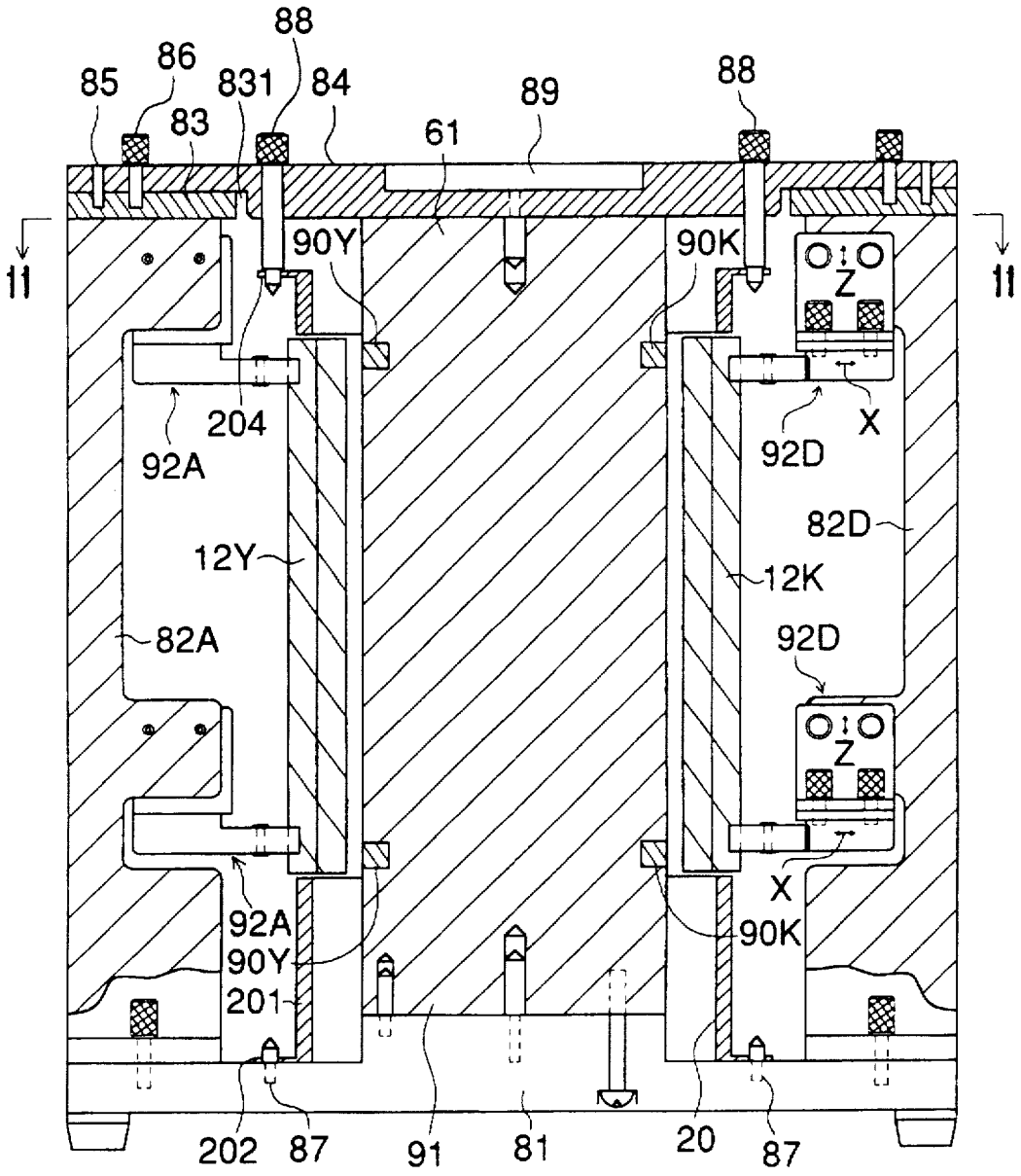
FIG. 10 is a frontal sectional view showing the exposure optical system and the optical system assembling device in the example 3 of the present invention.
Figure 11:
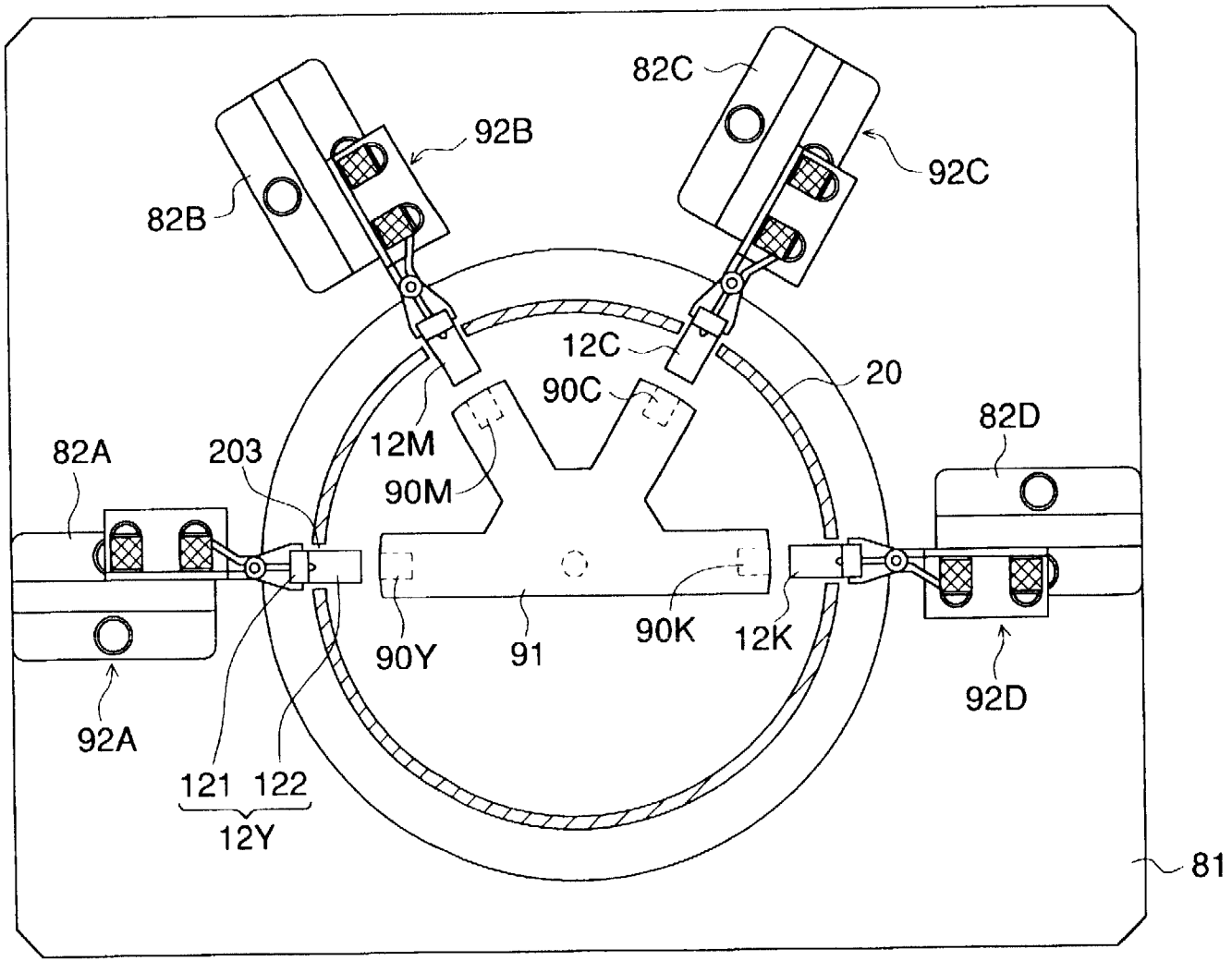
FIG. 11 is a view, viewed from the arrow 11—11 in FIG. 10, of the exposure optical system and the optical system assembling device in FIG. 10.

FIG. 10 is a front sectional view showing the exposure optical systems 12(Y, M, C, K) and the optical system assembly apparatus. FIG. 11 is a plan view taken on line A—A in FIG. 10. In the drawings, portions having the same functions as those of the above-described example, are denoted by the same numerical symbols.

Four supports 82A, 82B, 82C and 82D are vertically fixed on the base plate 81 of the optical system assembly device, and screwed in place so as to be movable. The upper base-plate 83 is horizontally fixed on the upper surface of the supports 82A to 82D. An opening 831 through which the optical system supporting body 20 can pass, is provided in the center of the upper base-plate 83. The detachable upper plate 84 is mounted on the upper surface of the upper base-plate 83. The upper plate 84 is positioned and fixed at a predetermined position on the upper base-plate 83 by two positioning pins 85 and the fixing screws 86.

Two positioning pins 87 are provided on the base plate 81 of the optical system assembly apparatus, which engage with reference holes of the lower flange portion 202 of the optical system supporting body 20, and the optical system supporting body 20 is thus positioned at a predetermined position on the base plate 81. Two positioning pins 88, which are detachably engaged with reference holes of the flange portion 204 provided above the optical system supporting body 20, are also on the upper plate 84, so that the optical system supporting body 20 is positioned at a predetermined position.

A sensor supporting body 91 of the light beam detecting means is fixed on the base plate 81 at a predetermined position inside the center of the optical system supporting body 20. A positioning pin 89 protrudes from the center of the upper plate 84, and is engaged with an upper hole of the sensor supporting body 91 of the light beam detecting means so that the upper plate 84 is mounted at a predetermined position and is detachable. As shown in FIG. 11, 4 pairs of light beam detecting sensors 90(Y, M, C, K) each pair of which are composed of an upper sensor and a lower sensor, are radially arranged and fixed in place. The light beam detecting sensors 90Y to 90K are composed of, for example, two-dimensional CCD sensors, and previously located at image formation positions of the exposure optical systems 12(Y, M, C, K), when the reference image formation body 10 is used, that is, at the image formation reference positions on the outer peripheral surface of the reference image forming body 10.

Optical system adjusting means 92A, 92B, 92C and 92D are radially arranged opposite to the detection surface of light beam detecting sensors 90Y, 90M, 90C and 90K.

Optical system adjusting means 92A to 92D have an upper end portion clamping means and a lower end portion clamping means which are approximately similar to those in Example 1. The upper end portion clamping means clamps the upper end portion of the light converging fiber lens array 122 of the image exposure optical systems 12(Y, M, C, K) and can move in the directions of X, Y and Z, which are structured in almost the same way as the members 41A to 46A. The lower end portion clamping means also clamps the lower end portion of the light converging fiber lens array 122 of the image exposure optical systems 12(Y, M, C, K), and can move in the directions of X, Y and Z, which are structured in almost the same way as members 41A to 46A. The thus structured 4 pairs of units, composed of 4 light beam detecting sensors 90(Y, M, C, K) and 4 optical system adjusting means 92A to 92D, are arranged and fixed opposite to each other.

Next, processes to adjust the image exposure means by the optical system assembly device will be described.

(1) The optical system supporting body 20, into which the exposure optical systems 12Y, 12M, 12C and 12K are temporarily inserted, is inserted from an opening 831 of the upper-base plate 83, and a flange portion 202 of the optical system supporting body 20 is positioned by positioning pins 87 and located on the base plate 81.

(2) Positioning pins 85 of the upper plate 84 are engaged through holes of the upper portion of the upper base-plate 83, and after that, the upper plate 84 is fixed by fixing screws 86. The relative position of the upper plate 84 with the optical system supporting body 20 is determined by a positioning pin 89. Further, the relative position with the optical system supporting body 20 is finally determined by positioning pins 88. As described above, when the optical supporting body 20 is positioned, the exposure optical system 12Y is opposed to a pair of light beam detecting sensors 90Y, composed of an upper sensor and a lower sensor, of the optical system assembly device and the clamping member of the optical system adjusting means 92A. Simultaneously, the exposure optical system 12M is opposed to the clamping member of the optical system adjusting means 92B and the light beam detecting sensor 90M. The exposure optical systems 12C and 12K are also respectively opposed to the light beam detecting sensors 90C and 90K, and the optical system clamping members of the optical system adjusting means 92C and 92D, in the same way as described above.

(3) The exposure optical system 12Y is moved in directions of X, Y and Z by the optical system assembly device 90A, and is adjusted by the light beam detecting sensor 90Y and a control means shown in FIG. 7. After that, the exposure optical system 12Y is secured by an adhesive agent. The exposure optical systems 12M, 12C and 12K are adjusted in the same way as described above.

(4) After all exposure optical systems have been mounted on the optical system supporting body 20, the upper plate 84 is removed, and the exposure optical systems 12(Y, M, C, K) and the optical system supporting body 20, which have been adjusted and integrated, are removed from the base plate 81.

According to the present invention, the accuracy of the mounting position of the linear image exposure optical system on the optical system supporting body is increased in an image forming apparatus having an optical system-enclosed exposure means. Further, mounting and adjustment operation time is reduced, and the operation becomes easier.

Figure 12:
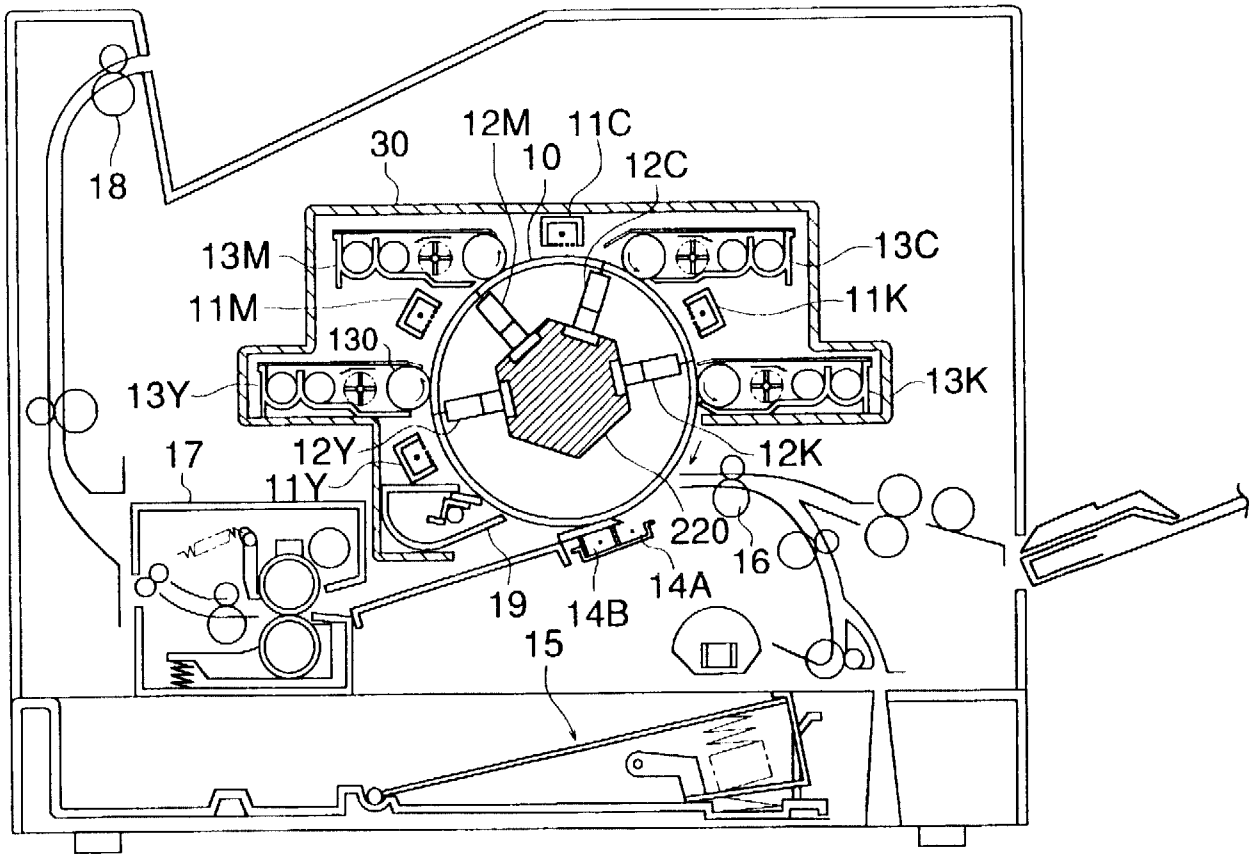
FIG. 12 is a sectional view showing an example of the color image forming apparatus having an internally enclosed exposure means, to which the present invention is applied.
Figure 13:
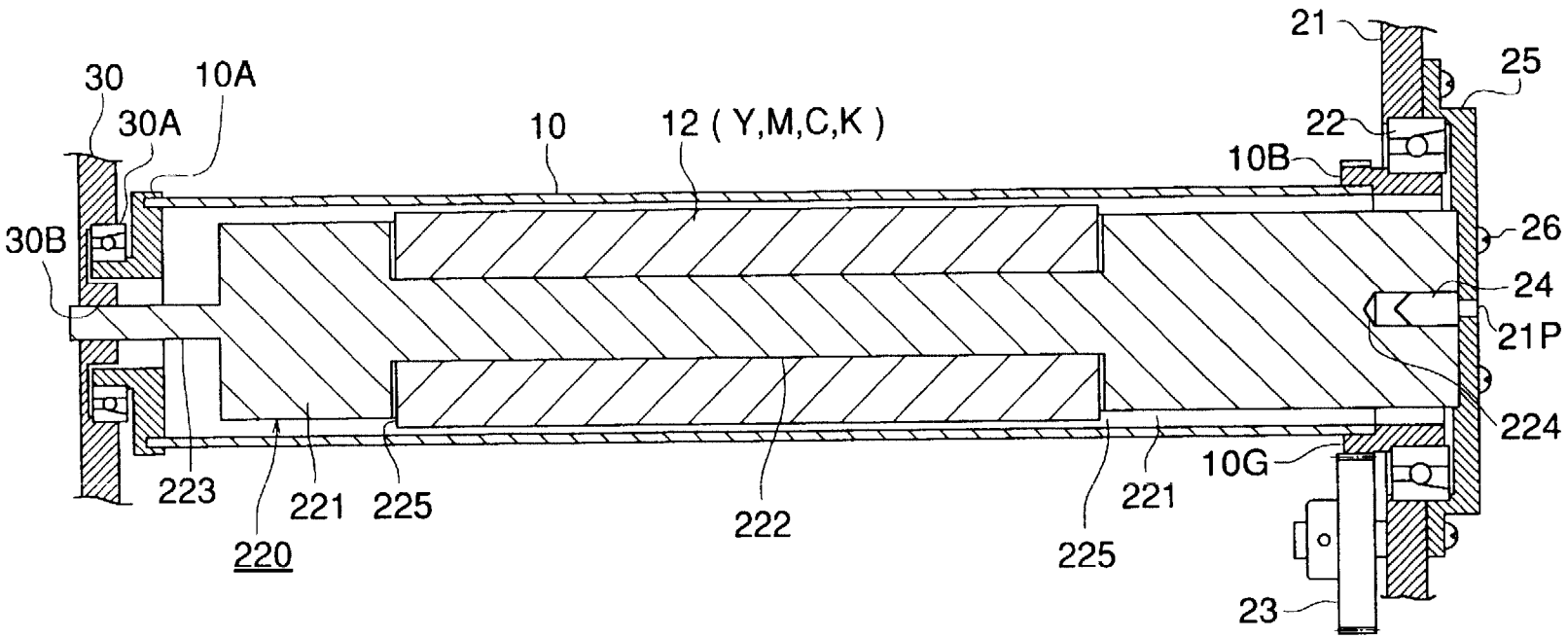
FIG. 13 is a sectional view showing a photoreceptor drum and the exposure optical system.
Figure 14:
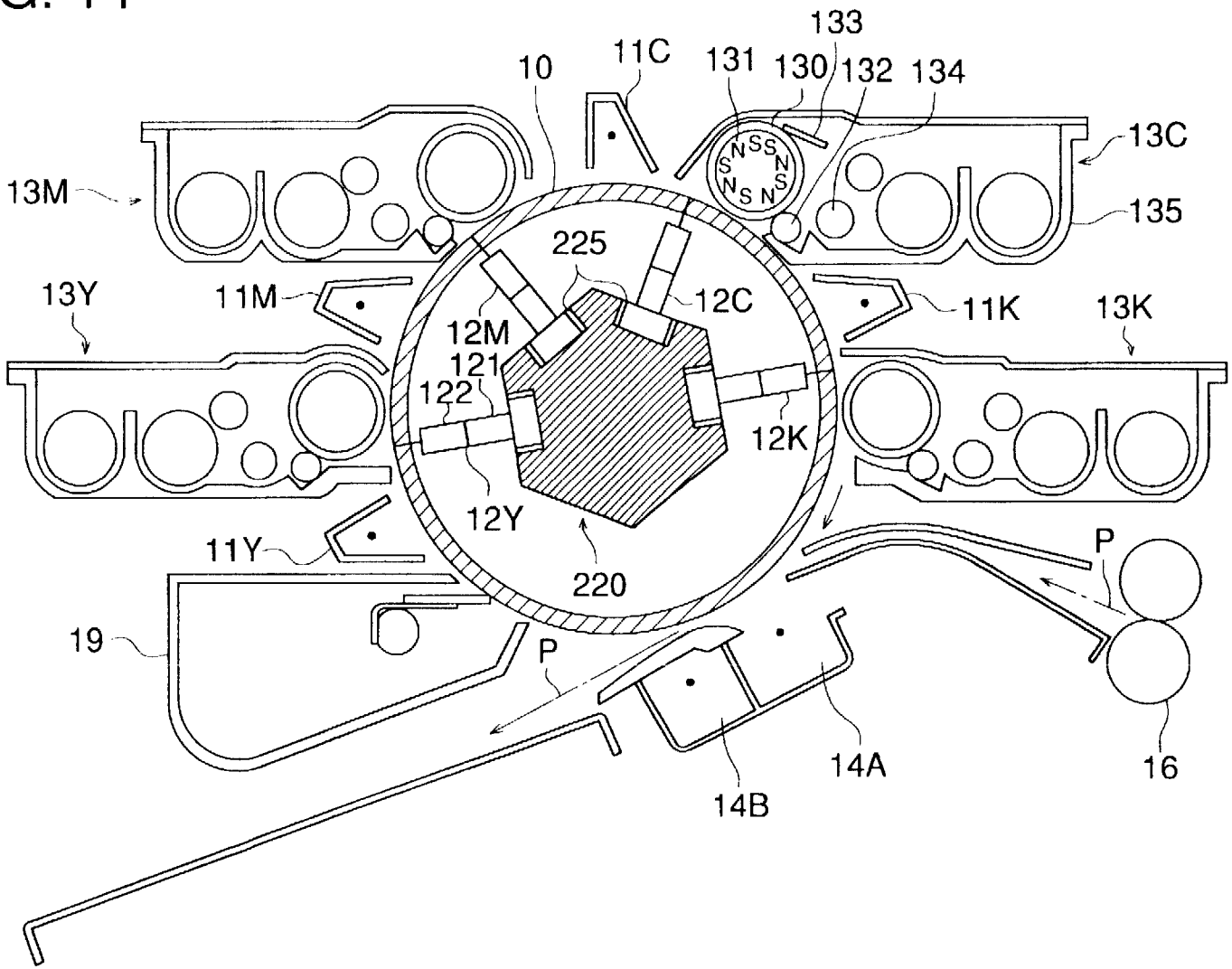
FIG. 14 is a sectional view showing an image forming means around the photoreceptor drum.

Referring to FIGS. 12, 13 and 14, the entire structure of a color image forming apparatus having an internally enclosed image exposure means will be described below.

FIG. 12 is a sectional view of a color printer as an example of the color image forming apparatus to which the present invention is applied. FIG. 13 is a sectional view showing a photoreceptor drum and an exposure optical system. FIG. 14 is a sectional view showing an image forming means around the photoreceptor drum.

In these drawings, numeral 10 is a photoreceptor drum which is a drum-shaped image forming body, and in which a transparent conductive layer and an organic photoreceptor layer (OPC) are coated on the outer periphery of a cylindrical base body formed of optical glass or transparent acrylic resin.

In the present invention, the transparent base body may have only an amount of exposure, the wavelength of which can form an appropriate contrast with light attenuation characteristics of a light conductive layer (light carrier generation), in a light conductive layer of the photoreceptor drum 10 which is an image forming point of exposure beams for image exposure. Accordingly, it is not necessary that a light transparency factor of a transparent base body of the photoreceptor drum 10 be 100%, but it may have a characteristic in which some amount of light is absorbed at the time of transmission of the exposure beam. As transparent base body materials, soda glass, Pyrex glass, boric silicate glass, or any type of light transmissive resins such as fluorine, polyester, polycarbonate, polyethylene terephtalate, etc., can be used. As a light transmission conductive layer, indium, tin oxide (ITO), lead oxide, indium oxide, copper iodide, or a metallic film, in which light permeability is maintained, and which is formed of Au, Ag, Ni, Al, etc., can be used. As film forming methods, a vacuum deposition method, an activated reaction deposition method, any type of spattering method, any type of CVD method, a dip coating method, a spray coating method, etc., can be used. As light conductive layers, an amorphous silicon (a-Si) alloy photoreceptor layer, an amorphous selenium alloy photoreceptor layer, or any type of organic photoreceptor layer (OPC), can be used.

Both ends of the photoreceptor drum 10 are integrated with flanges 10A and 10B. The flange 10A on one end of the photoreceptor drum 10 is supported by ball bearings 30A provided in the cartridge 30, and the flange 10B of the other end is supported by ball bearings 22 provided in a base plate 21 of the apparatus main body. A gear 10G formed on the outer periphery of the flange 10B is engaged with a drive gear 23 of the apparatus main body, and the photoreceptor drum 10 is rotated clockwise by its driving force while the transparent conductive layer is electrically grounded.

Numerals 11(Y, M, C, K) are scorotron chargers which uniformly charge the photoreceptor 10 by corona discharge using a grid and a discharge wire, which has a predetermined potential voltage with respect to the organic photoreceptor layer on the photoreceptor drum 10.

Numerals 12(Y, M, C, K) are linear exposure optical systems (which is called exposure optical system, hereinafter) and which are composed of: linear FLs (fluorescent substance emitting element), ELs (electroluminescence element), PLs (plasma discharging element), LEDs (light emitting diode), in which light emitting elements are arranged in the shape of an array in the axial direction of the photoreceptor drum 10; a linear light emitting means 121 such as LISA (photoelectro-magnetic effect optical shutter array), PLZT (transparent piezoelectric shutter array), LCS (liquid crystal shutter), etc. in which elements having optical shutter functions are linearly arranged; and a converging fiber lens array 122 as a life-sized image formation element. Each color image signal read by an image reading device, which is separately provided from the apparatus, is successively read from a memory and is inputted into each exposure optical system 12(Y, M, C, K) as an electric signal.

A cover member 25 having a guide pin 24 is fixed on the base plate 21 of the apparatus main body. All exposure optical systems 12(Y, M, C, K) are mounted onto a fixed optical system supporting body 220 when these exposure systems are guided by a guide pin 24 of the cover member 25 and a reference hole 30B provided in the cartridge 30, and are accommodated inside the base body of the photoreceptor drum 10. The optical system supporting body 220 is composed of: a cylindrical portion 221 near both ends in the axial direction; a hexagonal pole exposure optical system attaching portion 222 at the central portion; an axial portion 223 which is connected to one end of the cylindrical portion 221 and engaged with the reference hole 30B of the cartridge 30; and a reference hole 224 provided in the other end surface of the cylindrical portion 221. A recess 225 is provided in each surface of the exposure optical system attaching portion 222, and the base portion of the linear light emitting means 121 of the exposure optical systems 12(Y, M, C, K) is freely engaged with the recess 225.

Numerals 13Y, 13M, 13C, and 13K represent developing units in which yellow(Y), magenta(M), cyan (C), and black (K) developers are respectively accommodated, and each developing unit has a developing sleeve 130 which is rotated opposite to the rotation of the photoreceptor drum 10 with a predetermined gap with respect to the peripheral surface of the photoreceptor drum 10. The developing sleeve 130 has a fixed magnet 131 inside the sleeve. Numeral 132 is a thin layer forming member for developer, and is provided at the upstream side of the developing area of the rotating developing sleeve 130, so that the amount of the developer to be conveyed to the developing area is regulated. Numeral 133 is a developer scraping member, and scrapes any developer adhered to the developing sleeve 130 which has completed the development. Numeral 134 is a supplying member which supplies newly stirred developer. A developing bias voltage, in which a DC voltage is superimposed on an AC voltage, is impressed upon the developing sleeve 130, and contactless development is carried out in the developing area closest to the photoreceptor drum 10. In the example shown here, although the developing sleeve 130 is rotated in the opposite direction to the rotation of the photoreceptor drum 10, this direction of rotation is not limited in this example.

Each developing unit contactlessly reversal-develops the electrostatic latent image on the photoreceptor drum 10, formed by charging of the chargers 11(Y, M, C, K), and by image exposure of exposure optical systems 12(Y, M, C, K), when the development bias voltage is impressed.

Next, the color image forming processes in this apparatus, mainly concerning processes different from the above-described examples, will be described.

The exposure onto the organic photoreceptor layer of the photoreceptor drum 10 by each exposure optical system is conducted through the transparent base body from inside the drum. Accordingly, exposure of the images corresponding to the second, third, and fourth color signals, is respectively conducted without any influence of the previously formed toner images, and electrostatic latent images having the same image quality as that of an image corresponding to the first color signal can be formed. In this connection, temperature stabilization and temperature-rise prevention in the photoreceptor drum 10 due to heat generation of each exposure optical systems 12(Y, M, C, K), can be satisfactorily carried out when good heat-conductivity material is used for the support member 220; a heater is used to enhance processing during low temperature conditions; or heat is diffused outside the apparatus through a heat pipe for processing during high temperature conditions. Further, in the developing action by each developing unit 13(Y, M, C, K), a developing bias DC voltage, or an AC voltage superimposed on the DC voltage, is applied on the developing sleeve 130; contactless development is conducted by one component or two-component developer accommodated in the developing unit 13(Y, M, C, K); a DC bias voltage, having the same polarity as the toner, is applied onto the photoreceptor drum 10 in which a transparent conductive layer is electrically grounded; and contactless reversal development is conducted so that toner adheres to the exposed portions.

The photoreceptor drum 10, each charger 11(Y, M, C, K), each developing unit 13(Y, M, C, K) and the cleaning unit 19 are integrally accommodated in the cartridge 30, and the cartridge is mounted in the image forming apparatus main body. The apparatus is structured such that a plurality of exposure optical systems 12(Y, M, C, K) composed of linear light emitting means 121 and a light converging fiber lens array 122, and the optical system supporting body 220 are integrally formed into an image exposure unit, which can be directly attached to and detached from the image forming apparatus main body. Accordingly, the cartridge 30 is structured such that any mechanical load or impact is not applied to the image exposure means and the cartridge 30 can be attached to and detached from the apparatus main body while the image exposure unit remains in its normal position. The structure in which the exposure optical systems 12(Y, M, C, K) remain at the time of attachment and detachment, has advantages in that the heater, a heat pipe, a lead wire for the LEDs, and the exposure optical systems 12 (Y, M, C, K) can remain fixed on the support member 220 even when the photoreceptor drum is rotated or the photoreceptor drum 10 is attached to or detached from the apparatus. Further, the structure can also be utilized for determining the center of the axis of the photoreceptor drum 10.

In the color image forming apparatus of the present invention, the exposure optical systems 12(Y, M, C, K) using the light emitting elements 121 such as LEDs, and light converging fiber lens array 122 are arranged inside the photoreceptor drum 10, and the image exposure position of the exposure optical systems 12(Y, M, C, K) is provided upstream of the developing sleeve 130 in the development casing 135.

(EXAMPLE 4)

This example relates to the image forming apparatus having an internally enclosed exposure means, and relates to an optical system assembly device in which a unit composed of a light beam detecting means and exposure optical system adjusting tools are arranged at a predetermined position on a fixed support, and the exposure optical system is adjusted while the optical system supporting body is rotated.

Figure 15:
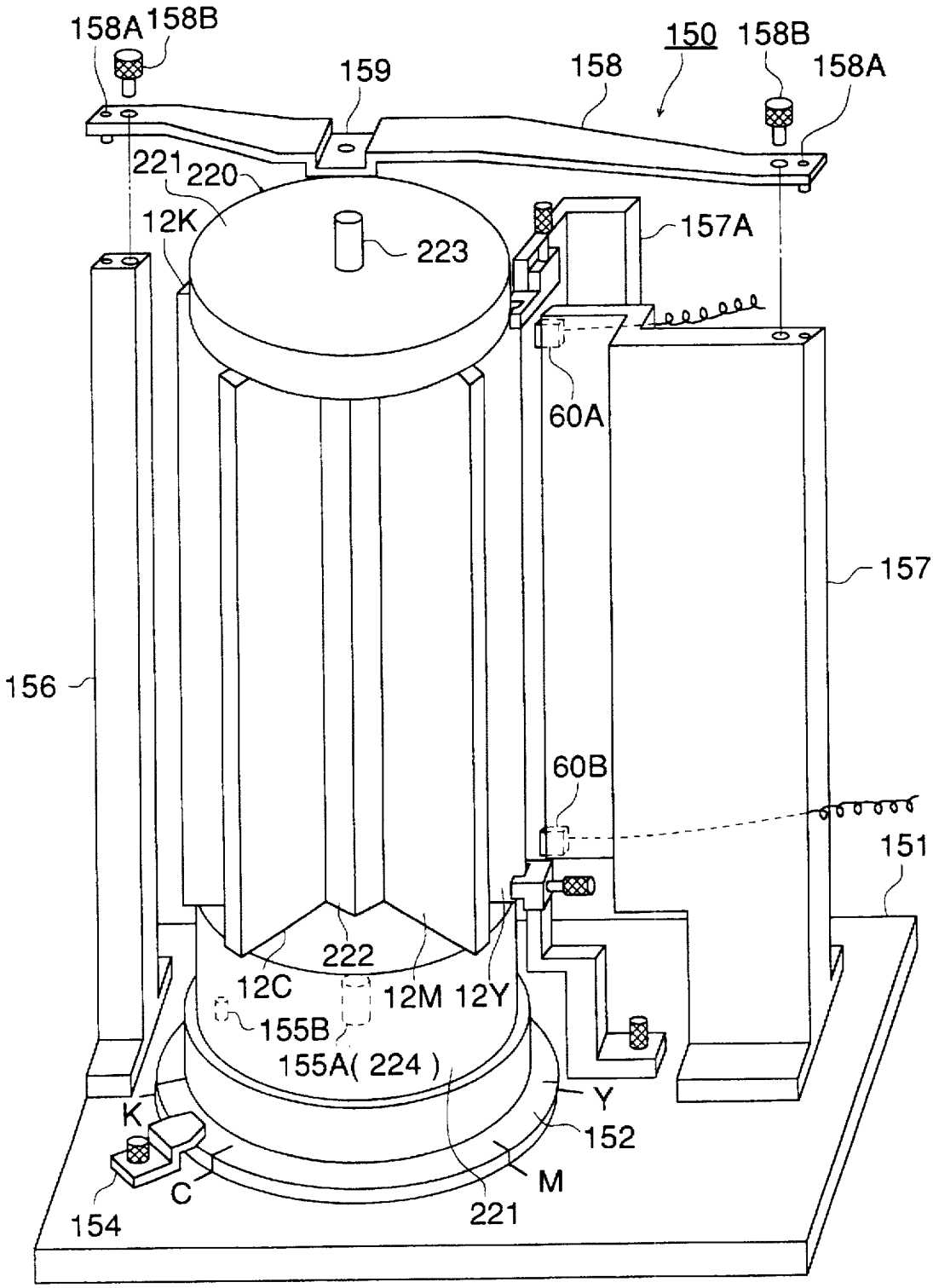
FIG. 15 is a perspective view of the exposure optical system and the optical system assembling device in the example 4 of the present invention.
Figure 16:
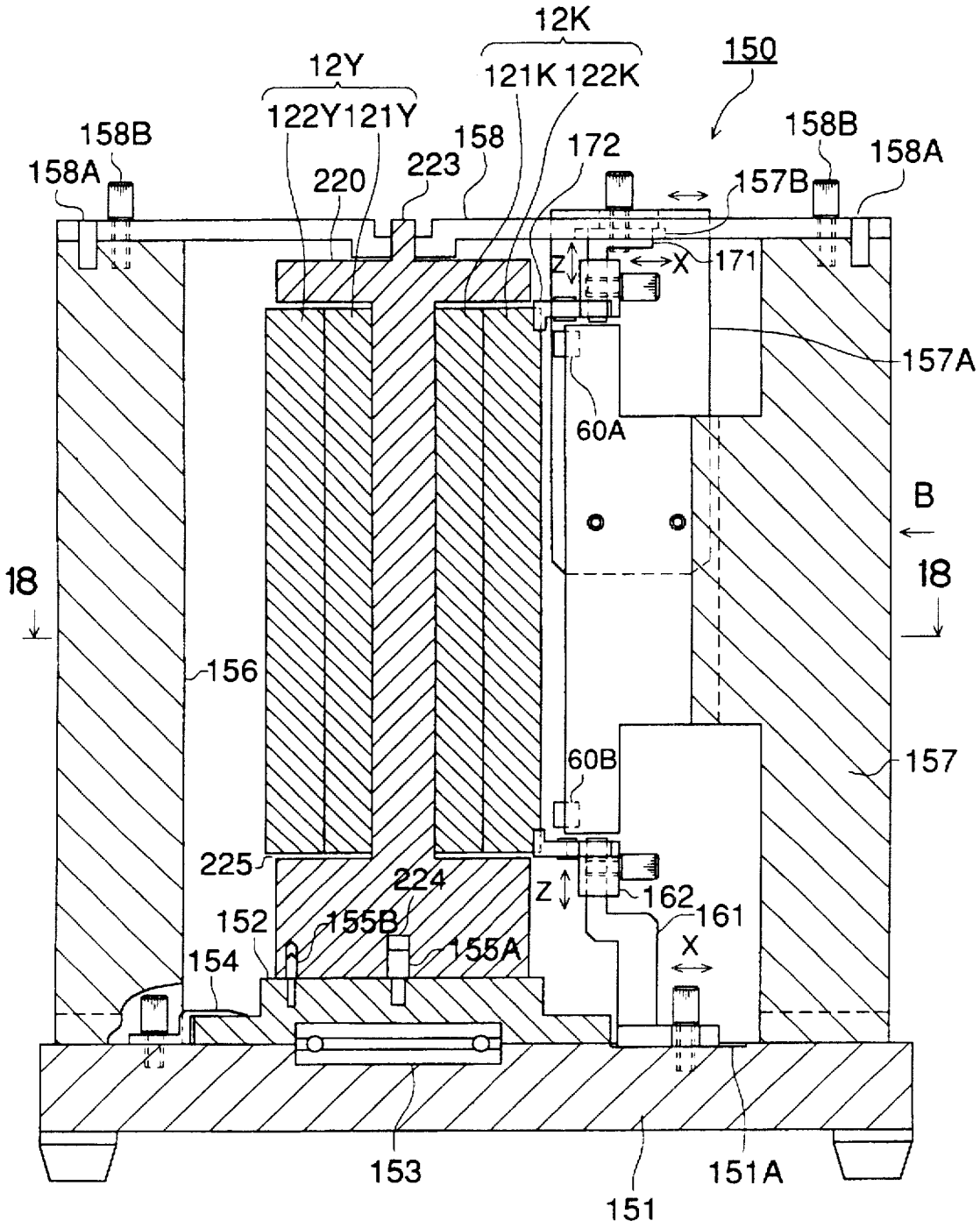
FIG. 16 is a frontal sectional view of the above-described exposure optical system and the optical system assembling apparatus.
Figure 17:
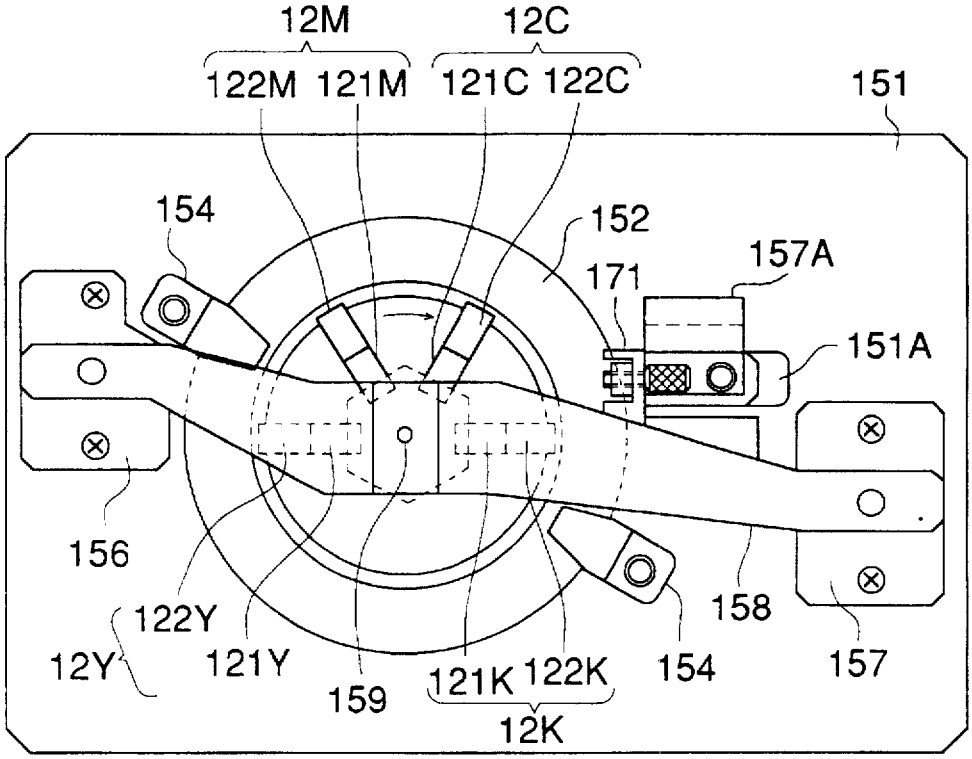
FIG. 17 is a plan view of the above-described exposure optical system and the optical system assembling device.
Figure 18:
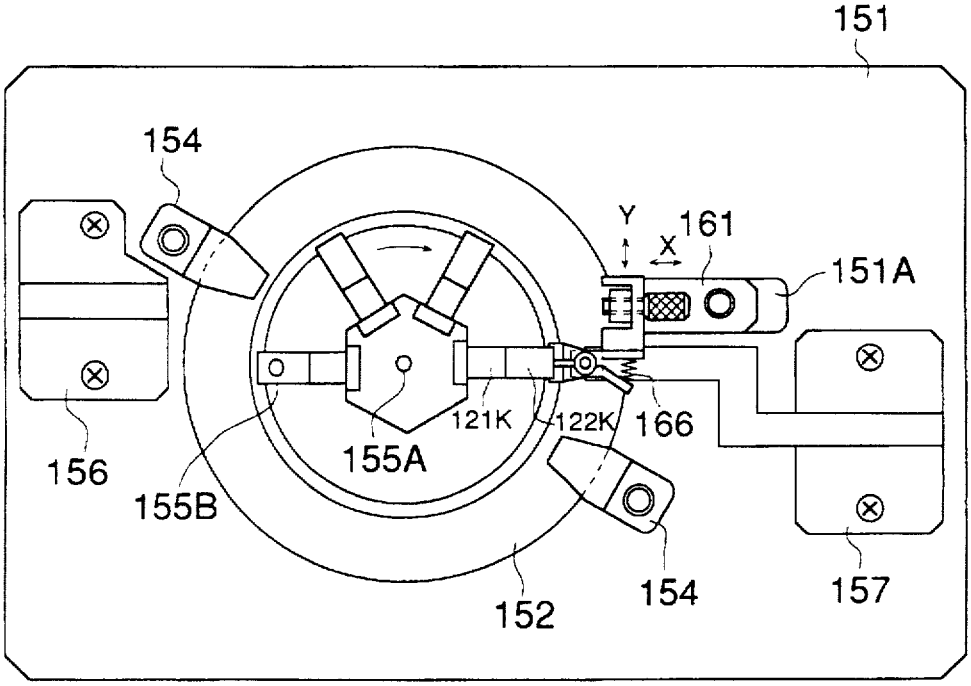
FIG. 18 is a view taken on line 18—18 shown in FIG. 16.
Figure 19:
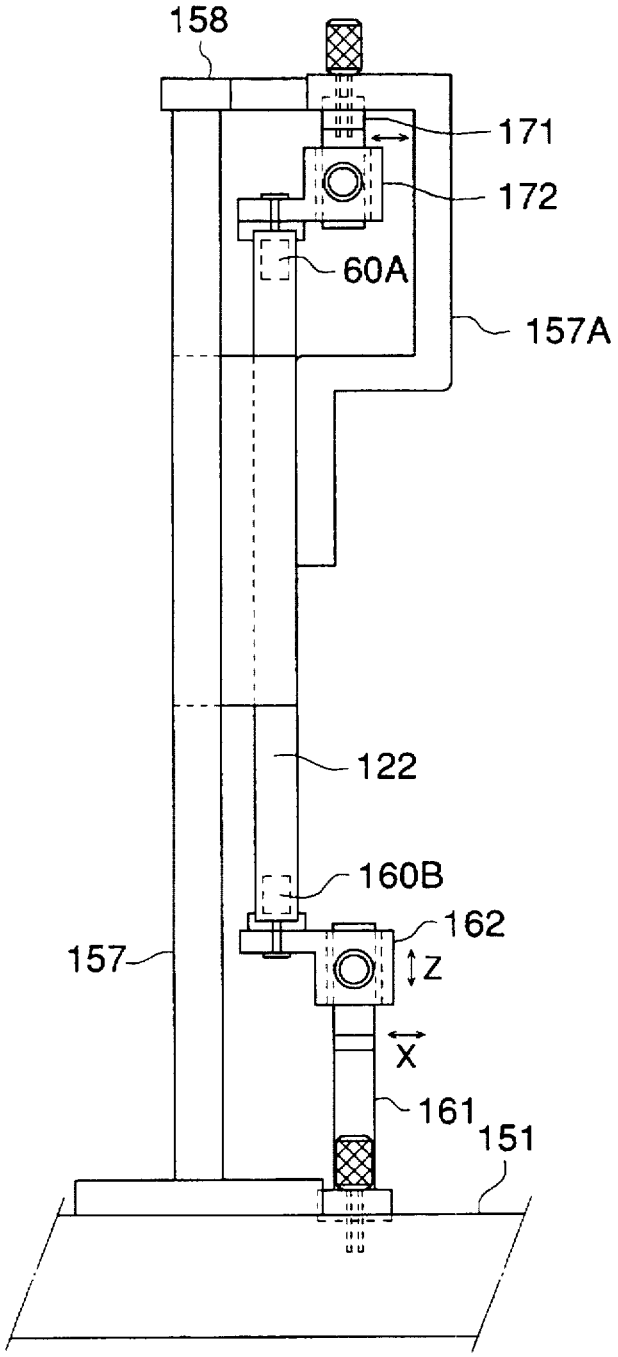
FIG. 19 is a view, viewed from the arrow B in FIG. 16.

FIG. 15 is a perspective view of the exposure optical systems 12(Y, M, C, K) and the optical system assembly device. FIG. 16 is a frontal sectional view of the exposure optical systems 12(Y, M, C, K) and the optical system assembly device. FIG. 17 is a plan view of the exposure optical systems 12(Y, M, C, K) and the optical system assembly device. FIG. 18 is a view taken on line A—A in FIG. 16. FIG. 19 is a view, viewed from an arrow B in FIG. 16.

A plurality of cutout portions 225, in which a plurality of exposure units integrally composed of linear light emitting means 121 and light converging fiber lens arrays are freely inserted, are provided in the optical system supporting body 220.

A rotatable table 152 is provided through bearings 153 in the vicinity of the center of the base plate 151 of the optical system assembly device 150. After the table 152 has been set at a predetermined angular position, the table 152 is fixed on the base plate 151 by clamps 154. A reference pin 155A protrudes at the rotational center of the ratatable table 152, and is engaged with a reference hole 224 of the optical system supporting body 220 and the central position of the optical system supporting body 220 is determined. A positioning pin 155B protrudes in the radial direction and is engaged with a hole, in the radial direction, of the optical system supporting body 220 when the optical system supporting body 220 is placed on the rotatable table 152, and the rotational direction of the optical system supporting body 220 is thus determined.

Supports 156 and 157 are perpendicularly fixed near both the left and right ends on the base plate 151. An upper plate 158 which is attached to and detached from the assembly device, is provided on the upper surface of supports 156 and 157. A reference hole is provided in the vicinity of the center of the upper plate 158, and is engaged with an upper shaft portion 223 of the optical system supporting body 220 placed on the rotatable table 152. After the optical system supporting body 220 has been positioned by engagement of the reference hole of the upper plate 158 with the shaft portion 223, the upper plate 158 is fixed onto the upper surface of the supports 156 and 157 by screws, or the like.

FIG. 20(*a*) is a plan view of the light beam detection means according to the present invention. The light beam detection sensors 60A and 60*b* are respectively provided at the upper and lower portions opposite to both ends of the linear light emitting means 121. The light beam detection means 60A and 60B are composed of, for example, two-dimensional CCD sensors, and previously arranged at an image formation position of the exposure optical system 12(Y, M, C, K), using the reference image forming body 10, that is, at an image formation reference position on the outer peripheral surface of the reference image forming body 10. The position and focus of the linear light emitting means 121 are adjusted while being detected by the light beam detection means 60A and 60B under the condition that specific pixels of both ends of the linear light emitting means 121 are lighted. The light beam detection means 60*a* and 60B are connected to the detection circuit and display means shown in FIG. 7, and the output is displayed on a CRT.

FIG. 20(*b*) is a plan view of a lower end clamping means which clamps the lower end of the exposure optical system 12 (Y, M, C, K), and which can move. A parallel slot 151A is provided in the base plate 151, and a moving stand 161 can move in the X direction in the parallel slot 151A. A holding member 162 is held at the upper portion of the moving stand 161 so that the holding member can move in the Y and Z directions with respect to the moving stand 161. A tip portion of the holding member 162 forms a fixed clamping portion 163 which clamps the lower portion of the end portion of the light converging fiber lens array 122 of the exposure optical system. The fixed clamping portion 163 is connected to the movable holding member 165 through a fulcrum portion 164, and is scissors-shaped. Numeral 166 is a compression spring attached to each handle portions of the fixed clamping portion 163 and the movable holding portion 165. When the handle portion is gripped against the compression spring 166, each clamping portion of the fixed clamping member 163 and the movable holding member 165 is opened. When the handle portion is not gripped, the clamping portion is closed by the compression spring 166, and clamps the tip portion of the light converging fiber lens array 122.

FIG. 20(*c*) is a plan view of an upper end clamping means which clamps the upper end portion of the exposure optical system 12(Y, M, C, K), and which can move. A U-shaped upper portion support 157A is integrally fixed with the upper portion of the support 157. The upper end portion clamping means, the shape of which is the same as the lower end portion clamping means, is provided near the tip of the upper portion of the upper support 157A. A parallel slot 157B is provided in the upper support 157A. A moving stand 171 can move in the X direction in the parallel slot 157B. At the lower portion of the moving stand 171, a holding member 172 is held such that the holding member 172 can move in the Y and Z directions with respect to the moving stand 171. The tip portion of the holding member 172 forms a fixed clamping portion 173 which clamps the upper portion of one end of the light converging fiber lens array 122 of the exposure optical system. The fixed clamping portion 173 is connected to a movable clamping member 175 through a fulcrum portion 174, and is scissors-shaped. Numeral 176 is a compression spring attached to both handle portions of the fixed clamping portion 173 and the movable clamping member 175. When the handle portion is gripped against the compression spring 176, both clamping portions of the fixed clamping member 173 and the movable clamping member 175 are opened. When the handle portion is not gripped, the clamping portion is closed by the compression spring 176, and the tip portion of the light converging fiber lens array 122 can be clamped.

Next, processes for adjusting the image exposure means using the optical system assembly apparatus, will be described.

(1) The reference hole 224 provided at the lower portion of the support member 220, is engaged with the reference pin 155A of the rotatable table 152, the rotational direction is determined by the positioning pin 155B, and the support member is located at a predetermined position on the rotatable table 152.

(2) A shaft portion 223 of the upper portion of the optical system supporting body 220 is engaged with a corresponding reference hole of the upper plate 158. Positioning pins 158A near both ends of the upper plate 158 are engaged with corresponding holes at upper portions of supports 156 and 157, and then, the upper plate is fixed by screws 158B.

(3) One exposure optical system, for example, the exposure optical system 12Y unit composed of the linear light emitting means 121Y and the light converging fiber lens array 122Y, is temporarily inserted into the cutout portion 225 of the optical system supporting body 220, and following that, the optical system supporting body 220 is rotated with the rotatable table 152, and stops at a predetermined rotational position. Then, the optical system supporting body is fixed by clamps 154. At this stopped position, the upper front surface of the light converging fiber lens array 122Y is opposed to the light beam detection means 60A.

(4) The upper portion of the exposure optical system 12Y is clamped between the fixed clamping portion 173 and the movable clamping portion 175 of the upper end clamping means. Further, the lower portion of the exposure optical system 12Y is clamped between the fixed clamping portion 163 and the movable clamping portion 165 of the lower end clamping means.

(5) In the linear light emitting means 121Y of the exposure optical system 12Y, specific pixels at both end portions are activated, and an image is formed on the light beam detection means 60A and 60B through the light converging fiber lens array 122Y.

(6) The upper end portion clamping means and the lower end portion clamping means are respectively moved slightly in the X, Y and Z directions. The position of the activated pixels and the condition of the image formation are detected by a detection circuit and a display means, and a predetermined position of the exposure optical system 12Y is set.

(7) An adhesive agent is injected into the gap between the cutout portion 225 of the optical system supporting body 220 and the exposure optical system 12Y, and the exposure optical system 12Y is firmly secured.

(8) In the same way as above, the optical system supporting body 220 is moved by a predetermined angle, and the exposure optical systems 12M, 12C, 12K are successively positioned and fixed on the optical system supporting body 220. After all exposure optical systems have been mounted on the optical system supporting body 220, the upper plate 158 is removed, and the adjusted exposure means, which is an integrally formed unit, is taken off from the rotatable table 152.

(EXAMPLE 5)

This example relates to the image forming apparatus having an internally enclosed exposure means, and specifically relates to an optical system assembly device in which one unit, integrally composed of a light beam detection means and exposure optical system adjusting tools, is rotated for adjusting the exposure optical systems.

Figure 21:
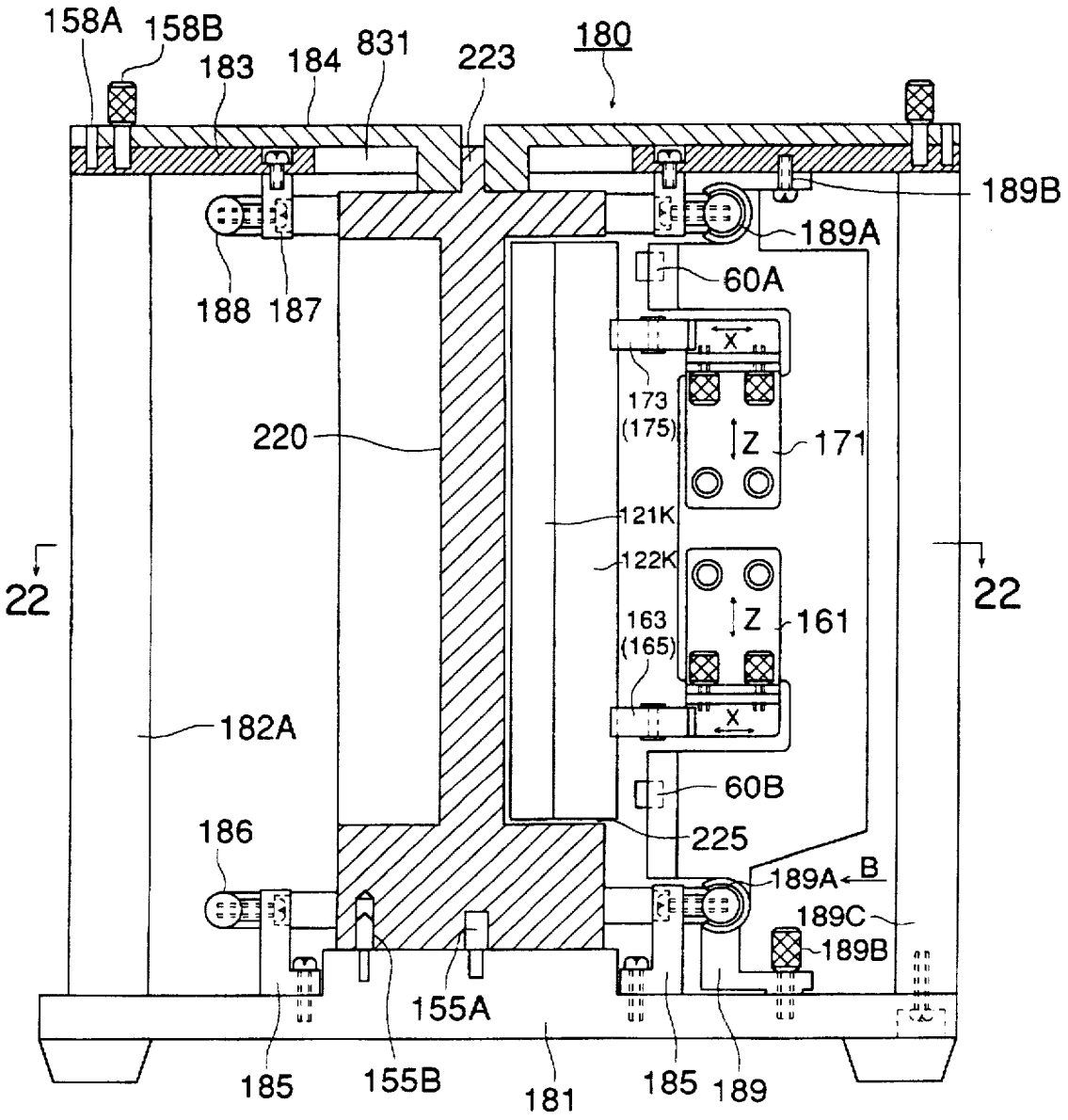
FIG. 21 is a frontal sectional view of the exposure optical system and the optical system assembling device in the example 5 of the present invention.
Figure 22:
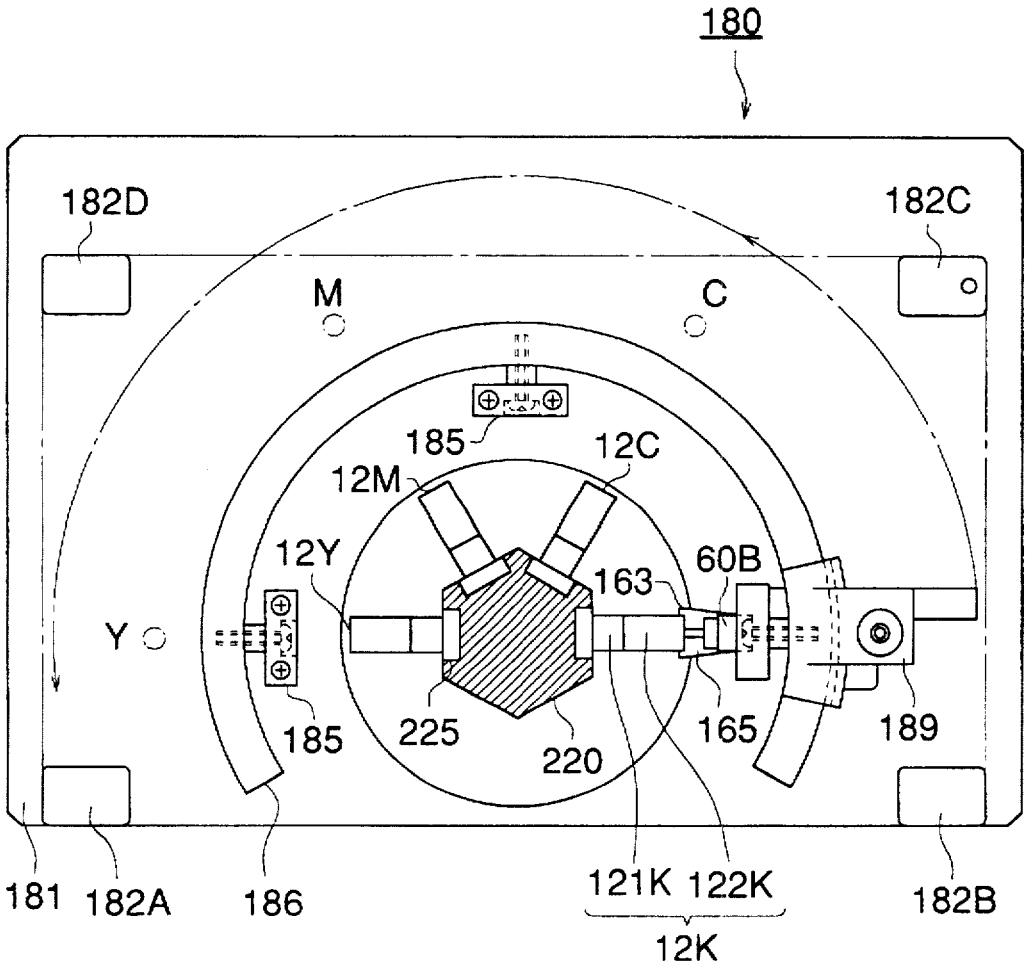
FIG. 22 is a view taken on line 22—22 in FIG. 21.
Figure 23:
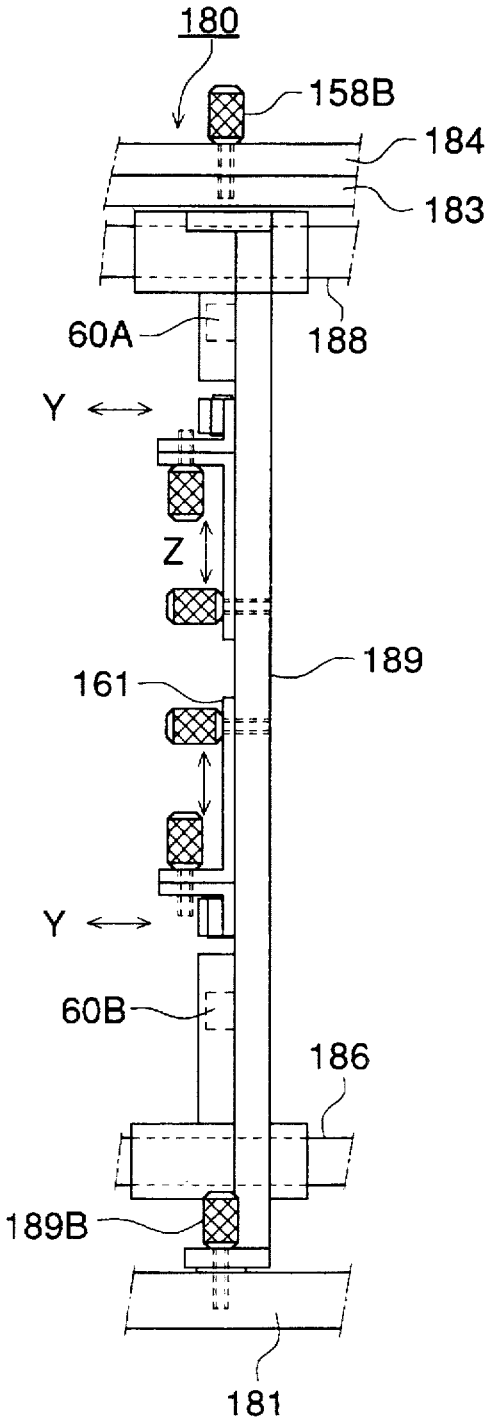
FIG. 23 is a view, viewed from the arrow B in FIG. 21.

FIG. 21 is a frontal sectional view of the exposure optical systems 12(Y, M, C, K) and the optical system assembly device. FIG. 22 is a view taken on line A—A in FIG. 21. FIG. 23 is a view, viewed from an arrow B in FIG. 21. In the drawings, parts having the same function as the above examples are denoted by the same numbers.

In the optical system supporting body 220, a plurality of cutouts 225 are provided in which a plurality of exposure units, integrally composed of the linear light emitting means 121 and the light converging fiber lens array 122, are loosely mounted.

A reference pin 155A protrudes from the center of the base plate 181 of the optical system assembly device 180, and a positioning pin 155B protrudes in the radial direction. When the optical system supporting body 220 is mounted on the base plate 181, the optical system supporting body 220 is engaged with the central hole and the hole in the radial direction, and the optical system supporting body 220 is positioned.

Four supports 182A, 182B, 182C, and 182D are vertically fixed in the vicinity of the left and right ends on the base plate 181. The upper base plate 183 is horizontally fixed on the upper surface side of supports 182A–182D. An opening 831, through which the optical system supporting body 220 can pass, is provided at the center of the upper base plate 183. A upper plate 184 is detachably attached onto the upper surface of the upper base plate 183. A reference hole is provided in the vicinity of the center of the upper plate 184, and is engaged with the upper shaft portion 223 of the optical system supporting body 220 mounted on the base plate 181. After the optical system supporting body 220 has been positioned by the reference hole and the shaft portion 223, the upper plate 184 is located at a predetermined position on the upper surface of the upper base plate 183 by the positioning pins 158A, and fixed by screws 158B.

Three rail supporters 185 are fixed in the vicinity of the periphery of the optical system supporting body mounting surface of the base plate 181, and support a cutout ring-shaped lower rail 186. Further, three rail supporters 187 are also fixed on the lower surface of the upper base plate 183, and support a cutout ring-shaped upper rail 188, the shape of which is the same as the lower rail 186.

Movable frames 189 which slide on the lower and upper rails 186 and 188 through bearings 189A, are held between the base plate 181 and the upper base plate 183 which are parallel to each other, and which can move. The light beam detection means 60A, 60B, and the upper end clamping means of the exposure optical systems and the lower end clamping means of the exposure optical systems, which are similar to those in Example 4, are vertically arranged and fixed onto the movable frames 189.

That is, the light beam detection means 60A and 60B are vertically arranged on the side on which the movable frame 189 is opposed to both ends of the linear light emitting means 121. The light beam detection means 60A and 60B are composed of, for example, two-dimensional CCD sensors, and are previously set at an image formation position by the exposure optical systems 12(Y, M, C, K) when the reference image forming body 10 is used, that is, at the image formation reference position on the outer peripheral surface of the reference image forming body 10. The position and focus of the linear light emitting means 121 are adjusted by the detection of the light beam detection means 60A and 60B under the condition that the specific pixels of both ends of the linear light emitting means 121 are activated. The light beam detection means 60A and 60B are connected to the detection circuit and the display means shown in FIG. 7, and the output is displayed on the CRT.

The lower end portion clamping means clamps the lower end portion of the light converging fiber lens array 122 of the image exposure optical systems 12(Y, M, C, K) and can move in the directions of X, Y and Z, which are structured in almost the same way as members 161 to 166. The upper end portion clamping means also clamps the upper end portion of the light converging fiber lens array 122 of the exposure optical systems 12(Y, M, C, K) and can also move in the directions of X, Y and Z axes, which are structured in almost the same way as members 171 to 176.

Next, processes for adjusting the image exposure means using the optical system assembly device will be described.

(1) The optical system supporting body 220 is inserted into the opening 831 of the upper base plate 183, and one hole at the rotational center is engaged with the reference pin 155A and the corresponding positioning pin 155B of the base plate 181, and is placed on the base plate 181.

(2) The reference hole of the upper plate 184 is engaged with the shaft portion 223 of the optical system supporting body 220, and further, the positioning pins 158A in the vicinity of both end portions of the upper plate 184 are engaged with corresponding holes on the upper base plate 183, and then, the upper base plate is fixed by screws 158B.

(3) One exposure optical system, for example, the exposure optical system 12Y unit composed of the linear light emitting means 121Y and the light converging fiber lens array 122Y, is temporarily inserted into the cutout portion 225 of the optical system supporting body 220, and following that, the movable frame 189 is rotated along the circular rails 186 and 188, and stops at a predetermined rotational position. Then, the exposure optical system is fixed by screws 189B. This stop position may be determined by aligning markings on the adjustment portions, or may be fixed by the positioning pins. At this stop position, the upper front surface of the light converging fiber lens array 122Y is opposed to the light beam detection means 60A.

(4) The upper portion of the exposure optical system 12Y is clamped between the fixed clamping portion 173 and the movable clamping portion 175 of the upper end clamping means. Further, the lower portion of the exposure optical system 12Y is clamped between the fixed clamping portion 163 and the movable clamping portion 165 of the lower end clamping means.

(5) In the linear light emitting means 121Y of the exposure optical system 12Y, specific pixels at both end portions are activated, and an image is formed on the light beam detection means 60A and 60B through the light converging fiber lens array 122Y.

(6) The upper end portion clamping means and the lower end portion clamping means are respectively moved slightly in the X, Y and Z directions. The position of the activated pixels and the condition of the image formation are detected by a detection circuit and a display means, and a predetermined position of the exposure optical system 12Y is set.

(7) An adhesive agent is injected into the gap between the cutout portion 225 of the optical system supporting body 220 and the exposure optical system 12Y, and the exposure optical system 12Y is firmly fixed.

(8) Movable clamping members 165 and 175 of the upper end clamping means and the lower end clamping means are opened and withdrawn, and screws 189B or the positioning pin is removed. The moving frame 189 is moved by a predetermined angle, and fixed. The position of the exposure optical system 12M is adjusted on the optical system supporting body 220, which is fixed at a predetermined position, in the same way as described above, and the exposure optical system 12M is fixed by the adhesive agent. In the same way, positions of the exposure optical systems 12C and 12K are successively adjusted with respect to the optical system supporting body 220, and the exposure optical systems are fixed.

(9) After all exposure optical systems have been attached to the optical system supporting body 220, the upper plate 184 is removed and the image exposure means, which is formed into a unit, is taken from the base plate 181.

(EXAMPLE 6)

This example relates to the image forming apparatus having an internally enclosed exposure means, and specifically relates to an optical system assembly device in which a plurality of units, integrally composed of the light beam detection means and the exposure optical system adjusting tools, are fixed for adjusting the exposure optical systems.

Figure 24:
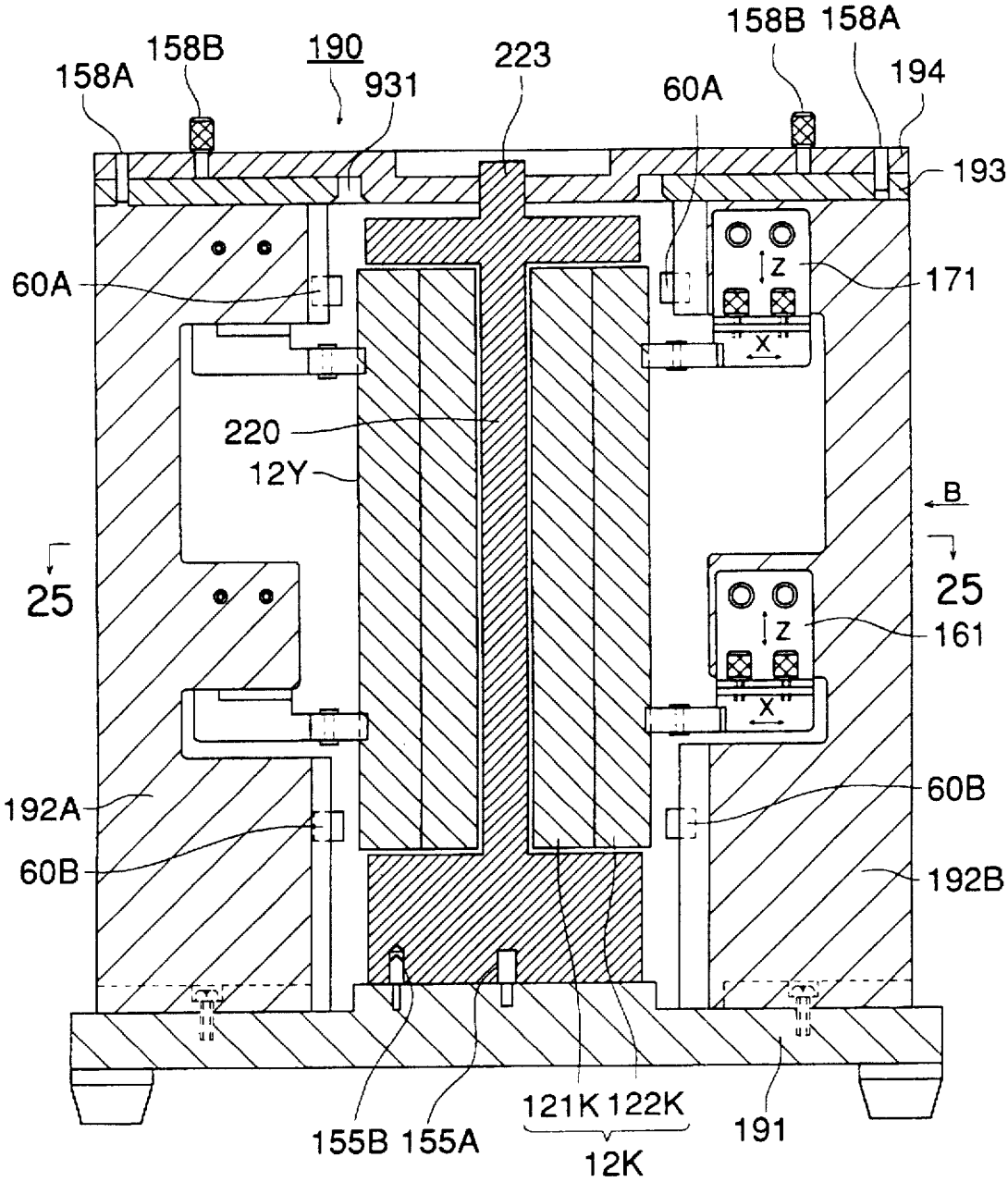
FIG. 24 is a frontal sectional view of the exposure optical system and the optical system assembling device in the example 6 of the present invention.
Figure 25:
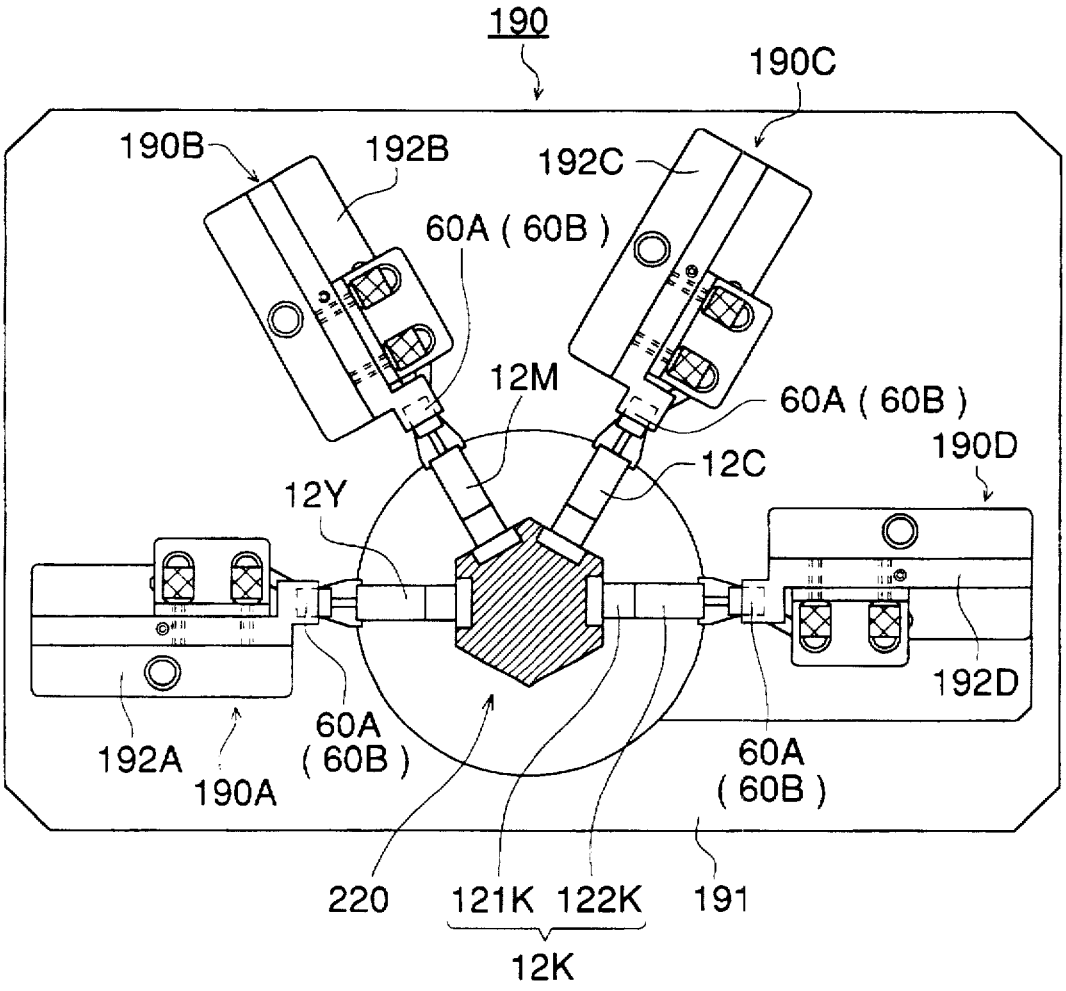
FIG. 25 is a view taken on line 25—25 in FIG. 24.
Figure 26:
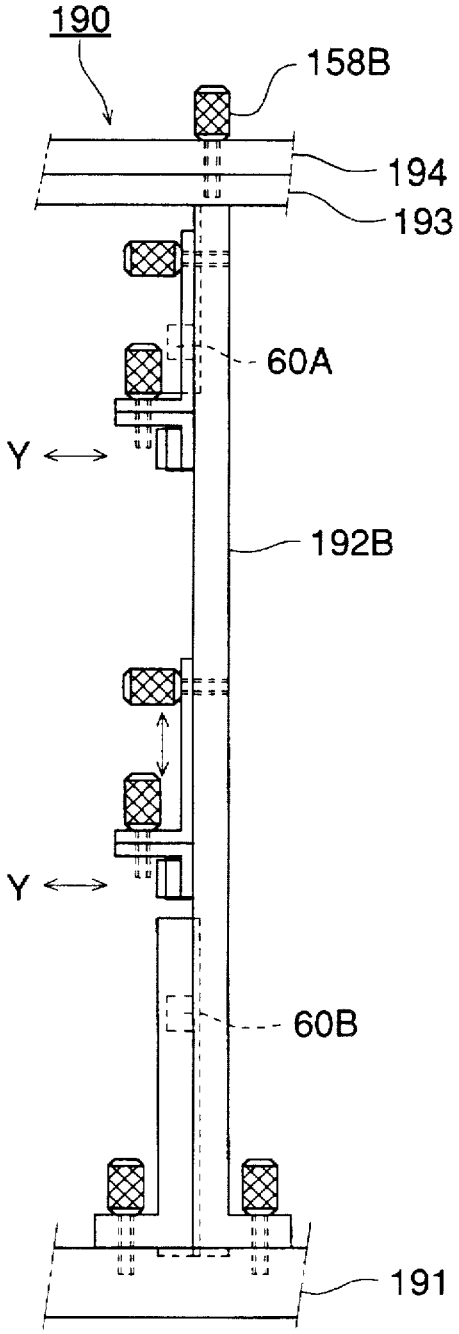
FIG. 26 is a view, viewed from the arrow B in FIG. 24.

FIG. 24 is a frontal sectional view of the exposure optical systems 12(Y, M, C, K) and the optical system assembly device. FIG. 25 is a view taken on line A—A in FIG. 24. FIG. 26 is a view, viewed from an arrow B in FIG. 24. In the drawings, parts having the same function as the above examples are denoted by the same numbers.

A reference pin 155A protrudes from the center of the base plate 191 of the optical system assembly device 190, and a positioning pin 155B protrudes in the radial direction. When the optical system supporting body 220 is mounted on the base plate 191, the reference pin 155A and the positioning pin 155B are respectively engaged with the central hole and the radial positioning hole, of the optical system supporting body 220, and the optical system supporting body 220 is positioned.

Four supports 192A, 192B, 192C, and 192D are vertically fixed in the vicinity of the left and right ends on the base plate 181. The upper base plate 193 is horizontally fixed on the upper surface of supports 192A–192D. An opening 931, through which the optical system supporting body 220 can pass, is provided at the center of the upper base plate 193. An upper plate 194 is detachably attached onto the upper surface of the upper base plate 193. A reference hole is provided in the vicinity of the center of the upper plate 194, and is engaged with the upper shaft portion 223 of the optical system supporting body 220 mounted on the base plate 191. After the optical system supporting body 220 has been positioned by the reference hole and the shaft portion 223, the upper plate 194 is located at a predetermined position on the upper surface of the upper base plate 193 by the positioning pins 158A, and fixed in place by screws 158B.

Light beam detection means 60A, 60B, the clamping means for the upper end of the exposure optical system, and the clamping means for the lower end of the exposure optical system, which are almost similar to those in Example 4, are vertically arranged and fixed on supports 192A–192D.

That is, the light beam detection means 60A and 60B are vertically arranged on the side on which the support 192A is opposed to both ends of the linear light emitting means 121Y. The light beam detection means 60A and 60B are composed of, for example, two-dimensional CCD sensors, and are previously set at an image formation position by the exposure optical system 12Y, when the reference image forming body 10 is used, that is, at the image formation reference position on the outer peripheral surface of the reference image forming body 10. The position and focus of the linear light emitting means 121Y are adjusted by the detection of the light beam detection means 60A and 60B under the condition that the specific pixels of both ends of the linear light emitting means 121Y are activated. The light beam detection means 60A and 60B are connected to the detection circuit and the display means shown in FIG. 7, and the output is displayed on a CRT.

The lower end portion clamping means clamps the lower end portion of the light converging fiber lens array 122Y of the image exposure optical system 12Y and can move in the X, Y and Z axes, which are structured in almost the same way as members 161 to 166. The upper end portion clamping means also clamps the upper end portion of the light converging fiber lens array 122 of the exposure optical systems 12Y and can also move in the X, Y and Z axes, which are structured in almost the same way as members 171 to 176. Four units, composed of light beam detection means 60A, 60B, and the exposure optical system adjusting tools 190A, 190B, 190C and 190D, are thus arranged.

Next, processes for adjusting the image exposure means using the optical system assembly device will be described.

(1) The optical system supporting body 220, into which the exposure optical systems 12Y, 12M, 12C and 12K are temporarily inserted, is inserted into the opening 931 of the upper base plate 193, and the corresponding holes at the rotational center are engaged with the reference pin 155A and the positioning pin 155B of the base plate 191, and the optical system supporting body 220 is placed on the base plate 191.

(2) The reference hole of the upper plate 194 is engaged with the shaft portion 223 of the optical system supporting body 220, and further, the positioning pins 158A in the vicinity of both end portions of the upper plate 184 are engaged with respective holes on the upper base plate 193, and then, the upper base plate is fixed by screws 158B.

(3) The exposure optical system 12Y is opposite to the light beam detection means 60A, 60B of the optical system adjusting tools 190A and the exposure optical system clamping member. Simultaneously, the exposure optical system 12M is opposite to the other light beam detection means 60A, 60B of the optical system adjusting tools 190B, and the exposure optical system clamping member. In the same way, other optical systems 12C and 12K are also opposite to the light beam detection means 60A, 60B of the optical system adjusting tools 190C and 190D, and the exposure optical system clamping member.

(4) The exposure optical system 12Y is moved in the X, Y, Z axes by the optical system adjusting tools 190A, and the exposure optical system 12Y is fixed by adhesive agent after its position has been adjusted while output of the light beam detection means 60A and 60B is being observed. In the same manner, the exposure optical systems 12M, 12C and 12K are fixed by an adhesive agent after these optical systems have also been adjusted.

(5) After all exposure optical systems have been attached to the optical system supporting body 220, the upper plate 194 is removed and the adjusted image exposure means, which is formed into an integral unit, is taken from the base plate 191.

(6) As shown in FIG. 13, the unit composed of thus adjusted and assembled optical system supporting body 220, and the exposure optical systems 12(Y, M, C, K) is positioned and fixed by fixing screws 26 when a guide pin 24 which is fixed on the cover member 25, is engaged with the reference hole 224 provided at the end of the optical system supporting body 220. (7) The optical system supporting body having the exposure optical systems 12(Y, M, C, K) integrated with the cover member 25, is held and inserted into the interior of the photoreceptor drum 10 which is supported by the base plate 21 of the image forming apparatus main body and one wall of the cartridge 30. A shaft portion 223 of the optical system supporting body 220 is engaged with the reference hole 30B of the cartridge 30, and the cover member 25 is engaged with the outer race of a ball bearing 22 for positioning, and fixed by fixing screws 26. In such a way, the exposure optical systems 12(Y, M, C, K) is securely and easily supported inside the photoreceptor drum 10 with high accuracy.

According to the present invention, in an image forming apparatus having an optical system enclosed exposure means, the accuracy of the mounting position of the exposure optical system having a linear light emitting means to the optical system supporting body, is improved. Further, the mounting adjustment operation time is reduced, and ease of operation is attained.

Next, the present invention having an internally enclosed image exposure means will be explained referring to FIGS. 27 to 38(*b*), in which the example of the present invention is included.

Figure 27:
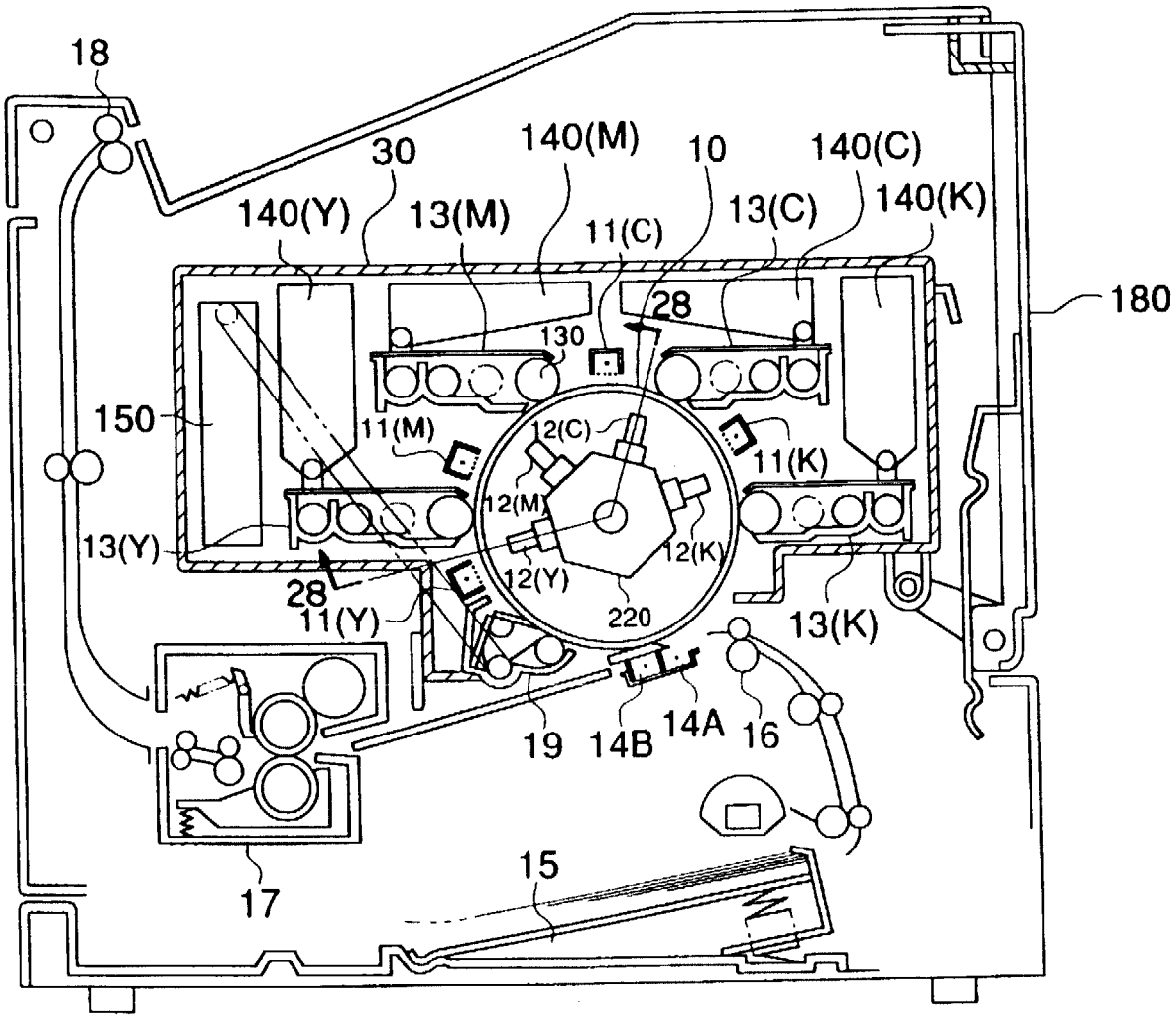
FIG. 27 is a structural view of the main portion of the image forming apparatus in an example to which the exposure device of the present invention is applied.
Figure 28:
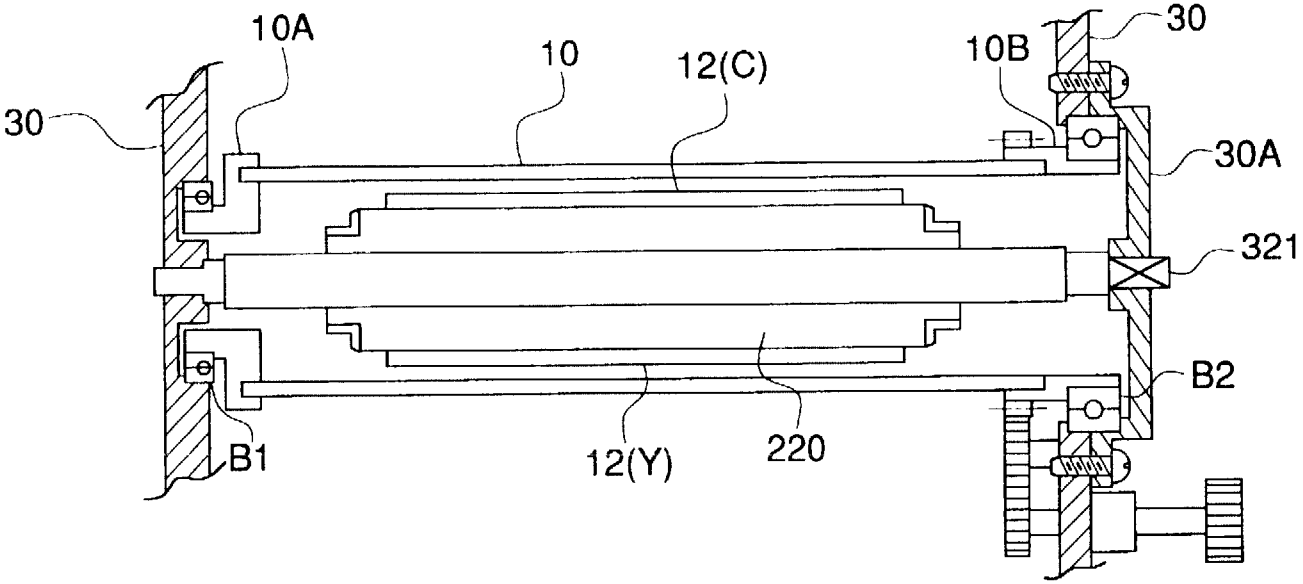
FIG. 28 is a sectional view taken on line 28—28 in FIG. 27 of the exposure device of the image forming apparatus in an example (example 7) to which the exposure device of the present invention is applied.

FIGS. 27 and 28 are views showing the structure of main portions of an image forming apparatus of an example (Example 7) to which the exposure device of the present invention is applied.

The above-described exposure optical systems 12(Y, M, C, K) are attached to column-shaped support members 220, which are common to each example, in such a manner that a line head is in parallel with the drum axis. The exposure optical systems 12(Y), 12(M), 12(C), 12(K) are arranged with same interval, and accommodated inside the base body of the photoreceptor drum 10. The line head of the exposure optical system 12 may be composed of a combination of optical shutter members such as LCS, LISA, PLZT, or the like, and an image formation lens such as SELFOC lens, or the like, other than the above-described light emitting elements.

Next, processes of a color image forming apparatus in the present device will be explained below, concerning mainly the points which differ from the above-described examples 4 to 6.

The photoreceptor drum 10 is accommodated in the process. cartridge 30 together with chargers 11(Y, M, C, K), developing units 13(Y, M, C, K), the cleaning unit 19, toner containers 140(Y, M, C, K) for supplying toner to developing units 13(Y, M, C, K), and the waste toner container 150 for accommodating the toner collected from the cleaning unit 19. The cartridge 30 is drawn horizontally from the apparatus main body, and can further be taken out outside the apparatus.

FIG. 28 shows a section AA, in which a flange member 10A of the front end portion of the photoreceptor drum 10 is directly supported by the wall surface of the process cartridge 30 through a bearing B1, and a flange member 10B of the rear end portion of the photoreceptor drum 10 is supported through a bearing B2 which is held being sandwiched between the process cartridge 30 and a disk member 30A which is detachably attached to the cartridge 30.

The exposure optical systems 12(Y, M, C, K) is held in such a manner that the front end portion of the shaft member 321, which penetrates the support member 220 and on which the support member is fixed, is supported by the wall surface of the cartridge 30, and the rear end portion is engaged with the disk member 30A and the rotation is thus restricted.

Accordingly, when the disk member 30A is removed, the photoreceptor drum 10 and the exposure optical systems 12(Y, M, C, K) can be easily taken out from the rear of the process cartridge 30.

The process cartridge 30 is temporarily moved by inclining it upward, and then drawn from the position, when a side cover 180, which forms the side surface member of the apparatus main body, is opened. By this operation, the cartridge 30 is horizontally moved toward the outside of the apparatus main body.

Figure 29:
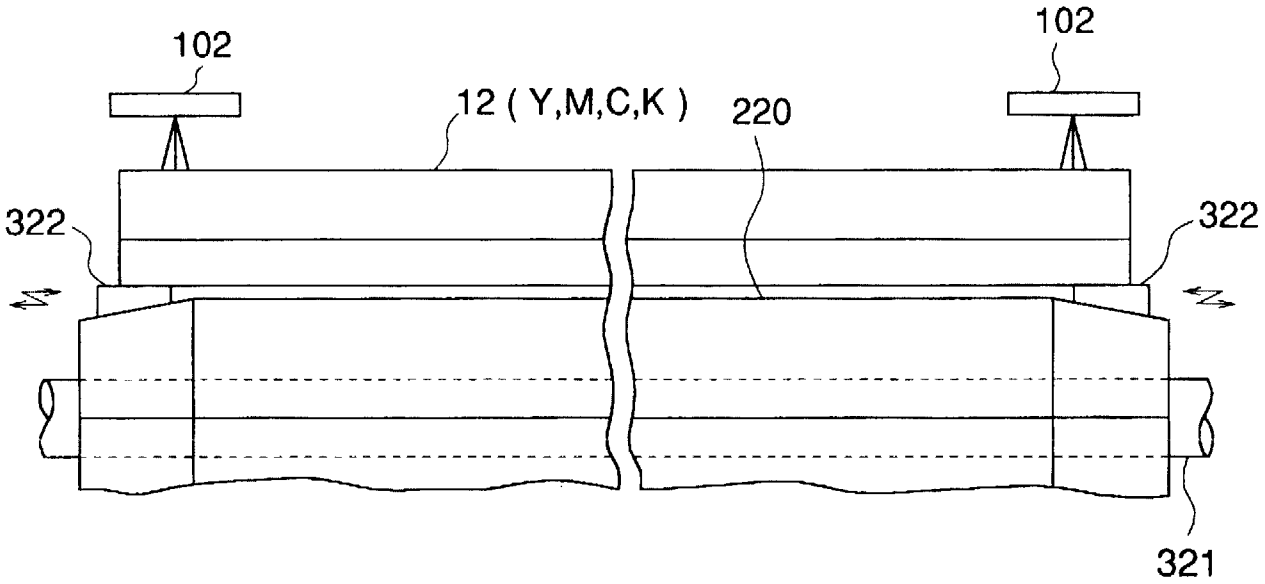
FIG. 29 is a side view of the above-described exposure device of the present invention.
Figure 30:
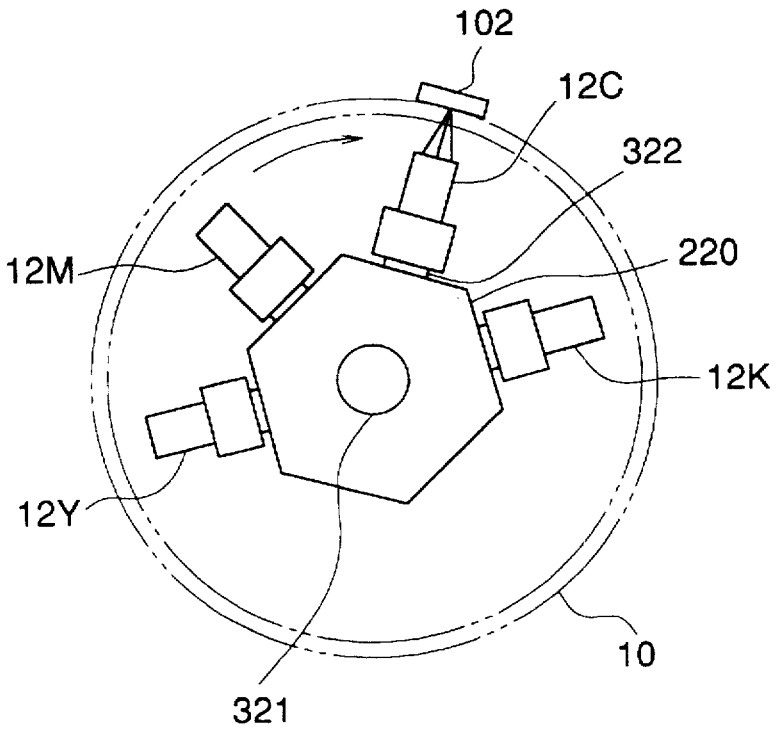
FIG. 30 is a front view of the exposure device of the present invention.
Figure 31:
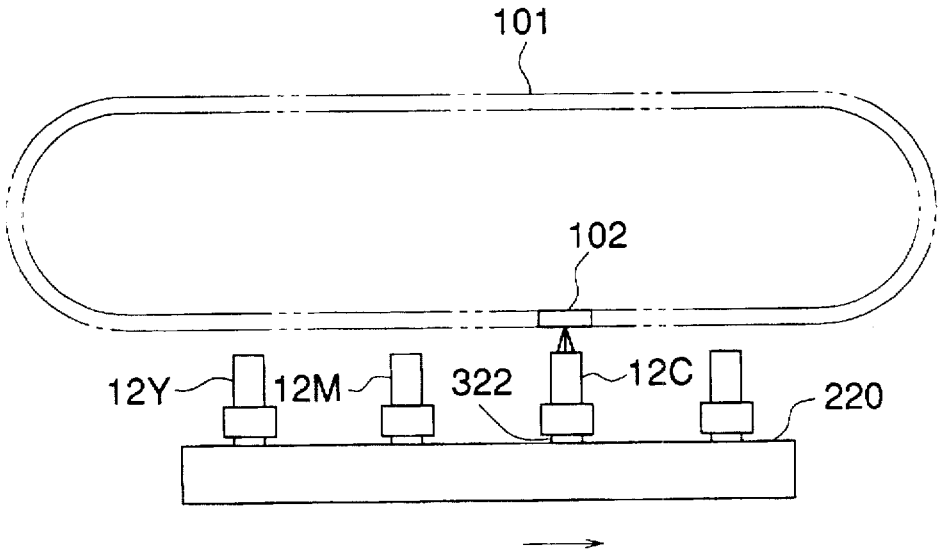
FIG. 31 is a front view of the exposure device of the present invention.

FIGS. 29, 30 and 31 are views to explain the exposure device. FIG. 29 is a side view of the exposure device when the exposure optical system and the support member, which is a supporting body for the exposure optical system, are mounted, in the case where the photoreceptor drum is used as the photoreceptor. FIG. 30 is a front view of the exposure device, and FIG. 31 is a front view of the exposure device when a photoreceptor belt is used as the photoreceptor.

In FIGS. 29 and 30, the exposure device of this example is structured as follows. As described above, the exposure optical system 12, the line head of which is composed of the light emitting elements such as a plurality of LEDs arranged on a substrate in the direction of the axis of the photoreceptor drum 10 and a SELFOC lens, is attached to the support member 220. That is, the exposure device is structured such that a plurality of the exposure optical systems, in this example, four exposure optical systems 12(Y, M, C, K) corresponding to Y, M, C, K color signals, are attached to the support member 220.

As shown in the drawing, inclination is provided on both ends of the support member 220 onto which the exposure optical systems 12(Y, M, C, K) are attached. As shown in the drawing, an wedge-shaped insert member 322 made of, for example, glass or acryl, which has penetrability in the ultraviolet ray wavelength area, can be inserted between both ends of the exposure optical systems 12(Y, M, C, K) and both corresponding ends of the support member 220.

In the drawing, composition of the main portion, under the condition that the thus composed exposure device is attached to the assembly tool, is also shown. That is, image detection elements 102 such as CCDs, which can detect an image formed by the exposure optical systems 12(Y, M, C, K), is arranged on the image formation surface on the light emission side of both ends of the exposure optical systems 12(Y, M, C, K) in this assembly tool as shown in the drawing. The support member 220 is slipped onto a shaft member 321 of the assembly tool and attached to the assembly tool. At this time, the image detection element 102 with respect to the shaft member 321 is accurately positioned and attached previously at a position corresponding to the image formation surface of the photoreceptor drum 10 to be installed in the image forming apparatus. Accordingly, the image detection element 102 is also accurately positioned with respect to the support member 220 of the exposure device when it is attached to the assembly tool. In this connection, an electrostatic latent image is formed on the image formation surface of the photoreceptor drum 10 at this time. Accordingly, since the surface on which the toner image is formed, is the outer surface of the photoreceptor drum 10, the detection surface of the image detection element 102 is also caused to correspond to the outer side surface of the photoreceptor drum 10. In this connection, the photoreceptor drum 10, shown in the drawing, is not attached to the assembly tool when positioning is actually being carried out.

In the above-described status, when the support member is moved on the stage, not shown in the drawing, while the exposure optical systems 12(Y, M, C, K) is being held, the image signal detected by the image detection element 102 is amplified for confirmation on a CRT monitor, not shown in the drawings, and the exposure optical systems 12(Y, M, C, K) can be accurately positioned with respect to the support member 220. As described above, when the exposure optical systems 12(Y, M, C, K) have been positioned with respect to the support member 220, left and right insert members 322 are inserted between the exposure optical systems 12(Y, M, C, K) and the support member 220, and the insert member 322 and exposure optical systems 12( Y, M, C, K) are adhered by instantaneous adhesive agents, and the insert member 322 and support member 220 are also adhered by instantaneous adhesive agents. After that, ultraviolet hardening resin is poured between the insert member 222 and the exposure optical systems 12(Y, M, C, K), and between the insert member 322 and the support member 220. Then, the poured resin is hardened by irradiation by ultraviolet rays, and the exposure optical system 12(Y, M, C, K) and the support member 220 are adhered to each other.

As described above, when both the insert member having the ultraviolet ray penetrability and the ultraviolet ray hardening resin are used, the front surface and the rear surface of the ultraviolet ray hardening resin can be directly irradiated with the ultraviolet ray, and therby, the effect of the adhesion can be greatly enhanced. Accordingly, the operation time is reduced, and reliability of the optical system can also be enhanced.

When one exposure optical system, for example, 12Y and the support member 220 are adhered to each other, the support member 220 is rotated, for example, in the arrowed direction using the shaft portion 321 as the rotational axis as shown in FIG. 30, and the next exposure optical system 12M is positioned in front of the image detection element 102. In the same way as described above, the exposure optical system 12M and the support member 220 are adhered to each other. In the same way, the remaining exposure optical systems 12C and 12K and the support member 220 are adhered to each other.

The exposure device on which adhesion has been completed, is removed from the assembly tool and is assembled into the image forming apparatus. Since the position of the support member 220 attached to the shaft member 321, is accurately positioned with respect to the image formation surface of the photoreceptor drum 10, and the exposure optical systems 12(Y, M, C, K) are adhered to the supporting body, the position is very accurately maintained when the exposure optical systems are mounted in the image forming apparatus.

As described above, in the present invention, when the exposure optical systems 12(Y, M, C, K) are held and moved in a stage, not shown in the drawings, and are accurately positioned, a wedge-shaped insert member 322, having the penetrability in the ultraviolet ray wavelength area, is inserted between the exposure optical systems 12(Y, M, C, K) and the support member 220, and is adhered by an instantaneous adhesive agent, and this position is thereby temporarily fixed. After that, ultraviolet ray hardening resin having good fluidity is poured between the exposure optical systems 12(Y, M, C, K) and the support member 220 so that the gaps between them are filled. Then, the ultraviolet ray is irradiated and the resin is hardened. The exposure optical systems 12(Y, M, C, K) and the support member 220, including the insert member 322, are directly adhered, so that the temporarily adhered condition by the instantaneous adhesive agent is changed to be permanent. Accordingly, the accurate positional relationship between the exposure optical systems 12(Y, M, C, K) and the support member 220 is easily maintained to be permanent.

The adhesion using ultraviolet ray hardening resin may be carried out each time when the adhesion by the instantaneous adhesive agent of one or a plurality of exposure optical systems 12(Y, M, C, K) and the support member 220 has been completed, or after adhesion by the instantaneous adhesive agent of all components has been completed.

FIG. 31 shows the structure when a photoreceptor belt is used as the photoreceptor and the exposure device exposes from the outside of the photoreceptor belt 101. Accordingly, since the outer surface of the photoreceptor belt 101 is the surface for electrostatic latent image formation by the exposure optical systems 12(Y, M, C, K), and also the surface for toner image formation, the detection surface of the image detection element 102 corresponds to the outer surface of the photoreceptor belt 101. In the same way as described above, the exposure optical systems 12(Y, M, C, K) are positioned in the stage, not shown in the drawing, and the insert members 322 are used successively or collectively. Then, the exposure optical systems 12(Y, M, C, K) and the support member 220 are adhered to each other by the instantaneous adhesive agent and the ultraviolet ray hardening resin, after the support member 220 is moved, for example, in the arrowed direction. Here, the detailed explanation is omitted because of overlapping. In this connection, the photoreceptor belt 101 is not attached to the assembly tool when the exposure optical system is actually positioned. Also in the case of an exposure device which exposes from the inside of the photoreceptor belt 101, it is of course obvious that the exposure device can be assembled in entirely the same way as described above.

FIGS. 29, 30 and 31 are also illustrations of the assembly method for the exposure device. Also, in the exposure device assembly method, the explanation for the exposure device in FIGS. 29, 30 and 31 can be entirely applied onto the exposure device assembly method. Accordingly, the detailed explanation is omitted because of overlapping information.

FIGS. 32(*a*), 32(*b*), 33(*a*) and 33(*b*) are illustrations to explain the exposure device assembly method according to the fifth embodiment. FIGS. 32(*a*) and 32(*b*) are front views respectively before and after the exposure optical system and the support member, which is a supporting body for the exposure optical system, are attached, when a photoreceptor drum is used as the photoreceptor. FIG. 32(*a*) is a view prior to the exposure optical system and the support member being attached, and FIG. 32(*b*) is a view after they have been attached. FIGS. 33(*a*) and 33(*b*) are front views respectively before and after the exposure optical system and the support member are attached, when a photoreceptor belt is used as the photoreceptor. FIG. 33(*a*) is a view before the exposure optical system and the support member are adhered, and FIG. 33(*b*) is a view after they have been adhered.

In FIGS. 32(*a*), 32(*b*), 33(*a*) and 33(*b*), the exposure optical systems 12(Y, M, C, K) of the exposure device, and the image detection element 102 have the same functions and structure as the exposure optical systems 12(Y, M, C, K) and the image detection element 102 which are described in FIGS. 29 and 30. Finally, as shown in FIGS. 32(*b*) and 33(*b*), they are structured and attached so that the positional accuracy of the exposure optical systems 12(Y, M, C, K) attached to the support member 220 which is engaged with the shaft member 321, and the photoreceptor drum 10 or photoreceptor belt 101, or the relative positional accuracy among exposure optical systems 12(Y, M, C, K) is a predetermined positional accuracy.

FIGS. 32(*a*), 32(*b*), 33(*a*) and 33(*b*) show also the structure of the main portion when the thus structured exposure device is attached to the assembly tool. That is, in the assembly tool, one of the image detection elements 102 such as CCDs which can detect the formed image by the exposure optical systems 12(Y, M, C, K), is respectively attached to one end in the longitudinal direction of the exposure optical systems 12(Y, M, C, K), that is, a total of two detection elements are attached onto the image formation surfaces of the light beam emission side of both ends of the exposure optical systems 12(Y, M, C, K) in the longitudinal direction, in the same way as shown in FIG. 30. Further, each image detection element 102 is accurately positioned and attached previously at corresponding positions of the exposure optical systems 12(Y, M, C, K), that is, the detection element is positioned and attached so that the position where it is to be attached is in a predetermined positional relationship with the shaft member 321 of the photoreceptor drum 10 or the photoreceptor belt 101. In this connection, the photoreceptor drum 10 or the photoreceptor belt 101 is not attached to the assembly tool when actually being positioned.

An image signal detected by the image detection element 102 corresponding to the exposure optical systems 12(Y, M, C, K) is enlarged and confirmed on a monitor, not shown in the drawing, and the position is adjusted. Then, the position of the exposure optical systems 12(Y, M, C, K) is temporarily fixed at the optimum position by a means, not shown in the drawing. By performing the above operations, the positions of the total of four exposure optical systems 12(Y, M, C, K) are successively adjusted, and temporarily fixed at their optimum positions. As a temporarily fixing means, for example, the following means may be adopted. A plate, onto which a plurality of sharp-pointed screws for temporarily fixing are attached, is provided on each one surface of the position corresponding to the exposure optical systems 12(Y, M, C, K) on the front and the rear sides of the front view, and the image signal is enlarged and confirmed on the monitor as described above, and the position is adjusted. After that, the exposure optical systems 12(Y, M, C, K) are temporarily fixed at their optimum positions by the plurality of screws. The reason for the exposure optical systems 12(Y, M, C, K) being fixed by the plurality of sharp-pointed screws is to prevent the fixed exposure optical systems 12(Y, M, C, K) from rotating around the tips of the sharp-pointed screws, and their attitudes changing.

Due to the above operations, the positional accuracy of the exposure optical systems 12(Y, M, C, K) onto the image detection element 102, the positional accuracy of the exposure optical systems 12(Y, M, C, K) onto the photoreceptor drum 10 or photoreceptor belt 101, and the relative positional accuracy among exposure optical systems 12(Y, M, C, K), that is, a predetermined positional relationship with respect to the shaft member 321 of the photoreceptor drum 10 or the photoreceptor belt 101, are inevitably accurately positioned.

Next, the support member 220 is engaged with the shaft member 321 of the assembly tool as shown in FIGS. 32(*b*) and 33(*b*), and the exposure optical systems 12(Y, M, C, K) and the support member 220 are adhered by the adhesive agent. After the completion of adhesion, when the sharp-pointed screws are loosened, the support member 220 onto which the four exposure optical systems 12(Y, M, C, K) of the exposure device are adhered, can be detached from the shaft member 321. The exposure device detached from the assembly tool is then mounted in the image forming apparatus. Since the support member 220 attached to the shaft member 321 and the position corresponding to the image formation surface of the photoreceptor drum 10 or the photoreceptor belt 101 are accurately positioned as described above, and the exposure optical systems 12(Y, M, C, K) are adhered, the position of this system is accurately maintained naturally even when these are mounted in the image forming apparatus.

As described above, when the exposure optical systems 12(Y, M, C, K) are adhered onto the support member 220 of the exposure optical systems 12(Y, M, C, K) after the positional accuracy of the exposure optical systems 12(Y, M, C, K) to the photoreceptor drum 10 or the photoreceptor belt 101, and the relative positional accuracy among the exposure optical systems 12(Y, M, C, K) have been previously accurately adjusted, then, the exposure device can be accurately assembled and adjusted.

Figure 35:
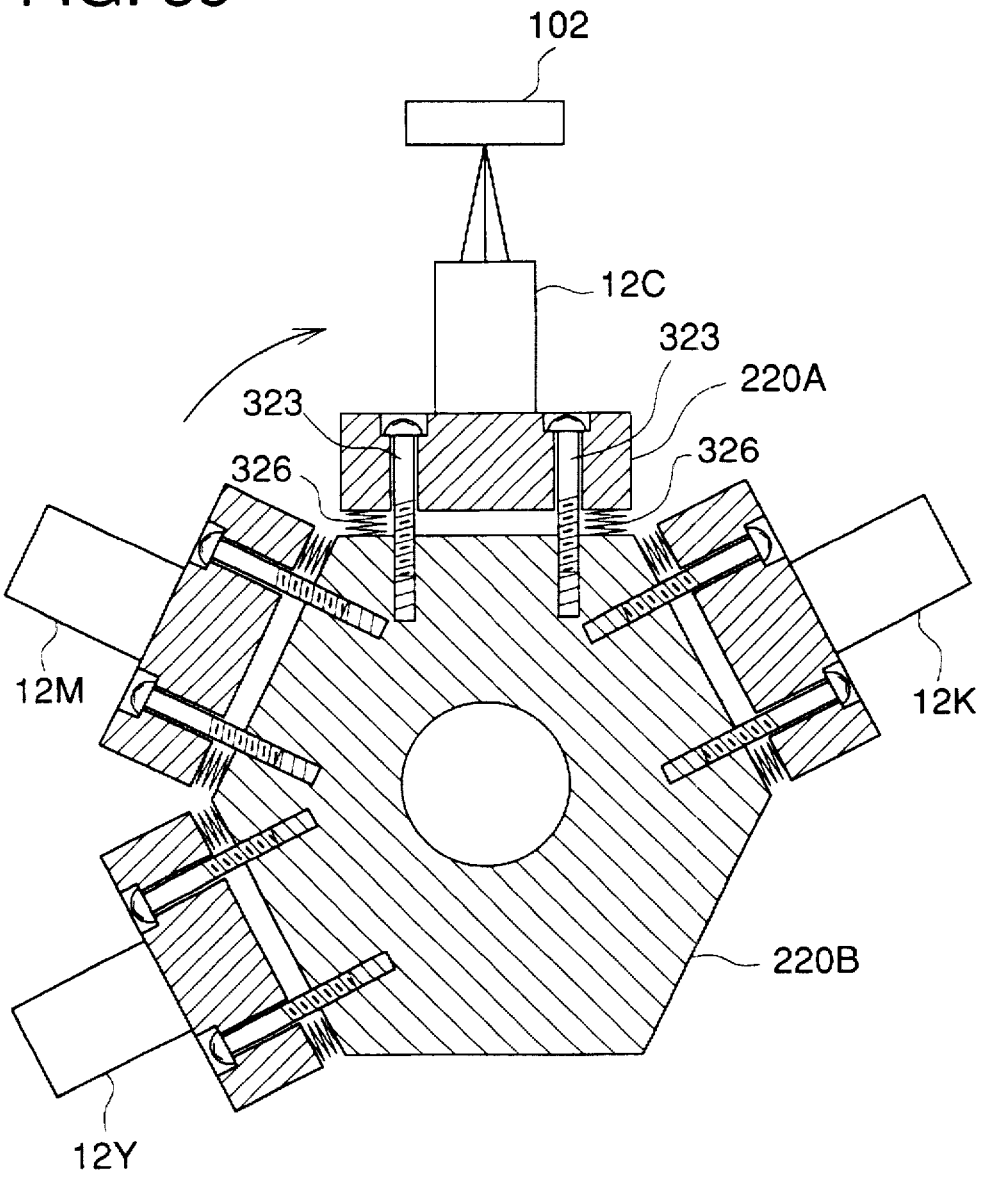
FIG. 35 is a view for explaining the exposure device assembling method of the present invention, and shows a sectional view of a fine adjustment mechanism of a photoreceptor drum.
Figure 36:
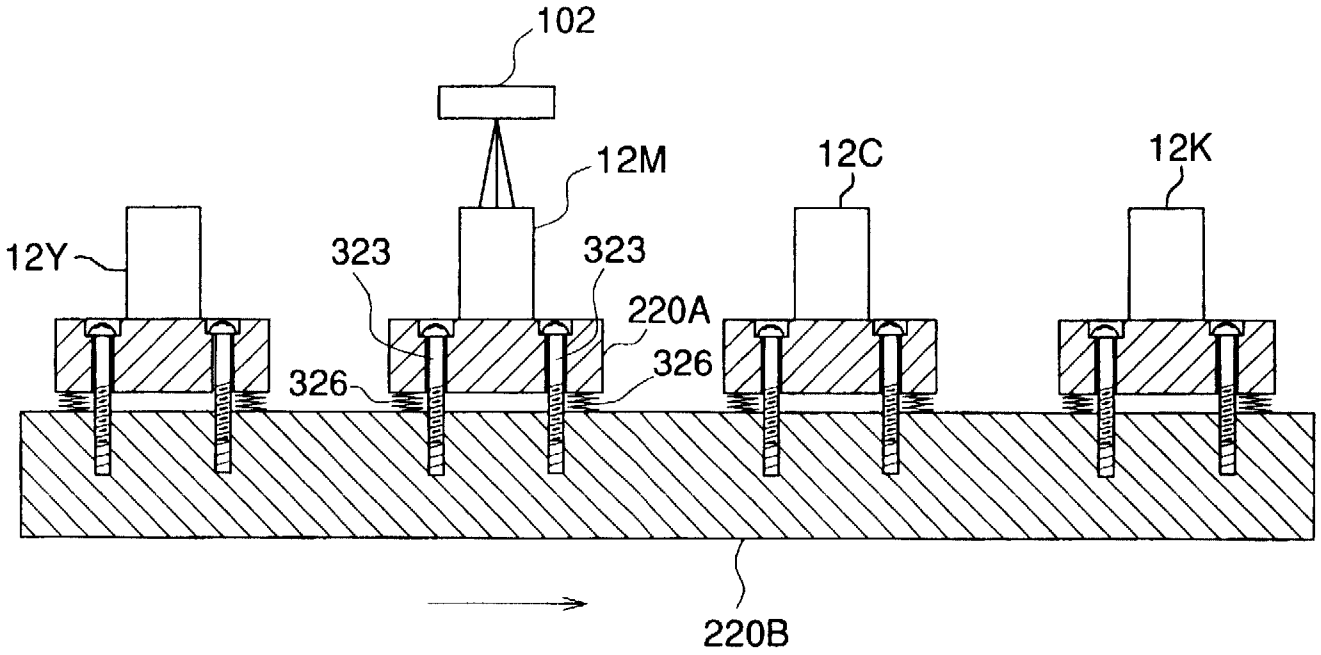
FIG. 36 is a view for explaining the exposure device assembling method of the present invention, and shows a sectional view of a fine adjustment mechanism of a photoreceptor belt.

FIGS. 34(*a*), 34(*b*), 35, 36, 37(*a*) to 37(*c*), are views to explain the exposure device assembly method according to the sixth and the seventh embodiments. FIGS. 34(*a*) and 34(*b*) are views of a fine adjustment mechanism provided on the support member which is a supporting body of the exposure optical systems. FIG. 34(*a*) is a plan view and FIG. 34(*b*) is a sectional view, viewed from a line X—X. FIG. 35 is a sectional view of the surface, parallel to the front view of the fine adjustment mechanism, when a photoreceptor drum is used as the photoreceptor. FIG. 36 is a sectional view of the surface parallel to the front view of the fine adjustment mechanism when a photoreceptor belt is used as the photoreceptor. FIGS. 37(*a*) to 37(*c*) are views of the fine adjustment mechanism by a pressure means for the exposure optical systems. FIG. 37(*a*) is a plan view, FIG. 37(*b*) is a side view and FIG. 37(*c*) is a front view.

In FIGS. 34(*a*) and 34(*b*), the exposure optical systems 12(Y, M, C, K) are adhered onto the support member 220A of the support members 220A and 220B, which are divided into two support members, at the adhesion surface shown in the drawing. In this connection, although these drawings show only the left side of the exposure optical systems 12(Y, M, C, K), a similar support member 220A is adhered at the right symmetrical position. Four screw holes 325 (showing only two screw holes in the drawing) are provided on the support member 220B, and screw holes 324 are provided at the corresponding positions on the support member 220A. Both support members 220A and 220B are connected to each other by adjustment screws 323 at four positions between adhesion surfaces of the support members 220A and 220B, sandwiching a spring 326 at each position. Accordingly, an interval between support members 220A and 220B can be finely adjusted by screwing adjustment of the four adjustment screws. In other words, the fine adjustment in the vertical direction of the exposure optical systems 12(Y, M, C, K) can be carried out to the support member 220B by screwing adjustment of the adjustment screws. An elastic member may be used as the spring 326, and, for example, a coil spring made of a steel wire, or a circular pole made of rubber may be used as the elastic member.

FIGS. 35 and 36 are sectional views of the surface, parallel to the front view when the above-described fine adjustment mechanism is provided near both ends of the exposure optical systems 12(Y, M, C, K) of the exposure device, and the exposure optical systems 12(Y, M, C, K) and the image detection element 102 have the same functions and the same structure as those explained in FIGS. 29 and 30. Since FIGS. 35 and 36 are the same as the drawings described above, detailed explanation is omitted. FIGS. 35 and 36 show also the structure of the main portion when the thus structured exposure device is attached to the assembly tool.

That is, the image signal detected by the image detection element 102 as described above, is enlarged and confirmed on the monitor, and the exposure optical systems 12(Y, M, C, K) are easily adjusted at their optimum positions by the adjustment screws 323. For example, the exposure optical systems 12(Y, M, C, K) are successively moved in the arrowed direction, and the positions of the four exposure optical systems 12(Y, M, C, K) can be adjusted. The exposure device in which positions of the exposure optical systems (Y, M, C, K) are adjusted as described above, is removed from the assembly tool, and then mounted in the image forming apparatus. Of course, the positional accuracy of the exposure optical systems 12(Y, M, C, K) and the photoreceptor drum or the photoreceptor belt of the image forming apparatus is maintained throughout.

FIGS. 37(*a*) to 37(*c*) are views showing a case in which the fine adjustment mechanism by a pressure means is used as the above-described fine adjustment mechanism. In the drawings, the exposure optical systems 12(Y, M, C, K) are structured as follows. The exposure optical systems 12(Y, M, C, K) are located between the left side wall 220L and the right side wall 220R provided on the support member 220. Four adjustment screws 323 are respectively screwed into threaded holes provided on each of the left and right side walls 220L and 220R such that the exposure optical systems 12(Y, M, C, K) are sandwiched between the left and the right walls, and are pressed by the adjustment screws 323 and then secured. In the same way as described above, the image detection element 102 which is already accurately positioned, is provided in the vicinity of the left and right ends of the exposure optical systems 12(Y, M, C, K) in the longitudinal direction as shown in the drawing, and the image signal detected by the image detection element 102, is enlarged and confirmed on the monitor, not shown in the drawing, and the exposure optical systems 12(Y, M, C, K) are adjusted at their optimum positions by the adjustment screws 323. In this case, the exposure optical systems 12(Y, M, C, K) can be adjusted in all directions by the adjustment screws, and highly accurately adjusted with the screws.

As described above, after the position of the exposure optical systems 12(Y, M, C, K) to the photoreceptor drum or the photoreceptor belt has been accurately determined, the exposure device in which positions of the exposure optical systems 12(Y, M, C, K) have been adjusted, is mounted in the image forming apparatus. In this case, the positional accuracy of the exposure optical systems 12(Y, M, C, K) to the photoreceptor drum or the photoreceptor belt of the image forming apparatus is naturally maintained.

FIGS. 38(*a*) and 38(*b*) are views to explain the exposure optical systems. FIG. 38(*a*) is a plan view of the light emitting element on a circuit board, and FIG. 38(*b*) is a front view of the exposure device in which the exposure optical systems composed of the circuit board and SELFOC lenses, are used.

In FIGS. 38(*a*) and 38(*b*), a plurality of rows of a plurality of light emitting elements of yellow 121Y, magenta 121M, cyan 121C and black 121K, that is, 4 rows in this example, are arranged with the row interval accuracy less than 100 μm which is within the regulated accuracy on the circuit board 119. Rows of SELFOC lenses 122 are arranged corresponding to the rows of the light emitting elements on the circuit board 119 and the exposure optical system 12 is formed. The exposure optical system is structured such that images of the light emitting elements are formed on the outer surface of the photoreceptor belt 101.

Since the light emitting element for each color of the thus structured exposure optical systems 12(Y, M, C, K) on the circuit board 119 is integrally printed simultaneously on the circuit board 119 respectively, the row interval is very accurately formed. Accordingly, the row interval of rows of images of light emitting elements which are formed on the outer surface of the photoreceptor belt 101, is also very accurately maintained corresponding to the rows of the SELFOC lenses 122 arranged on the circuit board 119. Therefore, a multi-color image can be formed with high image quality in which the degree of color deviation is very small. In other words, the exposure optical system for each color is easily positioned, which can reduce the cost of the exposure optical systems. Specifically, the exposure optical systems according to the present invention is effective as the exposure optical systems of the exposure device in the case where a photoreceptor belt is used as the photoreceptor, when the light emitting element for each color is formed by being spread on a plane of one circuit board.

Due to the present invention, the exposure device, exposure device assembly method and exposure optical system are provided which can be easily and accurately assembled and adjusted, and in which high quality image formation can be carried out at low cost.

Prior to explanation of each example, the structure and operational functions of a color image forming apparatus, which are common to each example, will be described below referring to FIG. 12 and FIGS. 39 to 46(*c*).

FIG. 12 shows a color image forming apparatus having an internally enclosed image exposure means in which the image exposure means is accommodated in the image forming body. However, the present invention is also applied to a color image forming apparatus having an externally arranged exposure means in which the image exposure means is arranged outside the image forming body.

Exposure optical systems 12(Y, M, C, K) in FIG. 12 are attached onto the pole-shaped support member 220, and are accommodated in the photoreceptor drum 10. The exposure optical systems 12(Y, M, C, K) may be composed of a combination of optical shutter members such as LCDs, LISAs, PLZTs, etc., and image formation lenses such as SELFOC lenses, other than the above-described light emitting elements.

Next, processes of the color image formation in the apparatus will be described, mainly concerning any points different from the above-described examples.

Figure 39:
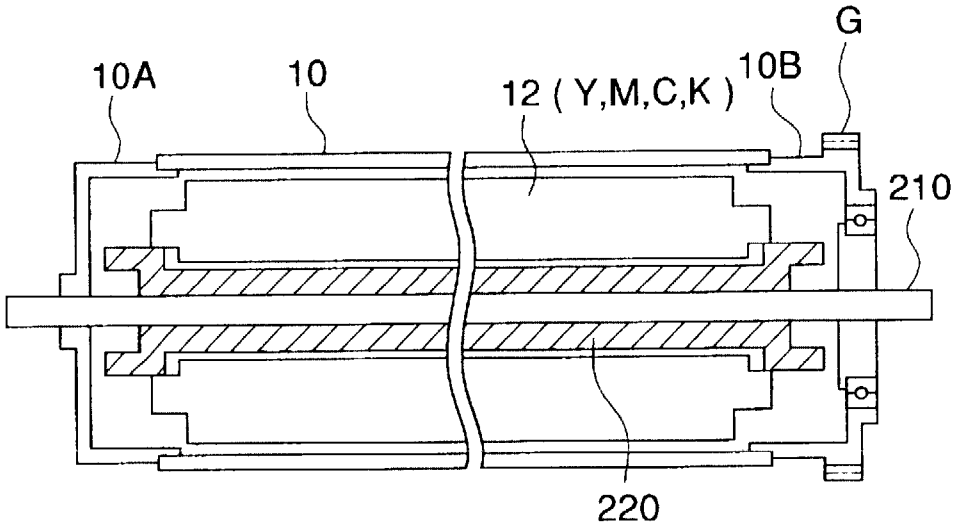
FIG. 39 is a sectional view showing a supporting mechanism of the image exposure means in the case of internal exposure.

As shown in FIG. 39, flange members 10A and 10B, provided at both ends of the photoreceptor drum for engaging and fixing the photoreceptor drum, are rotatably supported directly or indirectly by the drum shaft 210 which is fixed to the apparatus main body, and a gear G, integrally provided with the flange member 10B is engaged with the drive gear of the apparatus main body and is thus driven. Thereby, the photoreceptor drum 10 is rotated in a predetermined direction.

The drum shaft 210 passes through the support member 220 to which the exposure optical systems 12(Y, M, C, K) are attached and fixed, and is integrally fixed inside the photoreceptor drum 10.

Figure 40:
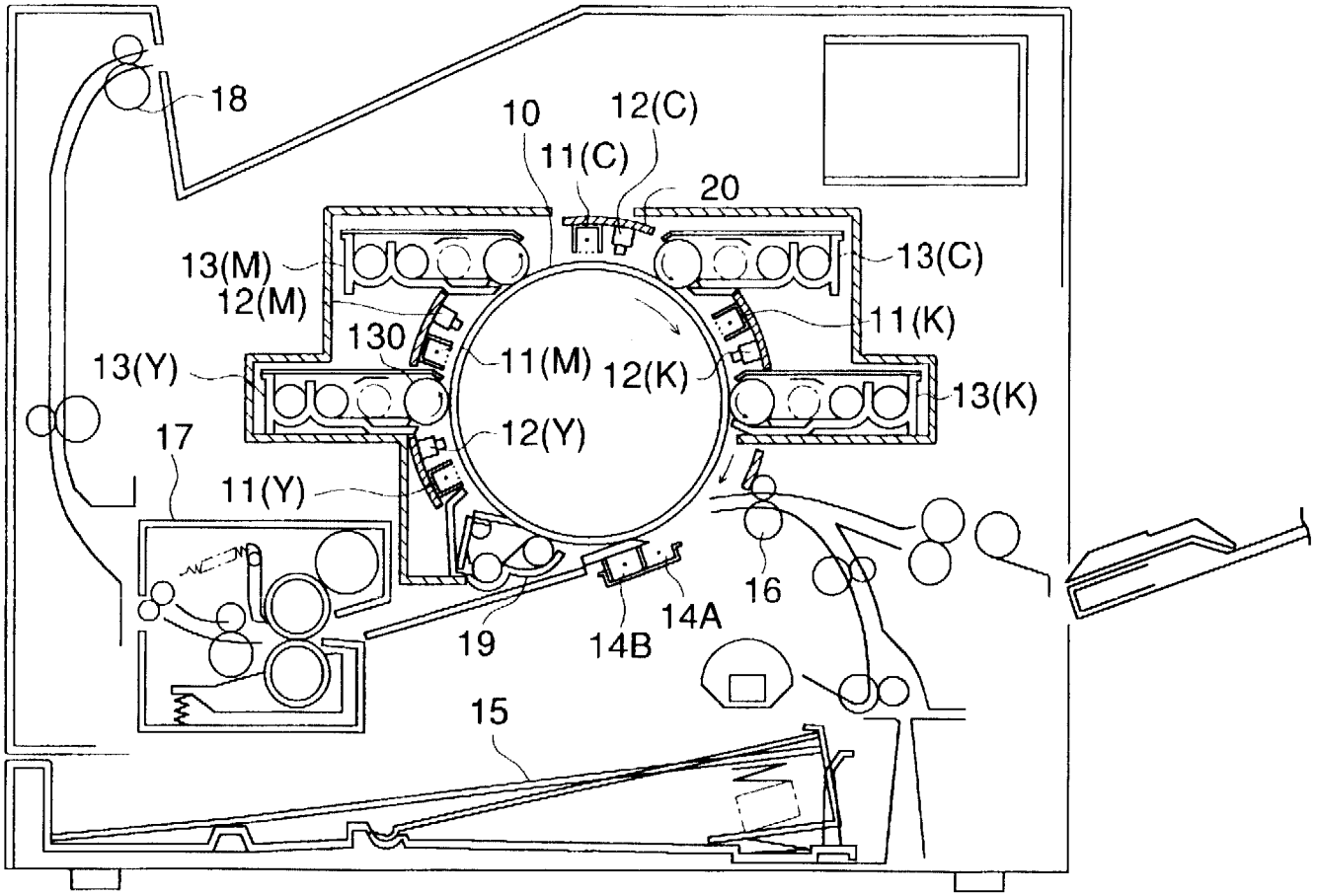
FIG. 40 is a sectional structural view of other color image forming apparatus of external exposure type.

FIG. 40 shows a color image forming apparatus having an externally arranged exposure means of another example, and shows a structure in which the exposure optical systems 12(Y, M, C, K) are arranged outside the photoreceptor drum 10. As shown in the above-described FIG. 39, the photoreceptor drum 10 is structured as follows. Flange members 10A and 10B, provided at both ends of the photoreceptor drum for engaging and fixing the photoreceptor drum, are rotatably supported directly or indirectly by the drum shaft 210 which is fixed to the apparatus main body, and a gear G integrally provided with the flange member 10B is engaged with the drive gear of the apparatus main body and is thereby driven. The photoreceptor drum 10 is thus rotated in a predetermined direction.

Figure 41:
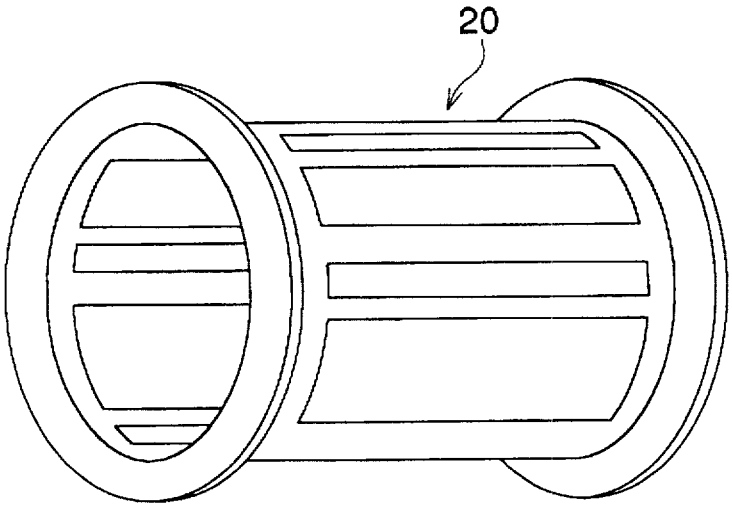
FIG. 41 is a perspective view of a support member of the image exposure means used for external exposure.

FIG. 41 shows the support member 20, which is one of parts, for holding the exposure optical systems 12(Y, M, C, K) of the example shown in FIG. 40. The support member 20 covers the photoreceptor drum 10 and is a cylindrical member coaxially aligned with the photoreceptor drum 10. The exposure optical systems 12(Y, M, C, K) are fixed on the peripheral surface of the support member 20. Slots in the support member 20 shown in FIG. 41, are provided for inserting developing units 13(Y, M, C, K) and exposure optical systems 12 (Y, M, C, K).

Each invention, described as follows, relates to a method for attaching and fixing the exposure optical systems 12(Y, M, C, K) onto the above-described support member 220, or a support member 20.

An adjustment device 100 shown in FIG. 42 (*a*) is used for setting the attachment positions of the exposure optical systems 12(Y, M, C, K) onto each support member 220 in the color image forming apparatus shown in FIG. 12.

The adjustment device 100 is composed of: a fine-movement stage 110 by which the exposure optical system 12 is clamped and held; a sliding base 320 which supports CCDs and moves parallel along a linear scale; and a rotational angle setting means 230 provided with a rotary encoder by which the support member 220 is supported and the position of the attached surface is set when being rotated at a predetermined angle. The image formation surface of the CCD is moved in parallel with the axis of the support member 220 under the condition that the surface of the CCD is accurately set at a position corresponding to the photoreceptor surface of the photoreceptor drum 10.

When the angle and position of the exposure optical system 12 with respect to the CCD surface, which is held by fine adjustment of the horizontal and vertical angles, are adjusted and the exposure optical system 12 is minutely moved perpendicular to the surface of the CCDs, then, the focusing point of the exposure optical system 12 is focused on the CCD surface, and the relative positional relationship of the exposure optical system 12 with respect to the support member 220 is adjusted, as shown in the sectional view of the main portion (FIG. 42 (*b*)). The adjustment of the focusing position of the entire exposure optical system 12 with respect to the CCD surface is carried out at, at least, two positions in the vicinity of both ends of the exposure optical system 12 by parallely moving the sliding base 320.

Figure 43:
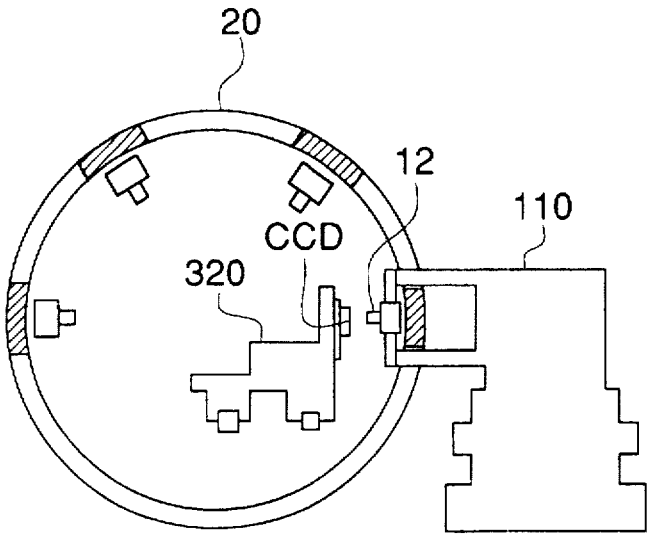
FIG. 43 is an illustration showing a type for mounting the image exposure means onto the support member used for external exposure.

In the case of color image forming apparatus shown in FIG. 40 in which the exposure optical system 12 is arranged outside the photoreceptor drum 10, the following are used: the fine movement stage 110 which holds the exposure optical systems 12 inside the support member 20 utilizing the cutout of the support member 20 as shown in FIG. 43; the sliding base 320 which moves in parallel with the axis of photoreceptor drum (the axis of the support member 20) in the support member 20; and the rotational angle setting means, not shown in the drawing, provided with an encoder which supports the support member, and by which the position of the attached surface is set when rotating at a predetermined angle. In this case, in the same way as shown in FIGS. 42(*a*) and 42(*b*), the focusing point of the exposure optical system 12 is focused on the CCD surface, and the relative positional relationship of the exposure optical system 12 with respect to the support member 20 is adjusted.

(EXAMPLE 8)

Figure 44:
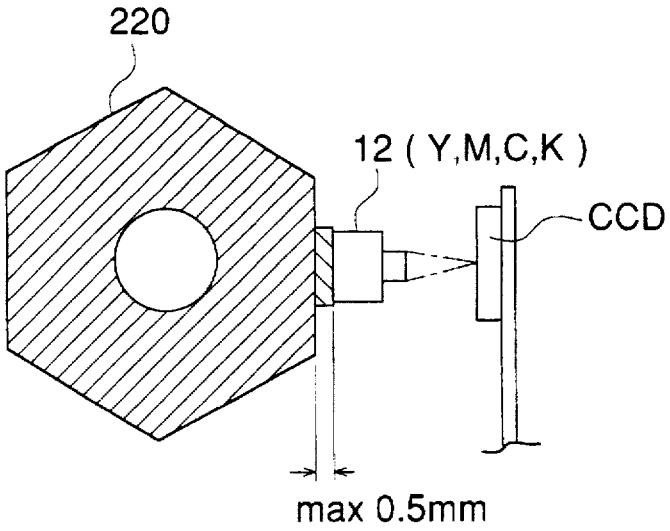
FIG. 44 is an illustration showing a direct fixing method of the image exposure means with adhesive agents.

An example of the invention will be described below referring to FIG. 44.

After the positions of the exposure optical systems 12(Y, M, C, K) with respect to the CCDs have been adjusted, the exposure optical systems 12(Y, M, C, K) are adhered to the support member 220 with an adhesive agent, and fixed onto the support member 220.

A preset gap between the back of the exposure optical systems 12(Y, M, C, K) and the surface of the support member 220, onto which the exposure optical systems 12(Y, M, C, K) are to be attached, is determined as the minimum gap as follows. Individual difference including fluctuations among the focal distance of the exposure optical systems 12(Y, M, C, K), any adjustment error at the time of focal position setting, or any manufacturing error of the support member 220 itself, is considered, and the above-described gap is set to a minimum gap including the coating thickness of the adhesive agent. The gap is coated and filled by an adhesive agent.

As an adhesive agent, the following is used: a low hardening contraction type, for example, an ultraviolet ray hardening type denatured acrylic resin adhesive agent which has a small contraction ratio during hardening; or an epoxy resin adhesive agent which has a contraction ratio (volume) of less than 10%. Generally, when the accuracy of the related parts dimensions is increased, the gap width required for adjustment is decreased. Since the gap width of 0.5 mm is sufficient, at the maximum, the positional variation of the exposure optical systems 12(Y, M, C, K) due to contraction of the adhesive agent after adjustment and adhesion, is within 0.02 mm, at the maximum. Accordingly, this value results in allowable slippage amount under the condition that the exposure optical systems are fixed into position.

According to the present invention, the exposure optical systems 12(Y, M, C, K) are accurately fixed at predetermined positions on the support member 220 by only an adhesive agent. As a result, conventional fine adjustment mechanisms to support the exposure optical system, or a fixing screw member to fix the exposure optical systems onto the support member, or the like, is not necessary. Accordingly, cost can be reduced by simplification of the mechanism, and reduction of assembly time.

(EXAMPLE 9)

An example of the invention will be described referring to FIGS. 45(*a*) and 45(*b*).

The focus position of the image exposure means, which is conventionally adjusted by visual observation, is automatically adjusted in the present invention.

Previously, optical characteristics of the exposure optical systems 12 were investigated; variations of the half band width or the maximum luminance as shown in FIGS. 45(*a*) and 45(*b*), corresponding to deviation of the image formation position from the regular focus position, are found and programmed by the approximate expressions, the degree of which is not higher than the fourth degree, and are stored in a focus position adjustment memory. As can clearly be seen from FIGS. 45(*a*) and 45(*b*), the half band width is the minimum, and the maximum luminance is the maximum value at the focused position.

The CCDs supported by the sliding base 120 of the adjustment device 100 are two-dimensional area type CCDs, and are located at two positions on the linear scale so that the CCDs correspond to positions in the vicinity of both ends of the exposure optical systems 12(Y, M, C, K) provided at predetermined positions in the primary scanning direction.

When the position of the exposure optical systems 12(Y, M, C, K) is adjusted to the focus position, the half band width or the maximum luminance is measured at, at least, 3 positions, that is, at the front and rear of the position presumed to be the focused position, and the presumed position itself. The measured values are plotted (substituted) on the program (the approximate expression not being higher than the fourth dimensional equation), and the focus position is calculated. The positions of the exposure optical systems 12(Y, M, C, K) are automatically controlled so that they can be moved at the calculated values. Then, the positions of the exposure optical systems 12(Y, M, C, K) are set by assuming the stop position of the exposure optical systems 12(Y, M, C, K) to be the focused position. In FIGS. 45(*a*) and 45(*b*), black dots show three measured points, and X shows the focused position which is obtained by the calculation.

Further, when the two-dimensional CCD is used, the positions in the primary and subsidiary scanning directions of the exposure optical systems 12(Y, M, C, K) can be automatically set by providing the attachment reference position on the CCD. When the positions in the primary and subsidiary scanning directions are automatically set successively after the focus position setting, entirely automatic setting of positions of the exposure optical systems 12(Y, M, C, K) can be carried out.

(EXAMPLE 10)

An example of the invention will be described below referring to FIGS. 46(*a*), 46(*b*) and 46(*c*).

After the position of the exposure optical systems 12(Y, M, C, K) with respect to the CCD has been determined by the adjustment device 100, the exposure optical systems 12(Y, M, C, K) are adhered and fixed onto the support member 220 by the adhesive agent through a pair of adherence members between the exposure optical systems 12(Y, M, C, K) and the support member 220.

The adherence member is formed of material which efficiently transmits the ultraviolet ray, and an ultraviolet hardening type adhesive agent is used as the adhesive agent.

The exposure optical systems 12(Y, M, C, K) shown in FIG. 46(*a*) are integrally provided with the adherence members 120A provided on both ends of the exposure optical systems 12(Y, M, C, K), and the adhesive agent coated onto and filling the gap between the adherence members 120A and the attachment surface of the support member 220, is thus hardened and fixed by irradiation by the ultraviolet rays, transmitting the adherence member 120A.

The exposure optical systems 12(Y, M, C, K) shown in FIG. 46(*b*) are adhered to the attachment surface of the support member 220 through an L-shaped adherence member 120B. The ultraviolet ray hardening adhesive agent which is coated onto and fills the gap between the adherence member 120B and the exposure optical systems 12(Y, M, C, K), and between the adherence member 120B and the attachment surface of the support member 220, is hardened and fixed by irradiation by the ultraviolet rays which are dispersed in and transmit through the adherence member 120B.

Further, the exposure optical systems 12(Y, M, C, K) shown in FIG. 46(*c*) are adhered onto the attachment surface of the support member 220 through an wedge-shaped adherence member 120C for adjustment. The adhesive agent coated onto and filling the gap between the adherence member 120C and the attachment surface of the support member 220, and between the adherence member 120C and the exposure optical systems 12(Y, M, C, K), is hardened and fixed by irradiation of the ultraviolet ray which transmits the adherence member 120C and is reflected inside it.

Adherence operations of the exposure optical systems shown in FIGS. 46(*a*) to 46(C) onto the support member can be very easily and efficiently carried out in a normally lighted room, and the exposure optical systems 12(Y, M, C, K) can be accurately fixed immediately at the adjustment position by irradiation by ultraviolet rays after the adjustment has been completed.

According to the present invention, a plurality of image exposure means can be accurately and securely adjusted and fixed at the predetermined positions corresponding to the photoreceptor surface in a short time, without assembling the adjustment mechanism or fixing members inside the apparatus. As a result, there has been realized a color image forming apparatus, in which the structure is simpler, and to which the cost reduction can be expected.

What is claimed is:

1. An optical system assembling method in an image forming apparatus in which there are provided an image forming body around which a plurality of exposure means each comprising a linear exposure optical system to image-wise expose on the image forming body to form a color image, the method comprising the steps of:

(a) lighting the exposure optical system;

(b) forming an image emitted from the exposure optical system on a sensor which is disposed at a position corresponding to a surface of the image forming body for the exposure optical system;

(c) adjusting a position of the exposure optical system with respect to the sensor on the basis of a result of the image forming so that a focal point of the exposure optical system is coincident with the sensor; and (d) fixing at the adjusted position the exposure optical system to an optical system supporting body provided on a main body of the apparatus.

2. The assembling method of claim 1, wherein the exposure optical system is disposed so that the exposure optical system exposes the surface of the image forming body from an outside of the image forming body.

3. The assembling method of claim 1, wherein the exposure optical system is disposed so that the exposure optical system exposes the surface of the image forming body from an inside of the image forming body.

4. The assembling method of claim 1, wherein the exposure optical system comprises a linear light emitting means and a linear lens.

5. The assembling method of claim 1, wherein the sensors are disposed at positions corresponding to both ends of the linear exposure optical system.

6. The assembling method of claim 1, wherein the linear exposure optical system comprises a plurality of light emitting elements arranged in a longitudinal direction of the linear exposure optical system, and the lighting step comprises the step of lighting specific light emitting elements located at positions opposite to the sensors.

7. The assembling method of claim 6, wherein the image forming step comprises the step of measuring a position and a luminance of the specific light emitting elements, and the adjusting step comprises the step of moving the exposure optical system on the basis of the measured position and luminance, and the step of adjusting the exposure optical system so that the position and the luminance of the light emitting elements are within a predetermined range.

8. The assembling method of claim 1, wherein the adjusting step is repeated so that the plurality of the exposure optical systems are positioned to each other.

9. The assembling method of claim 1, wherein the sensor is commonly used for the plurality of the exposure optical system.

10. The assembling method of claim 1, wherein a plurality of sensors are provided for the plurality of the exposure optical system.

11. The assembling method of claim 1, wherein the fixing step further comprises the steps of:

inserting an inserting member having penetrability in an ultraviolet ray wavelength area between the exposure optical system and the optical system supporting body;

applying an ultraviolet ray hardening resin in a vicinity of a contacting portion between the inserting member and the exposure optical system, and to a portion in a vicinity of a contacting portion between the inserting member and the optical system supporting body; and irradiating an ultraviolet ray to the inserting member so that the exposure optical system and the supporting body are adhered to each other through the inserting member by hardening the ultraviolet ray hardening resin.

12. The assembling method of claim i, wherein the adjusting step comprises the step of adjusting the exposure optical system by a fine adjustment means provided outside the optical system supporting body.

13. The assembling method of claim 1, wherein the adjusting step comprises the step of adjusting the exposure optical system by a fine adjustment means provided inside the optical system supporting body.

14. The assembling method of claim 13, wherein the fine adjustment means comprises an elastic member and a fastening member.

15. The assembling method of claim 1, wherein the fixing step comprises the step of fixing the exposure optical system to the optical system supporting body through a low hardening contractile adhesive agent.

16. The assembling method of claim 1, wherein the image forming step comprises the steps of:

measuring a change in a luminance or a diverging light amount emitted from the exposure optical system while changing a distance between the exposure optical system and the sensor; and calculating a focal point of the exposure optical system on the basis of the measured change;

and wherein the adjusting step comprises the step of:

moving the exposure optical system on the basis of the calculated focal point.

17. The assembling method of claim 1, wherein the image forming apparatus is further provided with a plurality of developing means containing respective color toners different from each other which are superimposed on a photosensitive surface of the image forming body to form a color toner image.

* * * * *